US008337271B2

(12) United States Patent
Campbell et al.

(10) Patent No.: US 8,337,271 B2
(45) Date of Patent: Dec. 25, 2012

(54) RECONFIGURABLE TOY

(75) Inventors: Fraser Campbell, Venice, CA (US); Dwayne Vance, Corona, CA (US)

(73) Assignee: Mattel, Inc., El Segundo, CA (US)

( * ) Notice: Subject to any disclaimer, the term of this patent is extended or adjusted under 35 U.S.C. 154(b) by 21 days.

(21) Appl. No.: 12/871,547

(22) Filed: Aug. 30, 2010

(65) Prior Publication Data

US 2011/0076915 A1 Mar. 31, 2011

Related U.S. Application Data

(63) Continuation of application No. 11/303,830, filed on Dec. 16, 2005, now abandoned.

(60) Provisional application No. 60/684,571, filed on May 24, 2005.

(51) Int. Cl.
*A63H 3/46* (2006.01)
*A63H 33/00* (2006.01)

(52) U.S. Cl. ..... 446/376; 446/487

(58) Field of Classification Search ..... 446/99–100, 446/321, 376, 487; D21/581, 582, 584
See application file for complete search history.

(56) References Cited

U.S. PATENT DOCUMENTS

| | | | | |
|---|---|---|---|---|
| 276,539 | A | | 4/1883 | Reed |
| 1,235,771 | A | | 8/1917 | Dettra |
| 1,277,702 | A | | 9/1918 | Des Combs |
| 1,363,891 | A | | 12/1920 | Lovington |
| 1,859,100 | A | | 5/1932 | Lewis |
| 2,052,841 | A | | 9/1936 | O'Donnell |
| 2,116,279 | A | | 5/1938 | O'Donnell |
| 2,182,913 | A | | 12/1939 | Brubaker |
| 2,308,524 | A | | 1/1943 | Longnecker |
| 2,310,084 | A | | 2/1943 | Hooker et al. |
| 2,347,657 | A | | 5/1944 | Binks |
| 2,385,724 | A | | 9/1945 | Olson |
| 2,457,653 | A | | 12/1948 | Froelich |
| 2,472,297 | A | | 6/1949 | Holt |
| 2,503,707 | A | | 4/1950 | Braman |
| 2,503,877 | A | | 4/1950 | Kuemmerlein et al. |
| 2,597,094 | A | | 5/1952 | Gutmann |
| 2,751,634 | A | | 6/1956 | Washington |
| 2,757,482 | A | | 8/1956 | Brown et al. |
| 2,803,920 | A | | 8/1957 | Salosky |
| 2,878,615 | A | | 3/1959 | Burgin |
| 3,025,846 | A | | 3/1962 | Crosman |
| 3,037,772 | A | | 6/1962 | Bonanno |
| 3,109,645 | A | | 11/1963 | Thorson |
| 3,151,866 | A | | 10/1964 | Glass et al. |
| 3,177,612 | A | | 4/1965 | Giossi |
| 3,346,989 | A | | 10/1967 | Ryan et al. |
| 3,594,947 | A | * | 7/1971 | Hartling et al. ..... 446/268 |
| 3,722,124 | A | | 3/1973 | Nathanson et al. |
| 3,802,098 | A | | 4/1974 | Sampson et al. |
| 3,813,795 | A | | 6/1974 | Marshall et al. |
| 3,917,270 | A | | 11/1975 | Gothard, Jr. et al. |

(Continued)

*Primary Examiner* — Gene Kim
*Assistant Examiner* — Alyssa Hylinski
(74) *Attorney, Agent, or Firm* — Edell, Shapiro & Finn LLC

(57) ABSTRACT

A reconfigurable toy including a body, a first leg coupled to the body, and a second leg coupled to the body is disclosed. The reconfigurable toy can be disposed in a first configuration in which the toy resembles a toy vehicle and in a second configuration in which the toy resembles a power-suit configuration.

17 Claims, 44 Drawing Sheets

U.S. PATENT DOCUMENTS 4,095,367 A * 6/1978 Ogawa ..... 446/73
4,107,872 A 8/1978 Tucker et al.
4,118,888 A 10/1978 Ogawa
4,125,961 A 11/1978 Yamashina
4,126,312 A 11/1978 Kreuzer et al.
4,145,049 A 3/1979 Papazian, Sr.
4,167,830 A 9/1979 Ogawa
4,206,564 A 6/1980 Ogawa
4,226,292 A 10/1980 Monte et al.
4,232,865 A 11/1980 Chen et al.
4,248,006 A 2/1981 Jones et al.
4,299,301 A 11/1981 Janin
4,345,765 A 8/1982 Wang
4,382,347 A 5/1983 Murakami
4,391,060 A 7/1983 Nakane
4,393,620 A 7/1983 Murakami
4,502,691 A 3/1985 Ratliff et al.
4,509,760 A 4/1985 Goldfarb et al.
D281,001 S 10/1985 Ohno
D281,088 S 10/1985 Murakami
4,571,197 A 2/1986 Kulesza et al.
4,571,203 A 2/1986 Murakami
4,580,993 A * 4/1986 Ohno ..... 446/376
4,583,958 A 4/1986 Matsuda
D283,717 S 5/1986 Obara
4,586,911 A * 5/1986 Murakami ..... 446/376
4,596,533 A 6/1986 Kennedy et al.
4,614,504 A * 9/1986 Yamasaki ..... 446/356
D286,169 S 10/1986 Ohno
4,626,223 A 12/1986 Sweet
D288,832 S * 3/1987 Koshikawa ..... D21/579
D289,665 S 5/1987 Nagano
D290,481 S * 6/1987 Kitamura ..... D21/580
D290,723 S 7/1987 Kitamura
4,708,688 A 11/1987 Lee
4,717,367 A 1/1988 Stubenfoll et al.
D294,610 S * 3/1988 Matsumoto ..... D21/581
D295,299 S 4/1988 Shibukawa
D295,300 S 4/1988 Yoke
D295,303 S 4/1988 Matsumoto
D296,801 S 7/1988 Matsumoto
D296,914 S 7/1988 Matsumoto
D297,035 S 8/1988 Yoke
D297,038 S 8/1988 Ohno
4,822,316 A 4/1989 Shaffer et al.
D301,351 S 5/1989 Doi
D301,352 S 5/1989 Doi
D301,355 S 5/1989 Doi
D301,356 S 5/1989 Doi
D301,359 S 5/1989 Shinohara
D301,505 S 6/1989 Kunihiro
D301,901 S 6/1989 Doi
4,844,474 A 7/1989 Schaub et al.
4,846,752 A 7/1989 Combs
D303,409 S * 9/1989 Shinohara ..... D21/581
4,863,412 A 9/1989 Mihalinec
D305,919 S 2/1990 Shibukawa
D306,046 S 2/1990 Shibukawa
D306,623 S 3/1990 Doi
4,906,215 A * 3/1990 Reiling et al. ..... 446/94
D307,777 S 5/1990 Shinohara
D307,926 S 5/1990 Shinohara
4,934,937 A 6/1990 Judd
D311,042 S 10/1990 Ikeda
D311,043 S 10/1990 Kunihiro
5,050,817 A 9/1991 Miller
5,061,217 A 10/1991 Miller et al.
D324,892 S 3/1992 Kwan
5,100,153 A 3/1992 Welte
5,125,668 A 6/1992 Welte
5,127,658 A 7/1992 Openiano
5,248,019 A 9/1993 Sbarro
5,281,142 A 1/1994 Zaenglein, Jr.
5,334,073 A 8/1994 Tilbor et al.
5,334,078 A 8/1994 Hippely et al.
5,380,231 A 1/1995 Brovelli
5,586,924 A 12/1996 Huang
5,702,107 A 12/1997 Novak
5,713,783 A 2/1998 Szoke et al.
5,779,515 A 7/1998 Chung
5,785,592 A 7/1998 Jacobsen
5,810,638 A 9/1998 Wood
5,906,528 A 5/1999 Ostendorff et al.
5,971,832 A 10/1999 Siboni
D424,633 S 5/2000 Hollis et al.
6,074,271 A 6/2000 Derrah
6,086,446 A 7/2000 Arriola
6,093,078 A 7/2000 Cook
6,106,356 A 8/2000 Trageser
6,224,457 B1 5/2001 Wu
6,315,630 B1 11/2001 Yamasaki
6,322,365 B1 11/2001 Shechter et al.
6,350,171 B1 2/2002 Hippely et al.
D469,828 S 2/2003 Tsai
6,533,638 B1 3/2003 Nelson et al.
6,557,855 B2 5/2003 Wu
6,752,684 B1 6/2004 Lee
6,793,552 B2 9/2004 Derrah
6,805,657 B2 10/2004 Trenary
6,852,000 B2 * 2/2005 Lee et al. ..... 446/476
6,893,318 B2 * 5/2005 Soviknes et al. ..... 446/379
2002/0158412 A1 10/2002 Wu
2003/0136900 A1 7/2003 Shechter et al.
2005/0059483 A1 3/2005 Borge
2005/0112988 A1 5/2005 Whitehead
2006/0270310 A1 11/2006 Campbell et al.
2006/0270313 A1 11/2006 Campbell
2006/0270315 A1 11/2006 Campbell

* cited by examiner

RECONFIGURABLE TOY

CROSS REFERENCE TO RELATED APPLICATIONS

This application is a continuation of U.S. patent application Ser. No. 11/303,830, entitled "Reconfigurable Toy Extreme Sport Jumper," filed Dec. 16, 2005, no abandoned the disclosure of which is incorporated by reference herein in its entirety, which claims the benefit of U.S. Provisional Patent Application No. 60/684,571, filed May 24, 2005. The entirety of U.S. Provisional Patent Application No. 60/684,571 is hereby incorporated herein by reference for all purposes, as are each of the following: U.S. Design application No. 29/240,599, filed Oct. 14, 2005; U.S. Design application No. 29/240,807, filed Oct. 18, 2005; U.S. Design application Ser. Nos. 29/240,916 and 29/240,939, filed Oct. 19, 2005; and U.S. Design application Ser. Nos. 29/241,424, 29/241,425, 29/241,433, and 29/241,434, filed Oct. 26, 2005.

BACKGROUND AND SUMMARY

Various types of toys have incorporated a transformation play element. One example is Transformers, which may be reversibly reconfigured between a vehicle mode and a robot mode. Another example is DICE, which can be reversibly reconfigured between a vehicle mode and a dinosaur mode. Further, in some examples, the transformation toy may involve an associated figure. For example, with DICE, both vehicle and dinosaur modes may involve a figure that interacts with the reconfigurable toy in manner that allows the figure to ride in or on the toy in both modes.

However, the inventors herein have recognized that the above mentioned reconfigurable toys are apt to be monotonous as dinosaurs and/or robots have commonly been used with transformable toys.

In one approach, the above issues may be addressed by a reconfigurable toy comprising a body, a plurality of wheels operatively coupled with the body, and at least one leg assembly operatively coupled with the body, wherein the toy is reconfigurable between a vehicle configuration where at least one of the wheels is in contact with a ground surface and a power suit configuration where the at least one leg assembly is in contact with the ground surface and the at least one of the wheels is spaced from the ground surface.

In this manner, a single reconfigurable toy assembly can provide two modes of play totally different from each other, with each mode potentially interactive with a figure and each mode allowing the figure to simulate racing and/or other competitive activity such as jumping. In this way, toys that embody sports, particularly physical or extreme sports, can introduce an increased level of excitement and competitive interaction among the toy users. For example, extreme sports such as jumping, climbing, and surfing have recently increased in popularity, and thus can impart an added dimension of new excitement to transformable or other types of toys.

Further, in one example, toy interaction may be encouraged by a trigger configured to cause disassembly of the toy into multiple portions that may then be reassembled, thus further adding to sport play.

DETAILED DESCRIPTION

Figure 1:
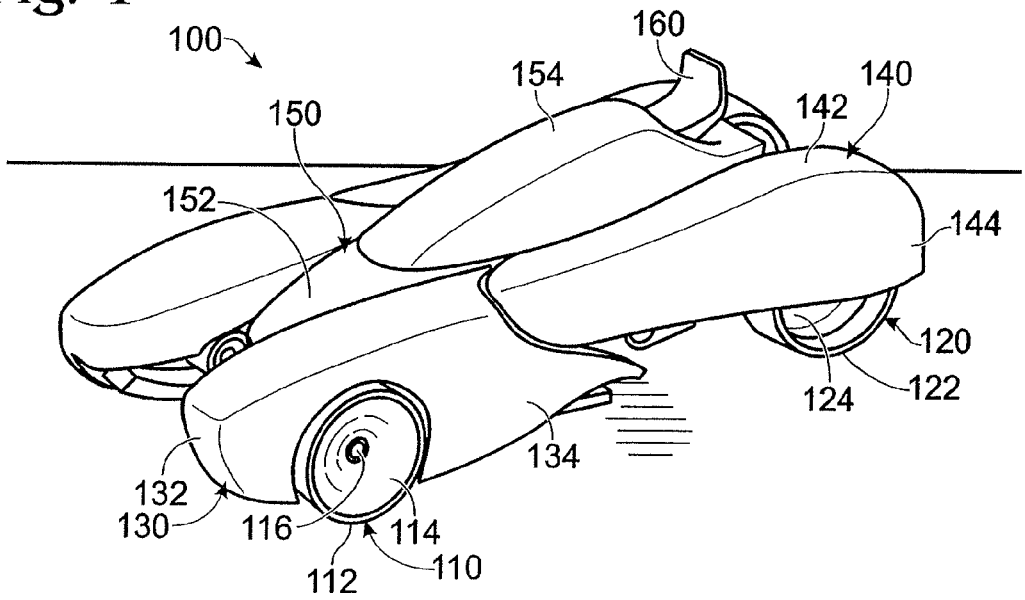
FIGS. 1-19 show a first example toy, which is transformable between a vehicle and a power-suit simulating a skiing activity.

In one example, a set of interrelated toys and accessories may be provided as part of a racing genre. The toys may include vehicles, action figures, computer games, interactive websites, and others. Various themes may be incorporated into one or more of the toys and/or accessories, including speed/racing, transformation, toy collision, and toy conflict. In general, the toys may be any product sold for enjoyment, collectability, recreation, sport, and/or other leisurely pursuit by persons of all ages.

The frame of the toy may be reconfigured into multiple play configurations. In some embodiments, a toy may transform from a first mode or configuration simulating a vehicle to a second mode or configuration simulating a power-suit. As one example, vehicles that embody the concept of racing can transform into racing power-suits in a selected extreme sport activity. Various forms of vehicles may be used, such as motorcycles, cars, trucks, planes, submarines, spaceships, rockets, or other types of vehicles. When in the power-suit mode, the suits may be wearable by an associated action figure, and/or may constitute an outfit. Therefore, it is possible to enjoy not only a vehicle play mode, but also a play mode with the outfit, power-suit, and/or sports activity by reconfiguring the toy.

Hence, a single reconfigurable toy assembly can provide at least two modes of play totally different from each other, but each interactive with a common action figure and each allowing the action figure to simulate racing and/or some other activity, such as a competitive activity. Some examples of wearable power-suits may include: a surfer with surfboard accessory, a skier with accessory skis and/or poles, a rollerblader with accessory rollerblades, a jumper, and a skydiver. Other examples may include a windsurfer, a rock climber, a skateboarder, or a snowboarder among others, and each may include one or more accessories. Further, it may also be possible that the power-suit simulates more than one activity, such as two extreme sports depending on accessories and/or toy configuration. Further, the power-suit mode may include genres other than sports activities. For example, the power-suit may incorporate a battle theme, a creature theme, or a fantasy theme wherein each power-suit corresponds to a specific activity.

In some embodiments, during each play mode or configuration, the toy may be repositioned to further simulate a specific action. For example, a power-suit simulating a surfing activity may be repositioned so that the arms and/or legs of the power-suit simulate a surfing position. Thus, each of the transformable toys may include improved play activity within each configuration or mode by repositioning of various elements. As used herein, the term "configuration" refers to the toy mode (e.g. vehicle, power-suit, etc.) whereas the term "repositioned" refers to the posing of the toy and/or associated action figure when configured as a particular mode or configuration.

Further, a set of related toys which incorporate various themes may further improve play fun or collectability. The previous examples, while relating to a power-suit mode, may nonetheless refer to any toy configuration wearable by an action figure. In this manner, the toy may transform from a vehicle mode where the action figure is riding in/on the vehicle to a mode where the action figure is wearing the power-suit. Further, the toy may accommodate a plurality of interchangeable action figures associated through the use of a common method of attachment. The wearable power-suit may also include four appendages that correspond to, and are proximate to, the four appendages of the action figure wearing the power-suit, in the case of a human or humanoid action figure. Further, the appendages of the power suit may be substantially adjacent to the action figure appendages of which they correspond. In this manner, simulated motion on the part of the action figure may directly correspond to simulated motion of the power-suit worn by the action figure in a realistic way. Further, the action figure and the suit can be positioned in similar poses to enhance the fantastical play mode where the action figure is controlling the power-suit via movement of its own limbs.

In some embodiments, a transformable toy can be configured to separate into one or more pieces when colliding with, or contacting another object, thus simulating disassembly, de-coupling, or breaking apart. Further, such a separation feature can be provided in the vehicle mode and the power-suit mode and/or various other modes. For example, separation of the toy may be initiated by an actuator, such as a trigger or a button among others. The actuator may be configured to be activated by a user, a collision or an interaction with an item ejected by an associated toy, among various others. In some examples, multiple actuators may be utilized to separate specific portions of the vehicle and/or power-suit configuration upon activation. In other examples, the action figure and/or accessory may be ejected from the toy when in any of the various play modes and/or toy configurations. In yet other examples, sounds and/or lights may be used in conjunction with toy disassembly or actuator activation. In this manner, a plurality of simulated collisions and/or toy interactions may be provided, thus further improving toy play.

In some examples, activation of the actuator may cause a different resulting separation or simulated collision/disassembly of the toy depending on mode or configuration. Further, the separation can be automatically generated upon activation of the actuator. For example, when in a vehicle configuration, a collision at the front end of the toy may cause simulated vehicle degradation to occur through the automatic separation of specific portions associated with the vehicle mode. Such automatic separate can generate fun and excitement during play.

Alternatively, when the toy is in power-suit configuration, separation of portions or accessories related specifically to the power-suit mode may occur. In some toy configurations, the trigger may be hidden from view by the user until reconfigured into a different mode. In some embodiments, separation of the toy in one mode may permit alternate reconfiguration of the separate portions thus attaining a different mode. In some examples, a center portion or nucleus may form the uniting portion of the toy to which other releasable portions are attached, where the center portion contains the actuator and separation mechanism. Such separation features may also allow another mode of play, and further can allow such improved play in both vehicle and power-suit modes.

In some embodiments, one or more of the transformable toys described herein may further include a lock-out feature that is configured to deactivate the actuator, which in turn causes disassembly and/or uncoupling of the various portions. For example, in a first mode, the transformable toy may be separated into two or more pieces when the actuator is activated, while in a second mode wherein the lock-out mechanism is enabled, an activation of the actuator does not cause disassembly or separation of the transformable toy. In this manner, if desired, a user can operate the transformable toy without utilizing the disassembly feature as described above.

As still another example of play, the vehicles and or power-suits may be fitted with accessories that are configured to eject items at other toy vehicles and/or wearable power-suits to cause disassembly to occur, thus further encouraging toy interaction. In some embodiments, sub-accessories may be ejected from an accessory by a user activating an actuator or similar device to the actuator causing separation of the toy as discussed above. Further, the reconfigurable toy may contain a plurality of ejectable items and/or subaccessories each controlled by one or more actuators. In some examples, accessories associated with a particular mode may transform to become a simulated weapon or ejecting device in another mode or configuration. For example, accessories that represent vehicle portions in the vehicle mode (e.g., exhaust pipes) may become simulated weapons (e.g., rocket launchers) in the power-suit mode. In other examples, ejectable items and/or the associated actuators may be hidden from view or activation by the user in certain modes and/or configurations.

In this manner, a reversibly reconfigurable toy may incorporate an associated action figure where in a vehicle mode, the action figure rides in/on the toy, and while in a power-suit mode the action figure wears the reconfigurable toy. In conjunction with the reconfigurable/transformable operation, the toy may also eject items and/or receive ejected items in the form of toy disassembly or separation, thus simulating a collision and/or disassembly, which may further serve to promote toy interaction and improve play fun.

Several examples of reconfigurable toys will be described herein. Specifically, FIGS. 1-19 show a toy that can transform between a vehicle mode and a power-suit mode simulating a skiing activity. FIGS. 20-36 show a toy that can transform between a vehicle mode and a power-suit mode simulating a surfing activity. FIGS. 37-47 show a toy that can transform between a vehicle mode and a power-suit mode simulating a skydiving activity. FIGS. 48-61 show a toy that can transform between a vehicle mode and a power-suit mode simulating a hang-gliding activity. FIGS. 62-69 show a toy that can transform between a vehicle mode and a power-suit mode simulating a rollerblading activity. FIGS. 70-74 show a toy that can transform between a vehicle mode and a power-suit mode simulating a jumping activity.

The action figures described herein are non-limiting examples of reversibly reconfigurable (i.e. transformable) toys, and other transformations are within the scope of this disclosure. It should also be appreciated that features shown relating to the various embodiments may be included in the other embodiments. In other words, features may be mixed and matched among the embodiments presented herein.

Referring now to FIGS. 1-19, an example reconfigurable toy that transforms between a vehicle mode and a power-suit mode simulating a skiing activity is described. As described here, the transformable toys can be transformed between the vehicle mode and the power-suit mode without requiring physical separation of portions of the toy or otherwise disassembling the toy in any way (although such features may be used, if desired). Thus, in one example, the toy may remain completely assembled during the transformation between a first configuration (e.g. vehicle) and a second configuration (e.g. power-suit), or between various poses within the same mode. However, while not shown in the following examples, in some embodiments, a transformable toy may be partially disassembled to facilitate the transformation process. As described in more detail below, one or more of the joints that enable transformation can be points of separation when a trigger mechanism is actuated.

In examples where the transformation may be completed between a first and second configuration without requiring disassembly, various advantages may be achieved. For example, in toys requiring at least some disassembly when transforming, the user may become confused as to where various parts are supposed to be coupled, or may accidentally disassembly components that are not necessary to be disassembled to effect the transformation. Further, in some cases, the user may find enjoyment in learning and understanding how transformation provides a toy that simulates at least two different toys each having a different overall outward appearance, without needing to disassemble components. Finally, toys requiring disassembly may often result in the user losing components, possibly rendering the toy useless.

Figure 2:
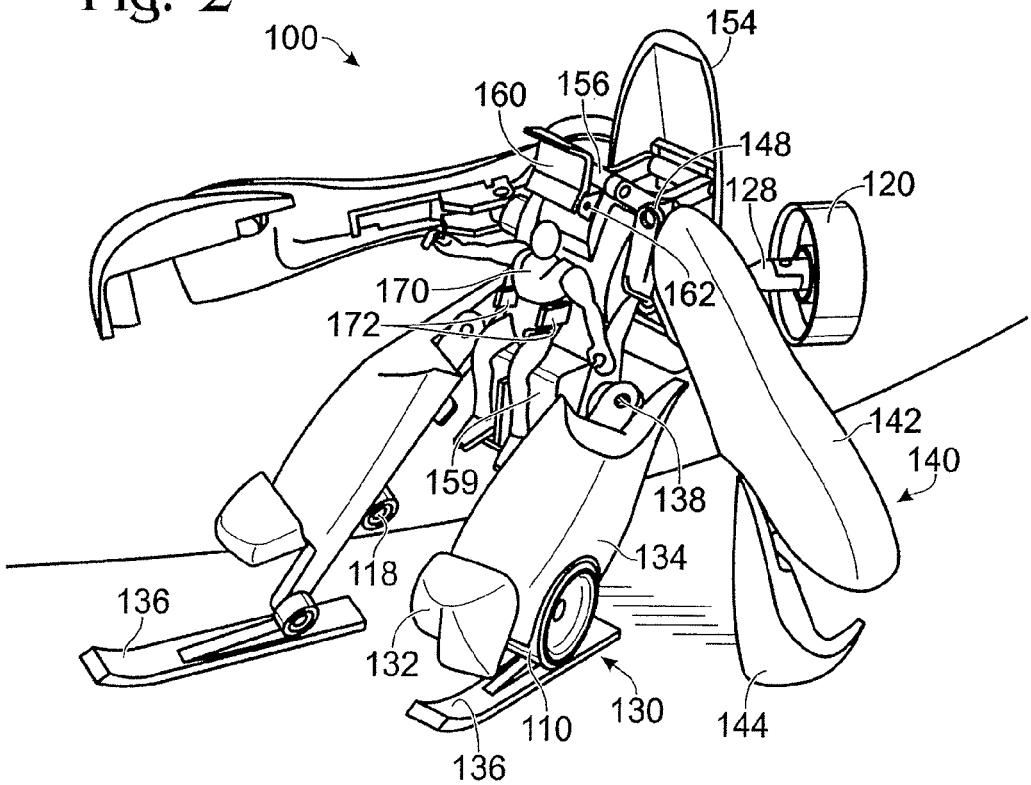

An example reconfigurable toy 100 is shown in a vehicle mode (FIG. 1) and in a power-suit mode simulating a skiing activity (FIG. 2). The frame of toy 100 may be transformed between the two modes. As will be described in more detail below, toy 100 can be reversibly reconfigured between the configurations of FIGS. 1 and 2 by manipulation of various components.

In the example embodiment shown in FIG. 1, toy 100 in a vehicle mode simulates a car that has two front wheels 110 (only one of which is visible) and two rear wheels 120 (only one of which is partially visible). While various types of wheels may be used, wheel 110 can have a colored outer portion 112, a colored inner portion 114, and/or a colored center (or axle) portion 116, about which the wheel rotates. In some embodiments, the outer portion 112 may comprise a translucent material, such as purple colored translucent plastic. Further, inner portion 114 may comprise a transparent material, silver opaque coloring, or combinations thereof. Finally, center portion 116 may comprise an opaque red coloring. Thus, in one example, the look of wheel 110 can simulate a high speed of rotation. Wheel 120 can be identical to wheel 110 in terms of coloring and construction, or can include some variations. For example, in some embodiments, inner portion 124 may comprise a clear translucent (or transparent) material and outer portions 122 may comprise a purple translucent material. Similarly, colored center portion 126 (not shown) may be of similar color or contain some variation from portion 116. Of course, nearly infinite variations in wheel component color, transparency, size, and shape are possible, and the above described wheel is a non-limiting example.

Continuing with FIG. 1, toy 100 is shown with two front quarter panel 130 and with two rear quarter panels 140 (only one of which is visible in FIG. 1). As described below, these quarter panels may be reconfigured to simulate legs and arms in the power-suit mode. Front left quarter panel 130 is shown having a front portion 132 and a main portion 134. Further, rear left quarter panel 140 is shown having a main portion 142 and a rear portion 144. A center portion 150 is also shown in FIG. 1, having a front body 152 and a canopy 154. The body 152 is a central member in this example. However, body may refer to various members of toy 100, such as a central body member, internal members, external members, or others.

As described in more detail below, canopy 154 may open allowing an action figure (not shown) to be placed into and out of a cockpit (not shown). In some embodiments, canopy 154 may include plastic that is opaque, clear, translucent, or combinations thereof. In one example, at least a portion of canopy 154 comprises translucent materials that are colored similarly to outer portions 112 and 122 of the wheels. In some embodiments, center portion 150 may include an actuator or a trigger 160 that is configured to be actuated, for example, by a user, an item ejected by an associated toy, or a collision with a foreign object, among various other causes of activation. The trigger 160, when actuated, allows various portions of the toy to uncouple from each other, thus simulating a disassembly, collision, and the like. Note that the trigger 160 may be a lever type trigger as shown herein. In some embodiments, the trigger may be a depressible button, an electronic position detector, a motion sensor, or other device.

As described above, toy 100 may be reconfigured between a vehicle mode and a power-suit mode to simulate a sports activity. Therefore, it is possible for the user to enjoy not only a vehicle play mode, but also a play mode with a power-suit and/or sports activity by reconfiguring toy 100. Hence, a single reconfigurable toy can provide at least two modes of play totally different from each other, but each interactive with a common action figure and each allowing the action figure to simulate racing and/or other competitive activity.

Referring now to FIG. 2, toy 100 is shown in a power-suit mode simulating a skiing activity with action figure 170 wearing the power-suit, and with the limbs of the action figure positioned in similar poses as the power-suit. FIG. 2 shows action figure 170 coupled to cockpit 159 via clip 172. In this example, clip 172 is shown coupled to a waist area of action figure 170, however various other methods of coupling could be used, if desired. For example, the wrists and/or ankles of the action figure may be coupled to cockpit 159 among other portions. In some embodiments, the action figure may coupled to the power-suit such that a right arm of the action figure couples to a right arm of the power-suit, and/or a right leg of the action figure couples to the right leg of the power-suit and so on. Thus, the appendages of the action figure may be coupled to the appendages of the power-suit enabling a direct relationship between the body and/or limb position of the power-suit and the action figure.

In the example power-suit configuration shown in FIG. 2, the two front wheels 110 form knees and the two rear wheels 120 simulate afterburners or thrusters. In one example, the wheels are coupled to the toy via a joint. Example wheel joints that may be used in toy 100 are discussed in more detail below with reference to FIG. 4, however other joints may also be used. Continuing with FIG. 2, toy 100 is shown with the two front quarter panels 130 reconfigured into legs and skis. Specifically, the front portion 132 is rotated relative to the main portion 134 to simulate a knee cap, and skis 136 are shown coupled at joint 118. Further, the legs are coupled to cockpit 159 of the center portion 150 via a hip joint assembly 138. Leg joints, including joint 118 and hip joint assembly 138, are discussed in more detail below with reference to FIGS. 7 and 8. FIG. 2 also shows the two rear quarter panels 140 reconfigured as arms with hands and/or ski poles. Specifically, the main portion 142 simulates an arm, and rear portion 144 is rotated relative to main portion 142 to simulate hands and/or ski poles. Further, rear quarter panel 140 are coupled to cockpit 159 of center portion 150 via a shoulder joint assembly 148, an example of which is discussed in more detail below with regard to FIG. 10. In some embodiments, the skis and/or ski poles can be accessories that may be uncoupled from the toy.

As shown in FIG. 2, the wearable power-suit mode of toy 100 simulates four appendages of the action figure wearing the suit. Therefore, the arms and legs of the power-suit may be adjusted and/or reconfigured to be substantially adjacent to or proximate to the arms and legs of action figure 170 wearing the suit. In this way, the wearable suit may act as an extension of the action figure's frame. Specifically, for example, the right arm of the action figure may be substantially proximate to the right arm of the power-suit, the left arm of the action figure may be substantially proximate the left arm of the power-suit, the right leg of the action figure may be substantially proximate the right leg of the power-suit, and the left leg of the action figure may be substantially proximate the left leg of the power-suit, thereby simulating an outfit that is worn by the action figure. In some examples, the power-suit may include a hat, helmet and/or other feature that simulate the action figure's head, thus further simulating a wearable suit. In the example of FIG. 2, the action figure wearing the power-suit may engage in a simulated competitive or extreme sport activity, such as skiing.

Continuing with FIG. 2, center portion 150 is shown in an open configuration, where canopy 154 is rotated about joint assembly 156 to reveal the action figure 170, as will be described in more detail below with reference to FIG. 9. Thus, various portions of toy 100 can be reconfigured in both the vehicle mode and the power-suit mode to further improve play fun. As described herein, toy 100 can hold action figure 170 in both the vehicle mode and power-suit mode. While not shown in this Figure, front body 152 may be rotated about joint 158 to the rear of the power-suit, as described in more detail below. Coupled to the center portion is an actuator configured as a trigger 160 that rotates about joint 162. As described herein, this trigger, when actuated, causes the toy 100 to disassemble or separate into various pieces.

Figure 3:
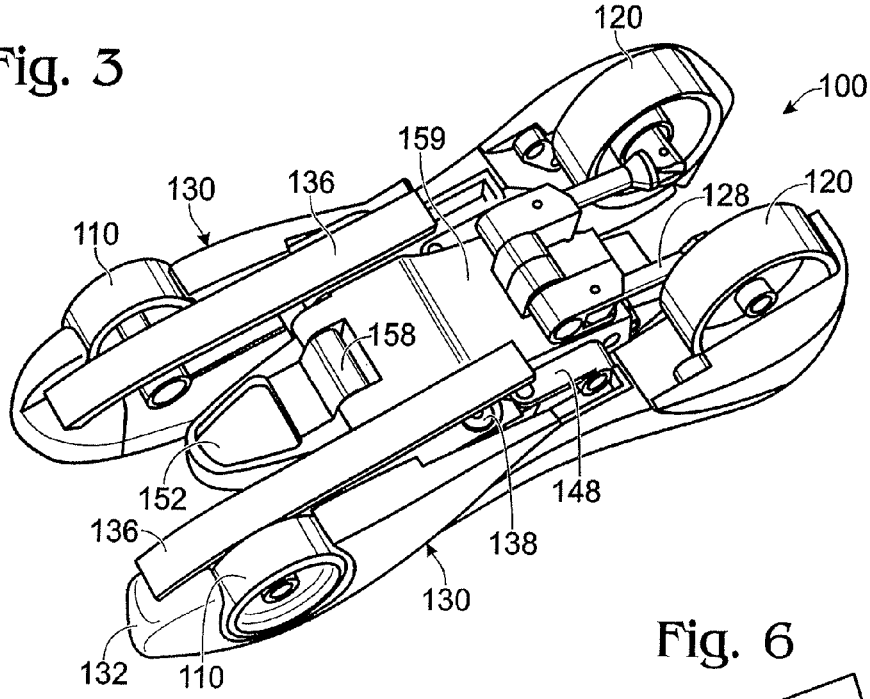

FIG. 3 shows a bottom view of toy 100 in a vehicle mode. FIG. 3 further shows how various components used in the power-suit mode are reconfigured to become the vehicle components, or are hidden from view. Specifically, FIG. 3 shows how skis 136 can fold into a recess in the front quarter panel interior wheel 110. Further, FIG. 3 shows joint assembly 128 coupling the rear wheel 120 to center portion 150, as well as joint assembly 156 coupling the front body 152 to cockpit 159. Further, shoulder joint assembly 148 and hip joint assembly 138 are partially visible in the folded position.

Figure 6:
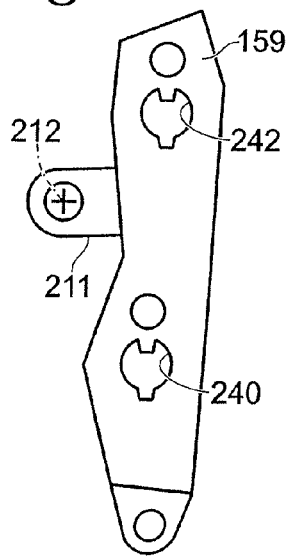
Figure 4:
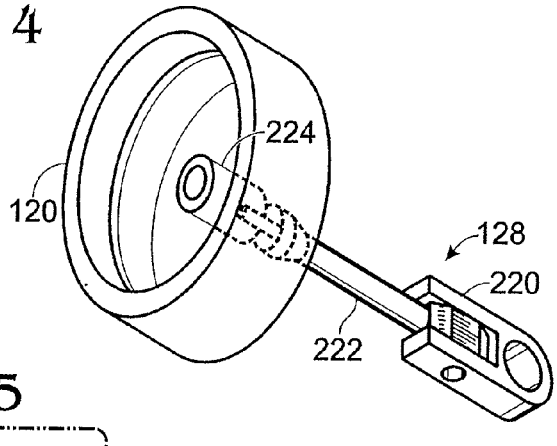
Figure 5:
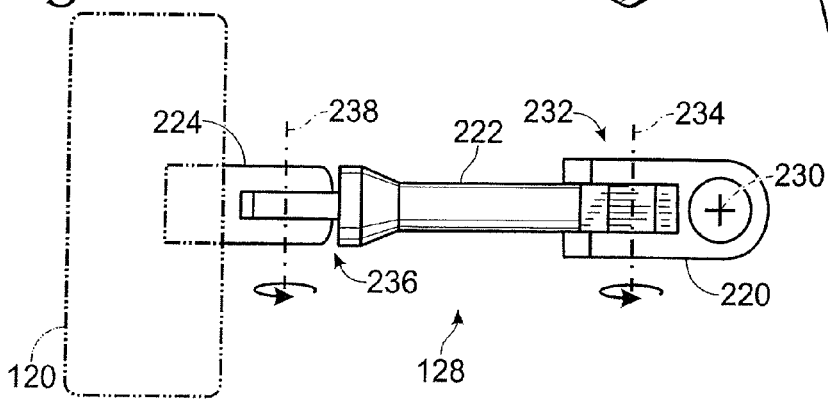

FIGS. 4-6 show a joint assembly 128. Joint assembly 128 includes first, second, and third extension portions 220, 222, and 224, and joints 230, 232, and 236, which collectively form a combined three degree-of-freedom joint. Joint 230 allows rotation about an axis extending through hole 212 through portion 211 of cockpit 159. A second joint 232 allows rotation via a yoke about axis 234. A third rotation joint 236 allows rotation via a yoke about axis 238. FIG. 6 shows a side view of a portion of cockpit 159 with the front and rear quarter panel portions removed, thus exposing releasable interfaces 240 and 242 for respectively receiving end portions of the front and rear quarter panel portions. Further, FIG. 6 shows portion 211 and hole 212 for receiving joint assembly 128.

Figure 7:
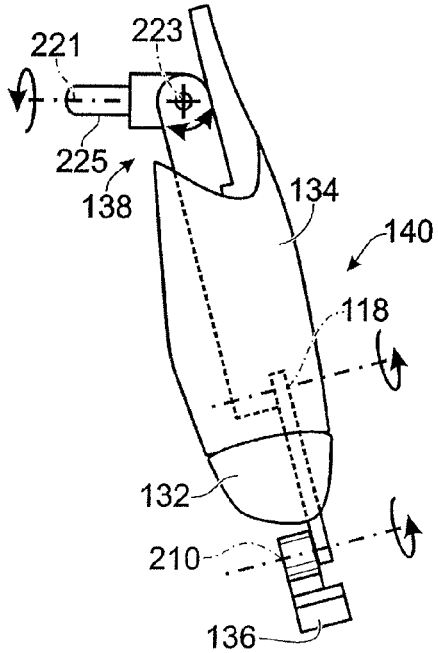
Figure 8:
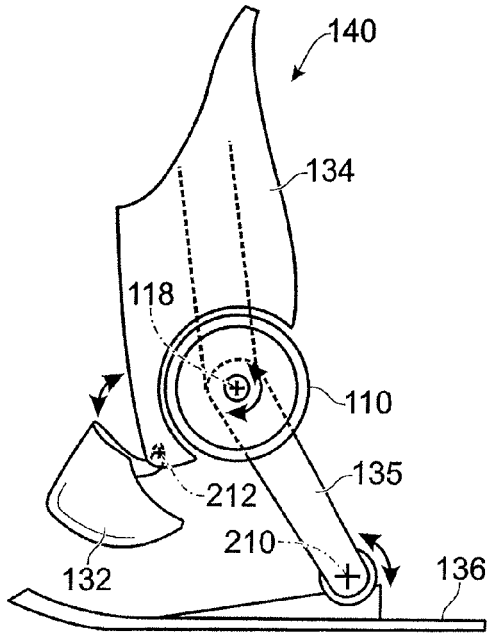

Referring now to FIGS. 7-8, FIG. 7 shows a front view of the left leg of toy 100, and FIG. 8 shows a side view of the left leg of toy 100. As will be describe below, the end of hip joint assembly 138 couples to releasable interface 240 in cockpit 159. Hip joint assembly 138 is shown as a two degree-of-freedom joint that rotates about axis 221 and joint 223. Further, end portion 225 of hip joint assembly 138 is configured to be releasably coupled to interface 240 (FIG. 6) so that upon activation of trigger 160, end portion 225 is released, or becomes separated, from cockpit 159. Further, the coupling between end portion 225 and cockpit 159 enables rotation about axis 221 to simulate a hip joint. Front portion 132 is shown coupled to main portion 134 by joint 212. Also, rotation about joint 223 is shown in FIG. 7, thus enabling additional positioning of the leg to simulate leg action. Additional details of an example releasable and rotatable coupling between end portion 225 and cockpit 159 is described in more detail below with reference to FIG. 15.

Continuing with FIGS. 7-8, two additional single degree-of-freedom joints 118 and 210 are shown for simulating a knee joint and an ankle joint, respectively. As shown, joint 118 couples wheel 110, main portion 134, and lower leg portion 135 together. Joint 210 is shown coupling lower leg portion 135 to ski 136.

FIG. 8 shows joint 118 sharing a common axis of rotation with front wheel 1110. Further, FIG. 8 shows each of joints 250, 254, 258, and 262, as well as the axis of rotation of each joint (270, 272, 274, and 264, respectively). Further, the end portion 280 of joint 250 is configured to be releasably coupled to cockpit 159 at releasable interface 242 so that upon activation of trigger 160, end portion 280 is released, disconnected, decoupled, or separated, from cockpit 159, depending on the type of mechanism employed. Further, the coupling between end portion 280 and cockpit 159 enables rotation about joint 250. Additional details of an example releasable and rotatable coupling between end portion 280 and cockpit 159 is described in more detail below with regard to FIG. 15.

In the example of FIG. 8, by using a common axis and/or joint for a wheel and a power-suit body joint, it may be possible to reduce manufacturing costs and/or complexity, while at the same time creating visually appealing transformable toys. Further, such a joint can also be used to enable the transformation, thereby providing further advantages.

Figure 9:
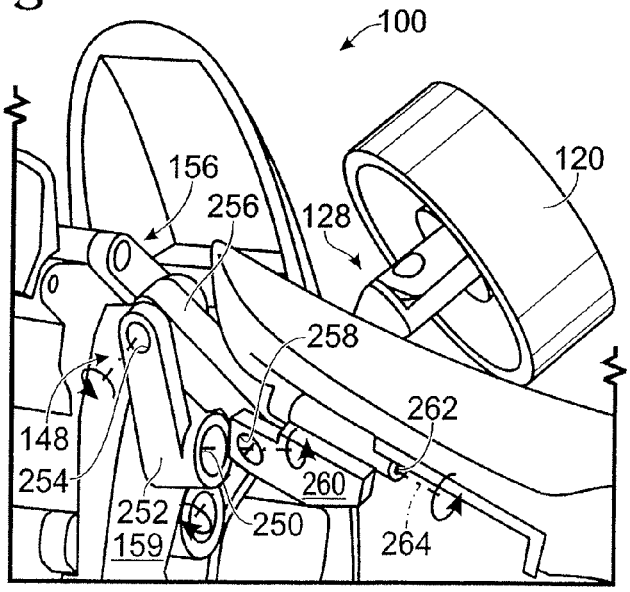
Figure 10:
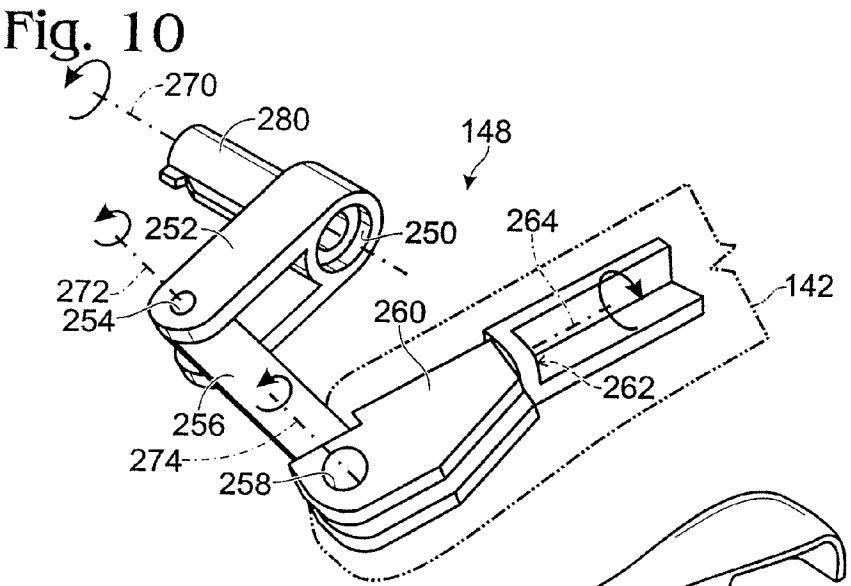
Figure 12:
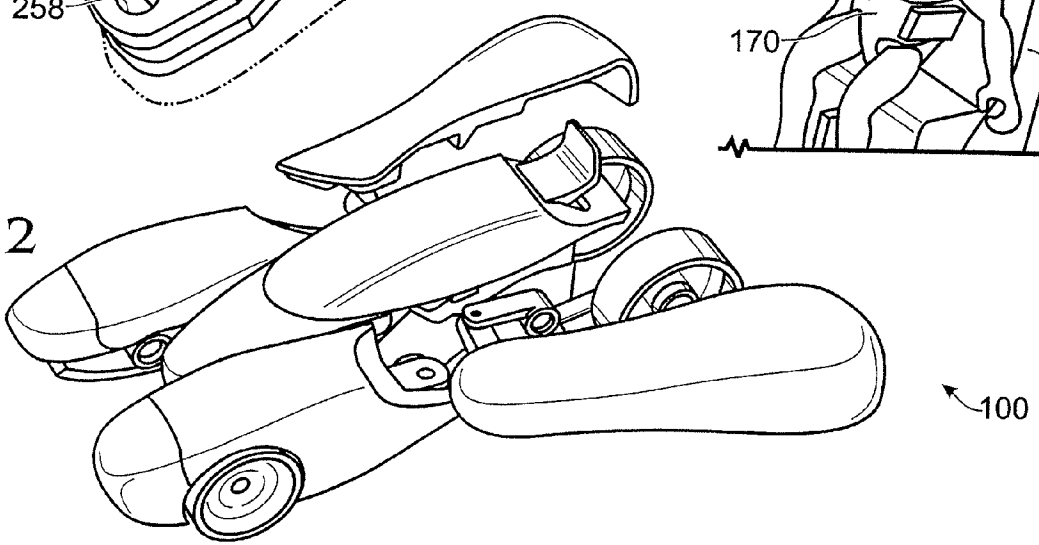
Figure 13:
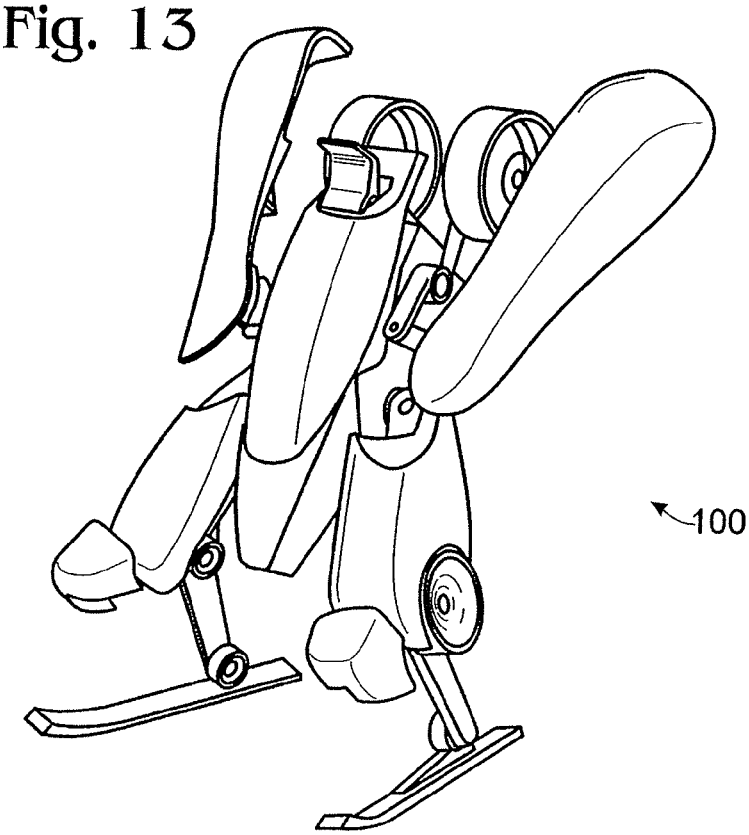
Figure 14:
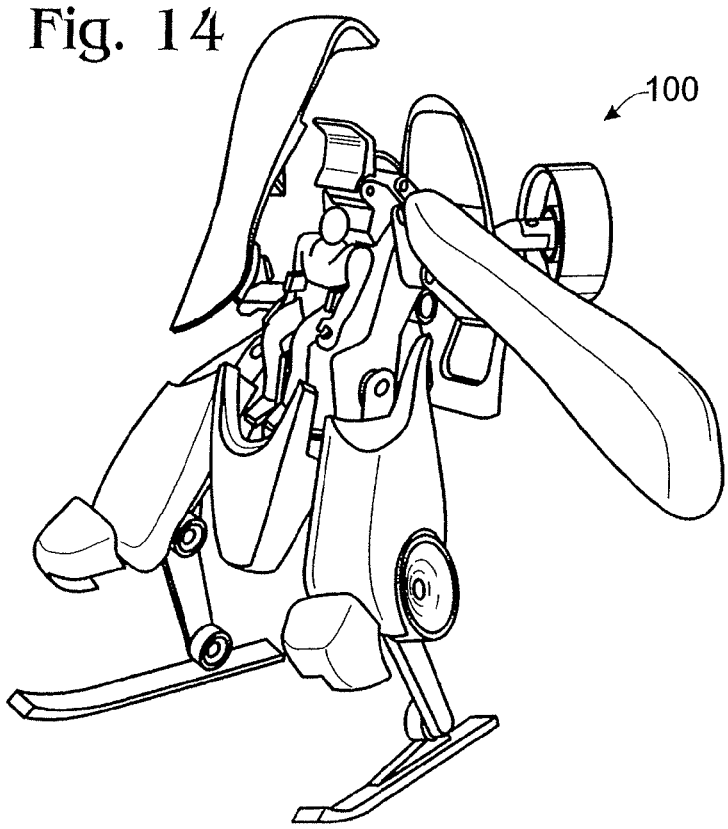

Referring now to FIGS. 9-10, FIG. 9 shows a three dimensional close up view of toy 100 in power-suit configuration illustrating the shoulder joint assembly 148. FIG. 10 shows an example shoulder joint assembly 148 containing four arm portions illustrating a four degree-of-freedom joint. Specifically, FIG. 9 shows various portions of toy 100, including shoulder joint assembly 148, a rear wheel 120 in afterburner configuration coupled to cockpit 159 via joint assembly 128, canopy 154 in an opened position coupled to cockpit 159 via joint assembly 156. Shoulder joint assembly 148 includes rotatable and releasably coupled joint 250, first arm extension member 252, rotatable joint 254, second arm extension member 256, rotatable joint 258, third extension member 260, joint 262 rotating about axis 264, and main portion 142. In this way, the arm of toy 100 is able to fold into and out of the rear quarter panel, while also being able to simulate realistic arm motion to enhance the power-suit play mode. While the herein described joints can each be a single degree-of-freedom joint, multi-degree-of-freedom joints, such as ball joints, may be used, if desired. FIG. 10 shows the extension members and joints in a position after the rear quarter panel 140 (left arm) has been pulled away from the position shown in FIG. 1, but without being rotated as shown in FIG. 7.

Figure 11:
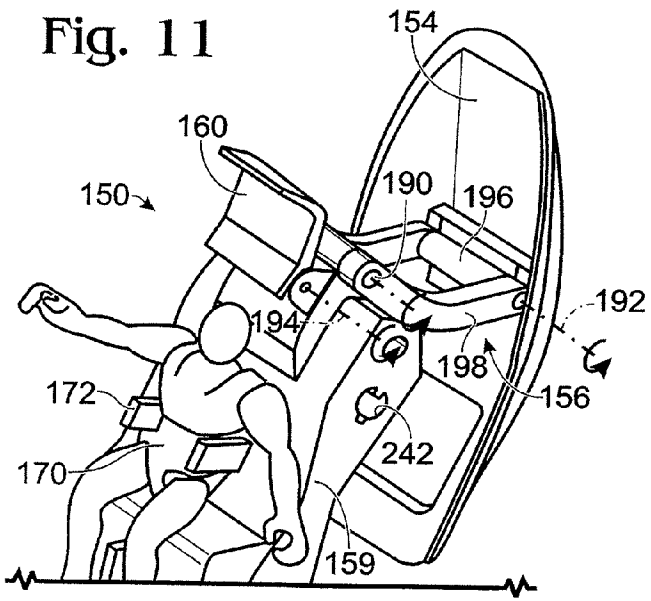

Referring now to FIG. 11, a partial view of a cockpit 159 is shown. Specifically, cockpit 159 and canopy 154 are shown coupled via joint assembly 156, which includes two degrees-of-freedom. Specifically, joint assembly 156 includes joint 190 to enable rotation of extension member 198 about axis 192 relative to cockpit 159. Joint 196 enables rotation of canopy 154 about axis 192 relative to extension member 198.

FIG. 11 also illustrates additional detail of action figure 170 coupled to cockpit 159 via clip 172.

An example process for reconfiguring toy 100 is illustrated via FIGS. 1, 12, 13, 14, and finally 2. Specifically, in moving from the positions of FIG. 1 to FIG. 12, the rear quarter panels are each moved outward from the center sections. Then, in moving from the positions of FIG. 12 to FIG. 13, the front quarter panels are rotated outward. Further, the legs and skis are extended, and front portion 132 is rotated outward. Then, in moving from the positions of FIG. 13 to FIG. 14, the rear quarter panels are rotated about the shoulder and the center cockpit section is opened. Also, rear wheels 120 may be rotated to simulate afterburners. Finally, in moving from the positions of FIG. 14 to FIG. 2, the right arm of the suit is rotated outward and the rear quarter panel sections are rotated out to simulate hands. Further, front body 152 is rotated to the rear. Next, the action figure and power-suit may be repositioned so that the arms and legs are in similar positions, so as to simulate the action figure wearing the power suit, thus providing an exciting power-suit play mode. Also, the process can be reversed to enable reversible reconfiguration back to vehicle mode. It should be appreciated that the order described above is not required, and various alternative orders may be used, if desired. Furthermore, in some embodiments, different joints can be used.

Figure 15:
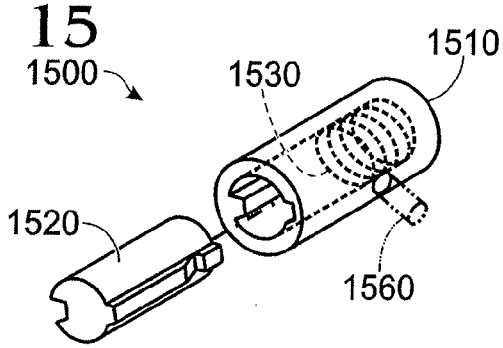

FIG. 15 shows an example of a releasable joint 1500, which may be used to release various portions of the toy so that disassembly, separation, or decoupling occurs upon activation of a trigger. In some embodiments, as described above with reference to FIG. 6, releasable joint 1500 may be located within an opening in the side of cockpit 159, thus creating releasable interfaces 240 and 242. For example, as described above with reference to FIG. 6, interfaces 240 and 242 can each contain a releasable joint 1500. Continuing with FIG. 15, releasable joint 1500 is shown including a receiving sleeve 1510 for releasably receiving an end portion 1520. End portion 1520 may be permitted to rotate within receiving sleeve, but can be selectively prevented from translating outward due to a key, such as portion 1560. Upon activation of a trigger mechanism, such as trigger 160, end portion 1520 may be released from receiving sleeve 1510 by portion 1560, or a suitable release mechanism. Further, a spring 1530 located within receiving sleeve 1510 may assist in ejecting end portion 1520 from receiving sleeve 1510. In this manner, disassembly or decoupling may occur for any portion of the toy utilizing a trigger-joint configuration.

An end portion similar to end portion 1520 may be used for any portion of the toy where disassembly may occur. For example, end portion 1520 may be used as end portion 225 to couple the leg of toy 100 to cockpit 159. Upon activation of trigger 160, end portion 225 is released from the receiving sleeve, thus releasing the leg of toy 100 from cockpit 159. In another example, end portion 1520 may be used as end portion 280, which may be released from cockpit 159 upon activation of trigger 160, thus releasing an arm of toy 100 from cockpit 159. Further, end portion 1520 may be used in several of the alternative transformation vehicles described herein. Note, however, that alternative releasable joints or couplings may be used in place of the releasable joint 1500. For example, an alternative joint mechanism may be used to couple a limb to a cockpit or center section that enables decoupling upon activation of an actuator such as a trigger.

Figure 16:
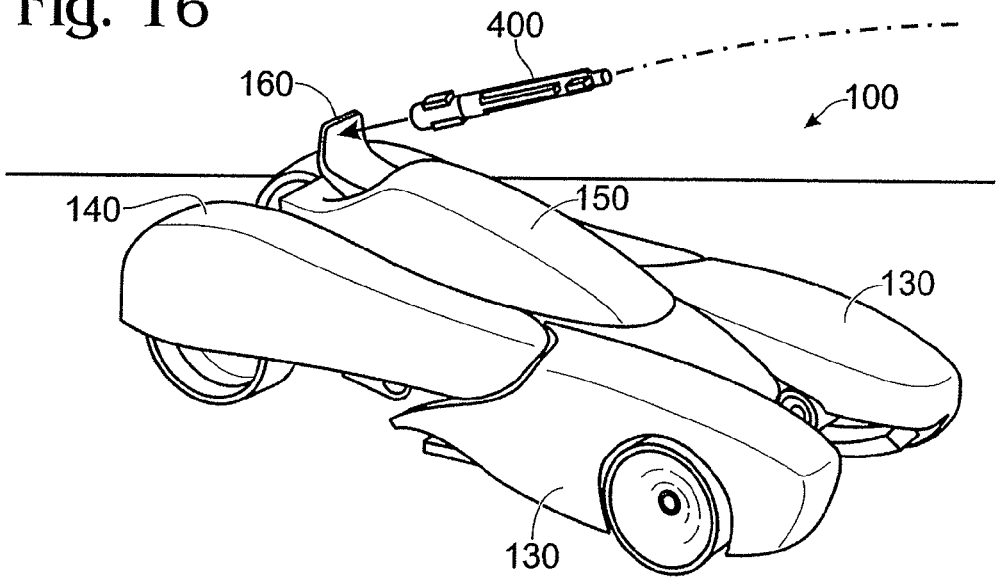
Figure 17:
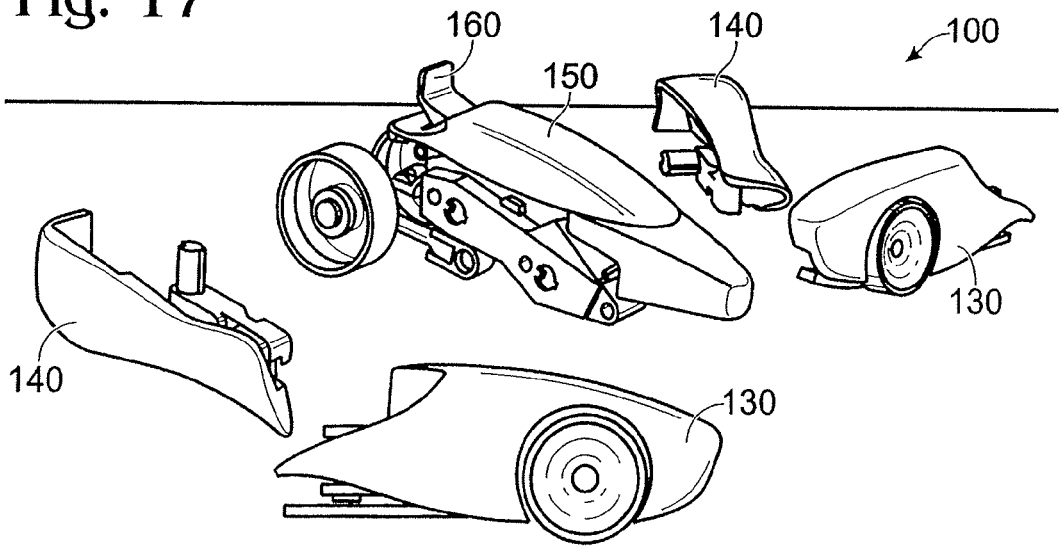
Figure 18:
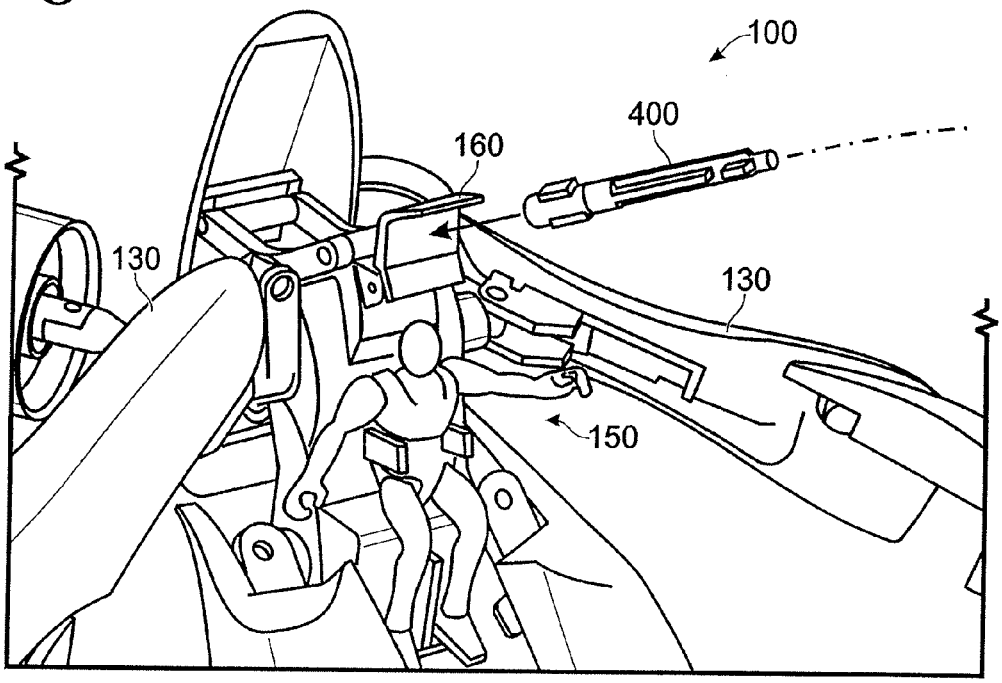
Figure 19:
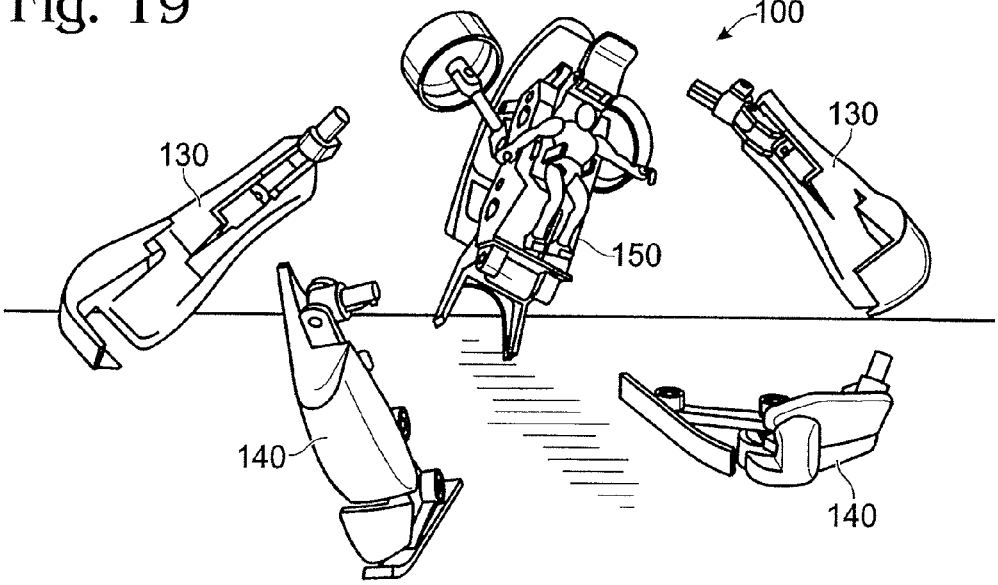

FIGS. 16-19 show the disassembly of toy 100 when trigger 160 is actuated. As described above, activation of trigger 160 may cause disassembly or decoupling of toy 100 in both vehicle and power-suit configurations. Specifically, FIGS. 16-17 show disassembly when the toy is configured as a vehicle, while FIGS. 18-19 show disassembly when the toy is configured as a power-suit. FIG. 16 shows toy 100 configured as a vehicle with front quarter panels 130 and rear quarter panels 140 releasably coupled to center section 150 and item 400 traveling toward the trigger 160. Item 400 may be various types of items, such as, for example, an ejected item from another toy, or a user actuating the trigger manually, among others. As described above, activation of trigger 160 can cause release or separation of the releasably coupled front quarter panels 130 and rear quarter panels 140 as shown in FIG. 17. Likewise, FIG. 18 shows toy 100 reversibly configured as a power-suit, with item 400 approaching trigger 160. FIG. 19 shows toy 100 after activation of the trigger by the item, with each of the arms and legs released from cockpit 159 of center section 150.

While in this example, all releasably coupled portions are released by activation of a single trigger from a single center section in both transformation modes, various other embodiments may be used. For example, multiple trigger points may be provided such that activation of each trigger can release a different portion. Alternatively, a single trigger may have multiple activation levels, with different levels of activation releasing different, or greater numbers of pieces. Further still, while in this example trigger 160 rotates relative to cockpit 159, other types of triggers may be used, such as push buttons, or others. In the example where the trigger (or triggers) is (are) located in a center section to which other pieces are releasably coupled, it is possible to not only simulate collisions and battle play, but the releasable coupling can also function as a joint thereby facilitating transformation and/or reconfiguration of the toy between more than one play mode.

Reassembly of the various disassembled portions may be achieved by recoupling each of uncoupled portions. For example, disassembled toy 100 shown in FIG. 19, which utilizes a coupling shown in FIG. 15, may be reassembled by reinserting end portion 280 of the rear quarter panel 140 (arm) into releasable interface 242 of cockpit 159. In some embodiments, as an end portion is reinserted into receiving sleeve 1510, portion 1560 may be configured to constrain the end portion until a future activation of the trigger mechanism.

In some embodiments, reassembly of the disassembled portions may be facilitated by color coding, number coding, and/or symbolic coding of the various portions. For example, in some embodiments, the uncoupled portion may include a visible symbol and/or colored portion corresponding to a visible symbol and/or colored portion on an interface located on the center cockpit portion. Thus, the uncoupled portion may be properly reunited with the center cockpit portion. Further, in some embodiments, each removable portion may have a uniquely shaped interface so that the toy can be reassembled in a specific configuration. For example, an end portion on each uncoupled portion may correspond to a specific opening. In another example, assembly instruction may be provided in the toy packaging or on the surface of the toy.

In some embodiments, toy 100 may be configured to receive one or more interchangeable accessories, a further discussion of which is presented below with reference to FIGS. 75-85.

Figure 20:
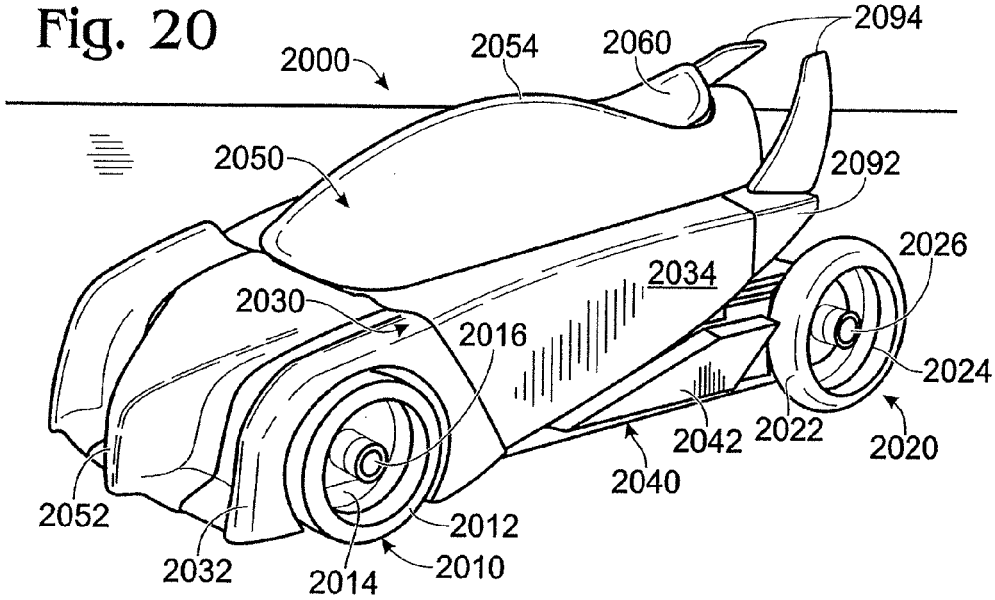
FIGS. 20-36 show a second example toy, which is transformable between a vehicle and a power-suit simulating a surfing activity.
Figure 21:
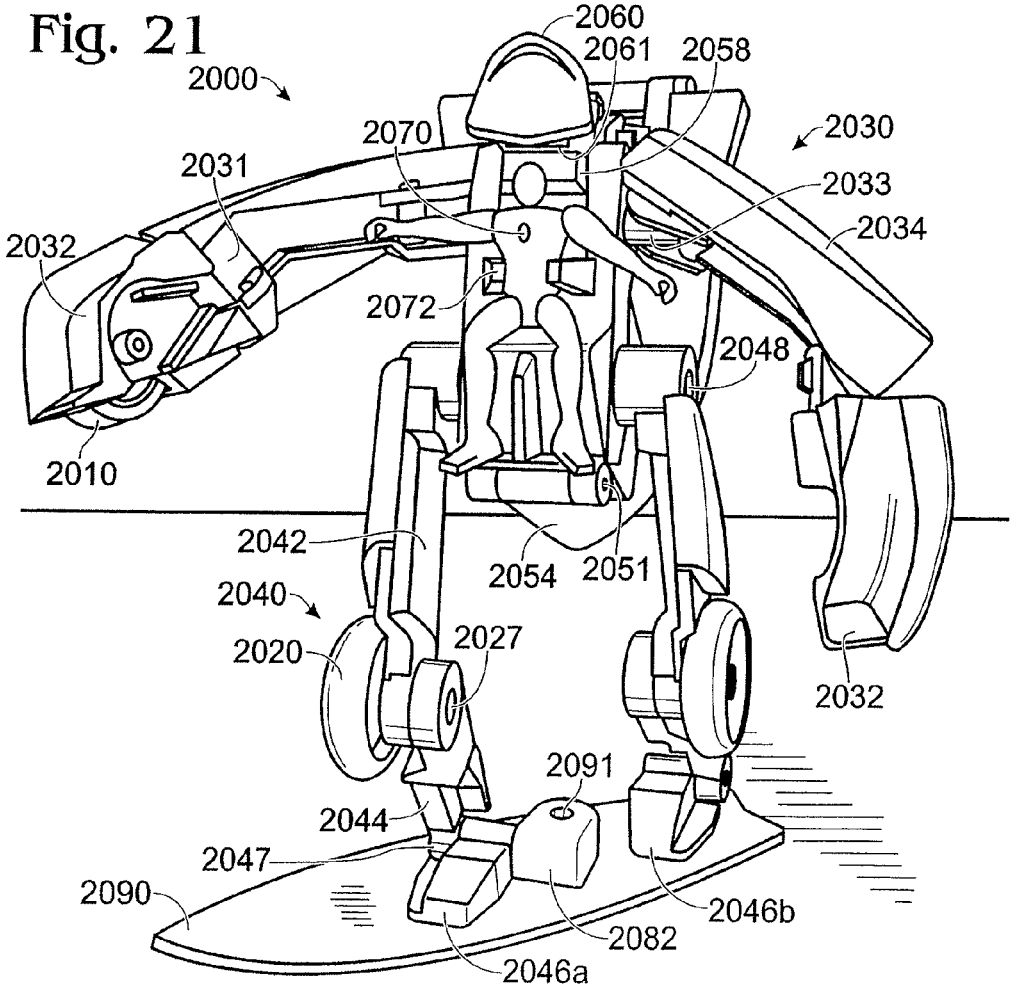
Figure 22:
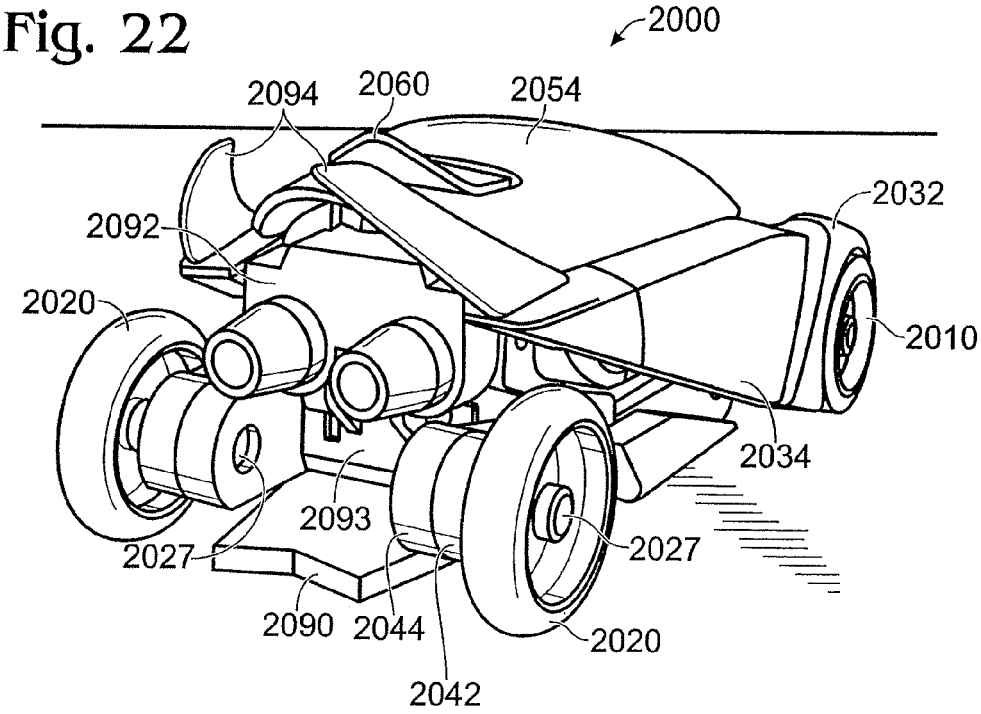
Figure 23:
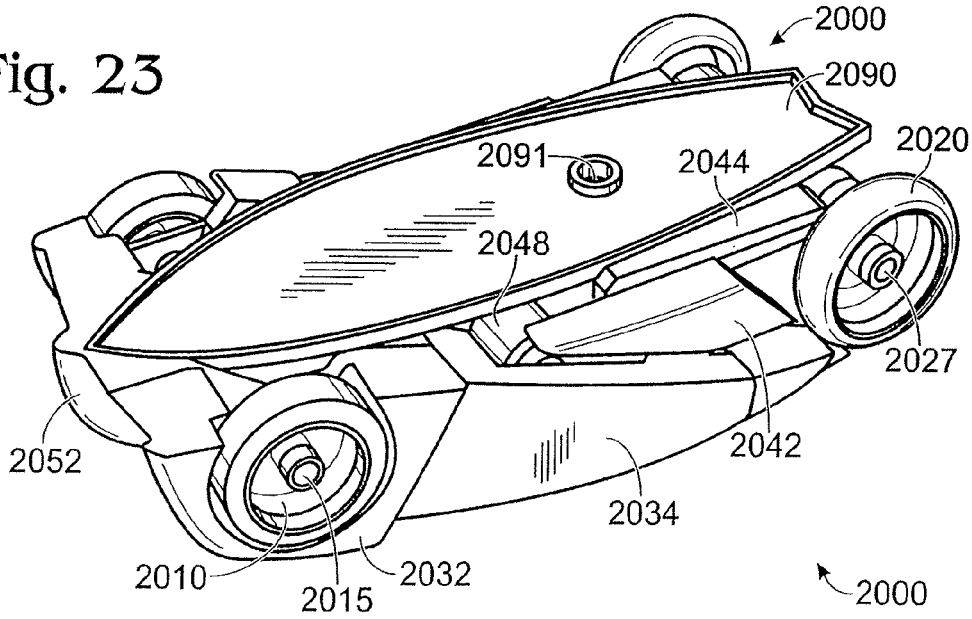

Referring now to FIGS. 20-36, an example vehicle that is reversibly reconfigurable to a power-suit configuration simulating a surfing activity is described. FIGS. 20, 22, and 23 show an example reconfigurable toy product 2000 in a vehicle configuration and FIG. 21 shows toy 2000 in a power-suit configuration. As will be described in more detail below, toy 2000 can be reversibly reconfigured between the configurations of FIGS. 20 and 21 by manipulation of various components.

In this example embodiment, toy 2000 in vehicle mode simulates a car that has two front wheels 2010 (only one of which is visible) and two rear wheels 2020 (only one of which is visible). Wheel 2010 is shown having an outer portion 2012, inner portion 2014, and center (or axle) portion 2016. Wheel 2020 is also shown having an outer portion 2022, inner portion 2024, and a center (or axle) portion 2026. Wheel 2020 can be identical to wheel 2010 in terms of coloring and construction, or can include some variations. Further, while various types of wheels may be used, the wheels of toy 2000 can be identical to the wheels of toy 100 in terms of coloring and construction, or can include some variations.

Continuing with FIG. 20, toy 2000 is shown with two front quarter panels 2030 and with two rear quarter panels 2040 (only one of which is visible in FIG. 20). As described below, these quarter panels may be reconfigured to simulate arms and legs in the power-suit configuration. Front quarter panel 2030 has a front section 2032 and main section 2034, which may be respectively reconfigured into a lower arm and an upper arm section in the power-suit configuration. Further, rear quarter panel 2040 has an outer section 2042, which can be reconfigured to serve as an upper leg in the power-suit configuration. Toy 2000 is further shown, having a front body section 2052 and a canopy 2054. As described in more detail below, canopy 2054 has an opening door that allows an action figure (not shown) to be placed into and out of a cockpit (not shown). Canopy 2054 may include plastic that is opaque, clear, translucent, or combinations thereof. In some embodiments, at least a portion of the canopy may include translucent materials that are colored similarly to portions 2012 and 2022 of the wheels. Further, fins 2094 are shown coupled to rear afterburner section 2092 (partially visible). These fins may also comprise a material that is opaque, clear, translucent or combinations thereof. In some embodiments, the fins may include translucent materials that are colored similarly to sections 2012 and 2022 of the wheels. The center section of toy 2000 is further shown having a trigger or actuator 2060. The trigger, when actuated, allows section and/or sections of the toy to uncouple from each other, thus simulating disassembly, collision, and the like.

As described above, toy 2000 may be reconfigured from a vehicle into a power-suit configuration to simulate a sports activity such as surfing. Therefore, it is possible to enjoy not only vehicle play mode, but also a play mode with the power-suit and sports activity by reconfiguring the toy; hence, a single reconfigurable toy assembly provides at least two modes of play totally different from each other but each interactive with an action figure and each allowing the action figure to simulate racing or other competitive activity. While a surfing activity is discussed herein, toy 2000 could simulate other boarding activities such as snowboarding or skateboarding. Furthermore, a set of related reconfigurable toys further improves play fun. Collision features may also allow another mode of play, and further can allow such improved play in both vehicle and power-suit configurations.

Referring now to FIG. 21, toy 2000 is shown in a power-suit configuration simulating a surfing activity. Action FIG. 2070 is shown wearing the power-suit, wherein the action figure is coupled to the cockpit 2058 via clip 2072. In this example, the clip is coupled to a waist area of action figure 2070, however various other coupling methods could be used, if desired. For example, there may be connection points at the wrists and ankles of the action figure.

In this example embodiment, toy 2000 simulates a power-suit configuration, where the two rear wheels 2020 form knees, and the two front wheels 2010 simulate hands. In one example, wheels 2020 are coupled to outer section 2042 (upper leg) and lower leg 2044 of the rear quarter panel 2040 via knee joint 2027. Wheels 2010 are shown coupled to front section 2032 of the front quarter panel 2030 via joint 2015. Continuing with FIG. 21, toy 2000 is shown with the two rear quarter panels 2040 reconfigured into legs. Specifically, lower leg 2044 is rotated relative to outer section 2042 (upper leg). While foot 2046 is shown rotated relative to lower leg 2044 via ankle joint 2047. Sport board 2090, configured in this example as a surfboard, is shown coupled to right foot **2046*a* via foot adapter 2082 (shown in more detail in FIGS. 24 and 25). Left foot 2046*b* is shown positioned on the sport board to simulate a surfing pose. In some embodiments, both the right foot and the left foot may be coupled and/or fastened to the sports board, or just the left foot may be coupled to the sports board instead of the right foot. Further, each leg is shown coupled to cockpit 2058 via a hip joint 2048. Leg joints, including knee joint 2027 and hip joints 2048, are discussed in more detail below with regards to FIGS. 24 and 25. FIG. 21 also shows the two front quarter panels 2030 reconfigured as arms. Specifically, the main section 2034 (upper arm) is shown rotated relative to cockpit 2058 via shoulder assembly 2033. Front section 2032 is shown rotated relative to main section 2034 via elbow joint 2031. Arm joints are discussed in more detail below in FIGS. 26 and 27**.

As shown in FIG. 21, various portions of toy 2000 can simulate the 4 appendages of the action figure during the power-suit configuration wherein the action figure simulates wearing the power-suit. Therefore, the arms and legs of the power-suit may be adjusted and/or reconfigured to be substantially adjacent to the arms and legs of the action figure, thus the wearable suit may act as an extension of the action figure's limbs or other parts. Specifically, for example, the right arm of the action figure may be substantially proximate to the right arm of the power-suit, the left arm of the figure proximate to the left arm of the power-suit, etc. thereby simulating an outfit that is worn by the action figure. In some examples, the power-suit configuration may contain a hat, helmet, and/or other feature that simulate the action figure's head. In this manner, the action figure wearing the power-suit configuration may simulate a competitive or extreme sport activity such as surfing, skateboarding, or snow boarding.

Further, canopy 2054 is shown rotated about joint assembly 2061 to reveal action figure 2070. As described herein, toy 2000 can hold action figure 2070 in cockpit 2058 in both the vehicle configuration and power-suit configuration. While not shown in FIG. 21, front body section 2052 may be rotated about joint 2051 toward the rear of the power-suit, as described in more detail below with reference to FIGS. 28 and 29. Also shown coupled to the center section is trigger 2060 that can rotate about joint 2061 when actuated. As described above with reference to toy 100, this trigger, when actuated, causes the toy 2000 to disassemble.

FIG. 22 shows a rear view of toy 2000 in a vehicle configuration. FIG. 22 further illustrates how the various components shown in the power-suit configuration may be adjusted to become the vehicle components and can be hidden from view. Specifically, FIG. 22 shows how sport board 2090 is partially hidden under the vehicle. FIG. 22 also shows joint knee 2027 coupling the outer section 2042 (upper leg), lower leg 2044, and rear wheel 2020. Linkage 2093 is also shown located between the sports board and the rear afterburner section.

FIG. 23 shows a bottom view of toy 2000 in a vehicle configuration, further revealing how various components of the power-suit are reconfigured to become the vehicle components, and/or are hidden from view. For example, FIG. 23 shows how sport board 2090 is recessed under the front of the vehicle by front body section 2052. Further, hip joint 2048 (partially visible) is shown coupling the outer section 2042 of the rear quarter panels to cockpit 2058. Further, joint 2091 is shown coupling sport board 2090 to foot adapter 2082.

Figure 25:
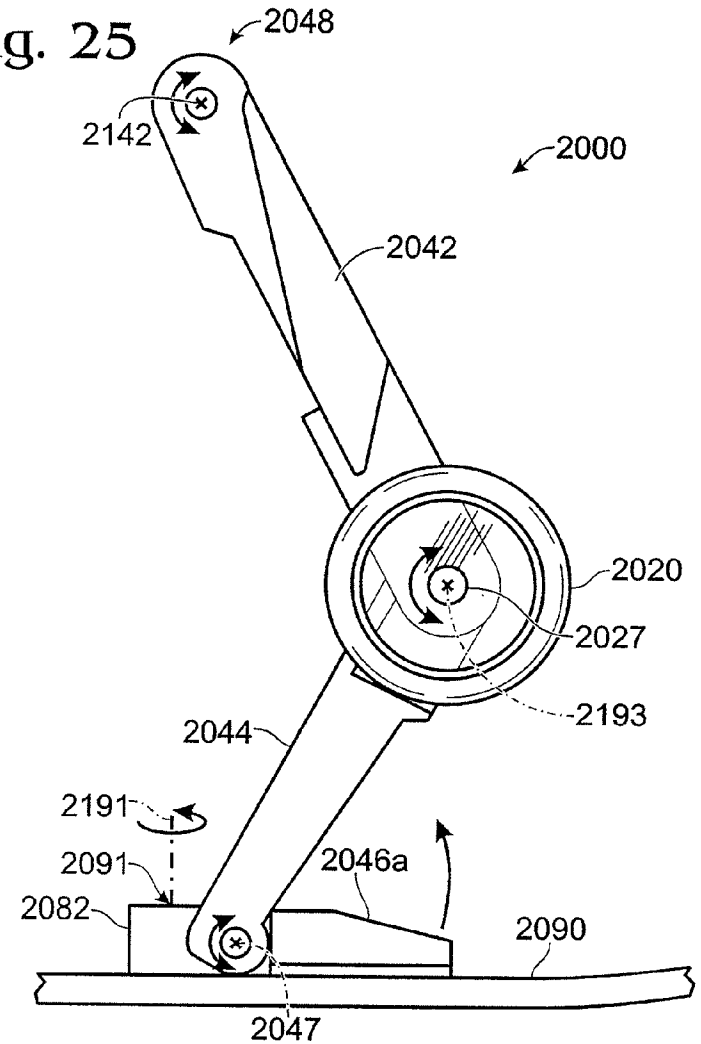
Figure 24:
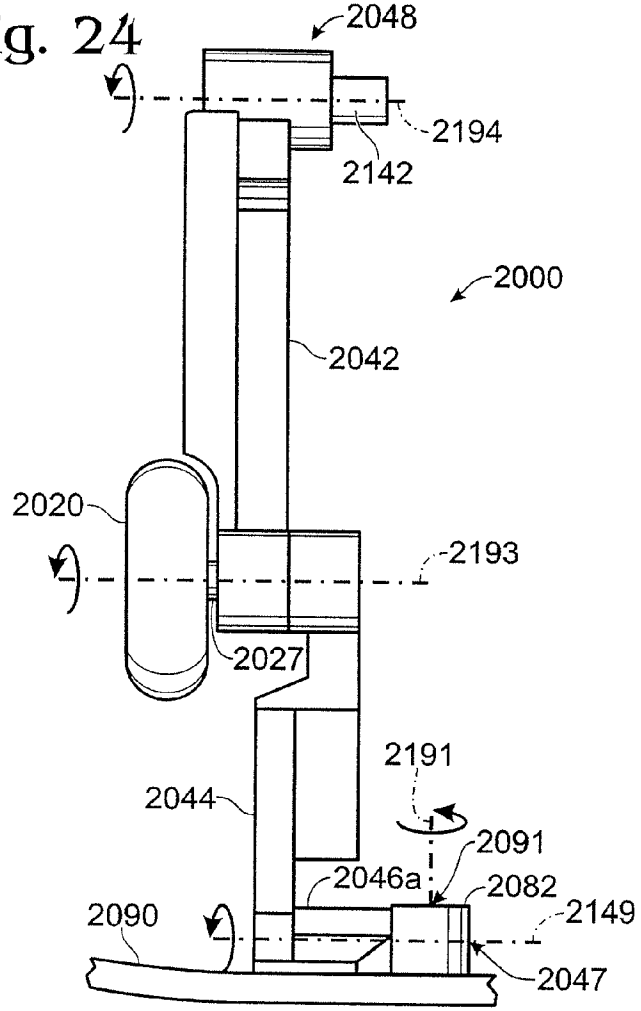

FIGS. 24 and 25 respectively show a front and side view of the right leg of toy 2000. Joint 2091, which couples sport board 2090 to foot adapter 2082 is shown as a single degree-of-freedom joint that rotates about axis 2191. Thus, in this example, joint 2091 allows the repositioning of the power-suit in relation to the surfboard to further simulate surfing action. Hip joint 2048, which couples outer section 2042 to cockpit 2058, is shown as a single degree-of-freedom joint that rotates about axis 2194. Further, hip joint 2048 includes end portion 2142 coupled to outer section 2042 (upper leg), wherein end portion is configured to be releasably coupled to cockpit 2058 via releasable interface 2144 shown in FIG. 29. Upon activation of trigger 2060 (FIGS. 21 and 22), the coupling is released and end portion 2142 is free to translate outward from cockpit 2058 as described above with reference to FIG. 15.

Continuing with FIGS. 24 and 25, ankle joint 2047, which connects foot adapter 2082 to right foot 2046*a* and lower leg 2044, is shown as a single degree-of-freedom joint enabling rotation about axis 2149. A knee joint 2027, which connects lower leg 2044 to outer section 2042 is shown as a single degree-of-freedom joint that rotates about axis 2193. In this manner, the legs of toy 2000 in power-suit configuration may be adjusted to simulate leg action.

Figure 26:
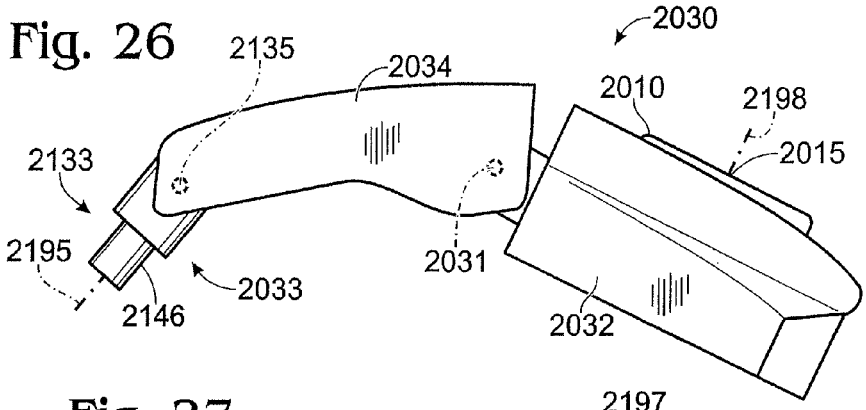
Figure 27:
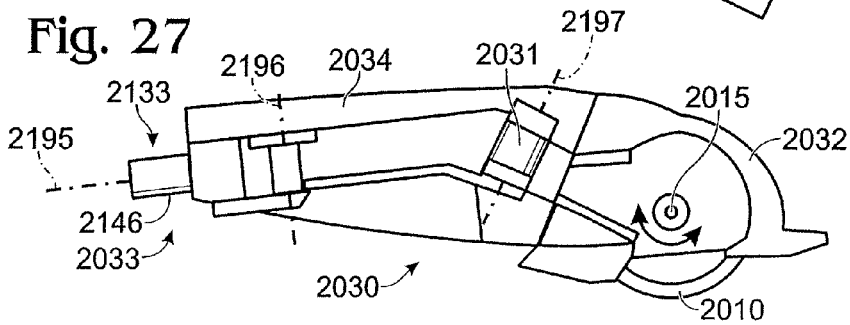

FIGS. 26 and 27 respectively show a schematic front and side view of the left arm of toy 2000. Specifically, FIG. 26 shows the components of the left arm of toy 2000 including front wheel 2010, joint 2015 coupling wheel 2010 to front section 2032, and elbow joint 2031 configured to couple main section 2034 and front section 2032, shoulder assembly 2033 coupling main section 2034 to the cockpit. Joint 2015, which couples front wheel 2010 to front section 2032, is shown as a single degree-of-freedom joint enabling rotation about axis 2198 (FIG. 26). Elbow joint 2031, which couples front section 2032 to main section 2034, is shown as a single degree-of-freedom joint enabling rotation about axis 2197. Shoulder assembly 2033, which is configured to couple main section 2034 to the cockpit is shown having two independent single degree-of-freedom joints 2133 and 2135. Joint 2133 is shown as a single degree-of-freedom joint that enables rotation about axis 2195. Further, end portion 2146 of joint 2133 is configured to be releasably coupled to cockpit 2058 via releasable interface 2140 shown in FIG. 29. Upon activation of trigger 2060, end portion 2146 is released from cockpit 2058 as described above with reference to FIG. 15. Joint 2135, which couples main section 2034 (upper arm) to releasable end portion 2146, is shown as a single degree-of-freedom joint that rotates about axis 2196. In this manner, shoulder assembly 2033 can have two degrees of freedom, while also releasing from cockpit 2058 due to activation of trigger 2060. In this way, the arm is able to fold into and out of the front quarter panel, while also being able to simulate realistic arm motion to enhance the power-suit play mode. While the above joints are each a single degree-of-freedom joint, multi-degree-of-freedom joints, such as ball joints, may be used, if desired.

Figure 28:
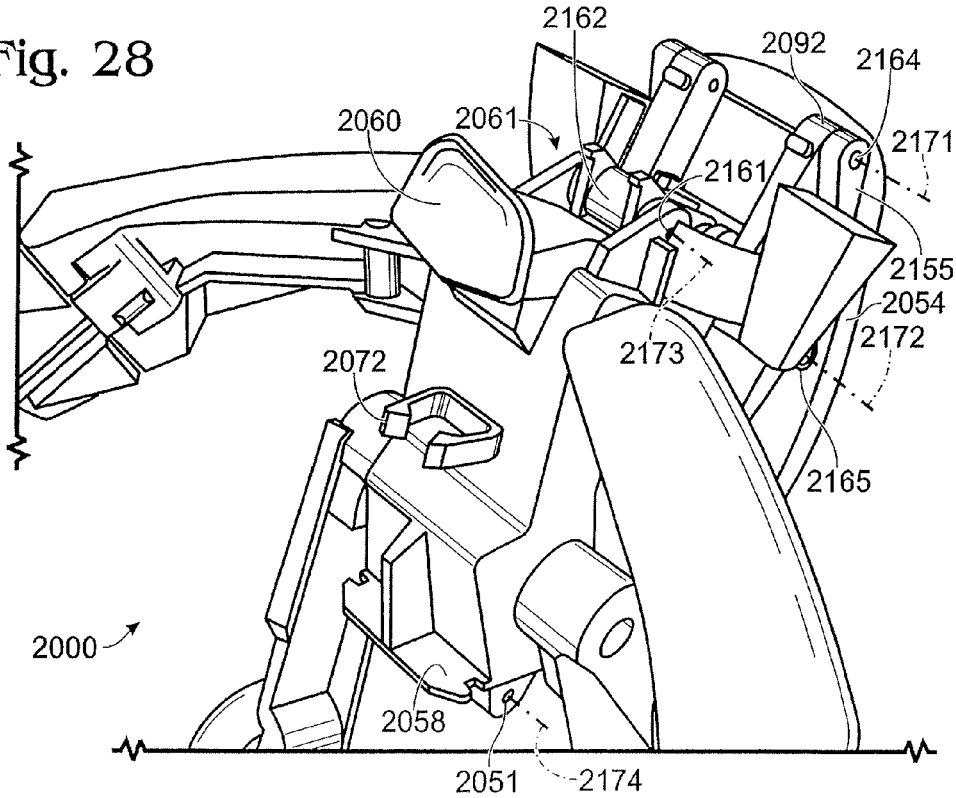
Figure 29:
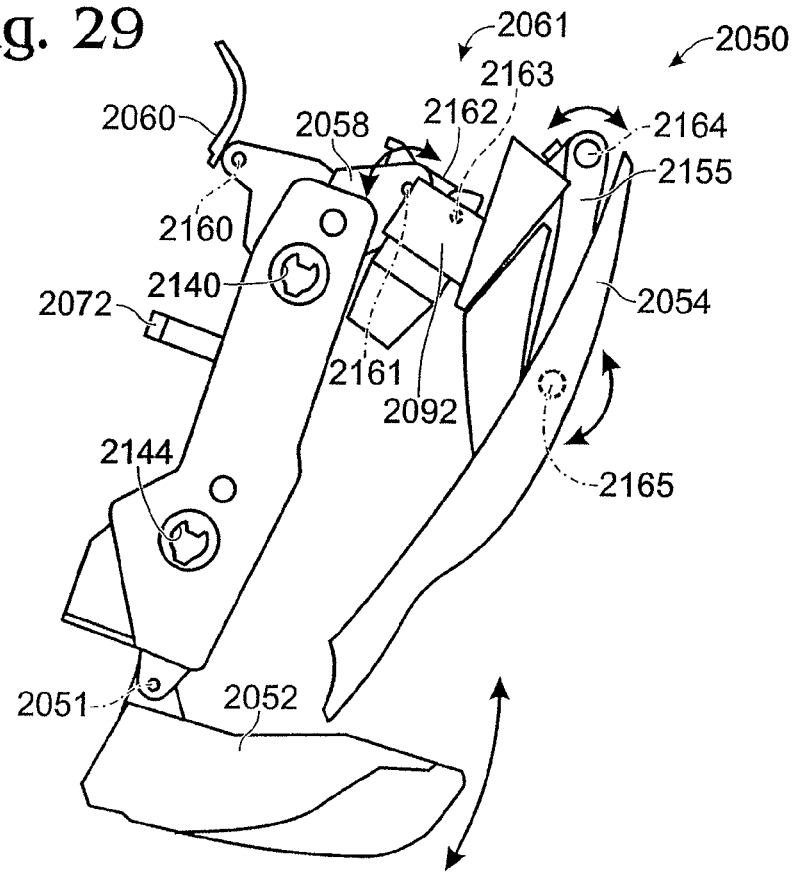
Figure 30:
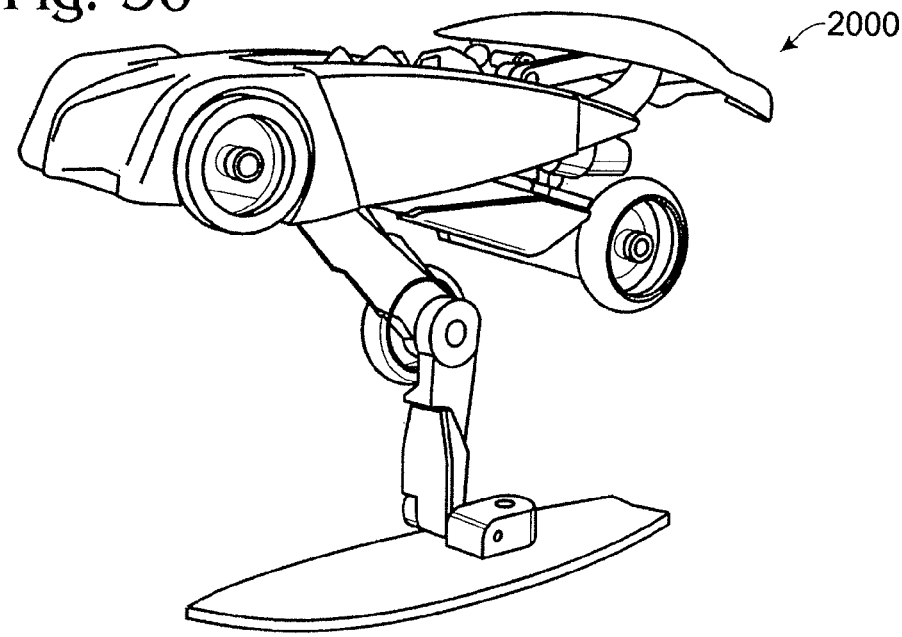
Figure 31:
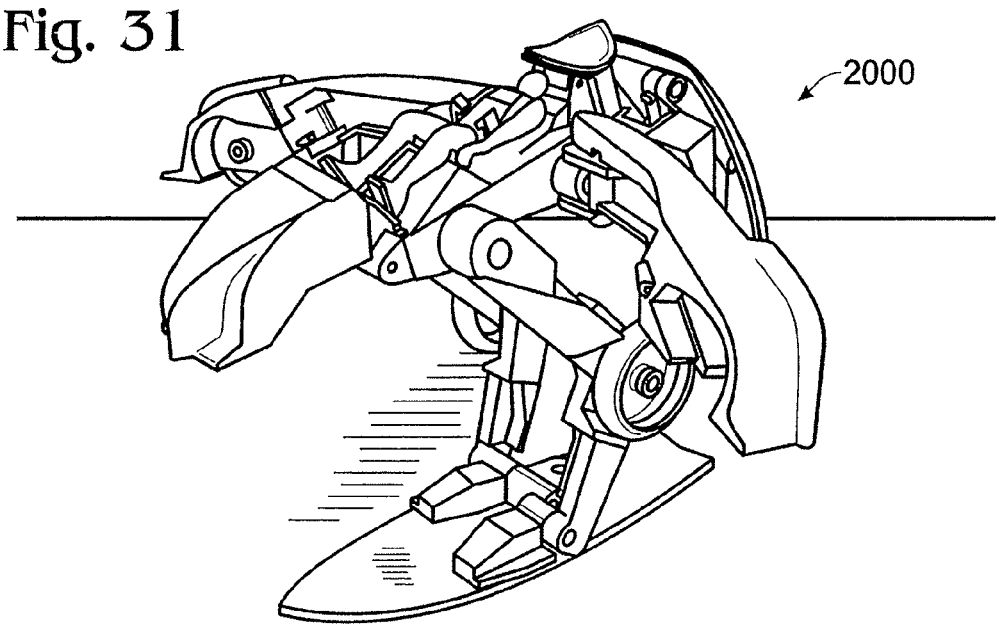
Figure 32:
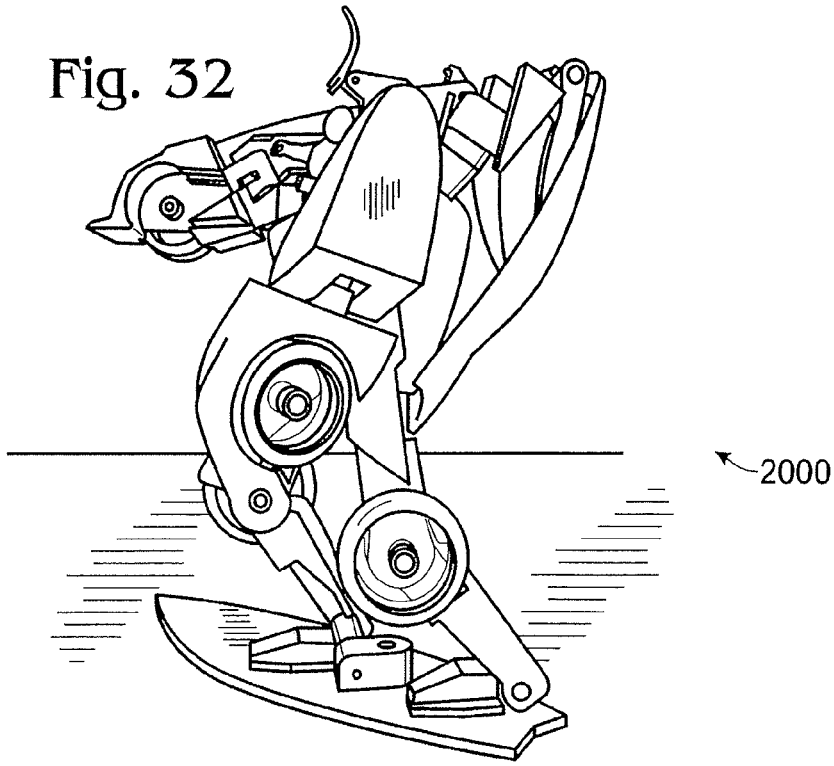

FIGS. 28 and 29 respectively show a three-dimensional view and a two-dimensional view of the power-suit frame. Specifically, cockpit 2058 and canopy 2054 are shown coupled via joint assembly 2061. Joint assembly 2061 is shown including joint 2161, joint 2163 (FIG. 29), joint 2164, and joint 2165 combined to form a four degree-of-freedom joint. Further, FIG. 28 shows joint 2051, coupling cockpit 2058 and front body section 2052 (FIG. 29). Referring now to FIG. 29, a side view of toy 2000 is shown. Specifically, joint assembly 2061 is shown having a first singe degree-of-freedom joint 2161 that enables rotation of section 2162 relative to cockpit 2058. Joint 2163 forms a second single degree-of-freedom joint enabling rotation of afterburner section 2092 relative to section 2162. Joint 2164 forms a third single degree-of-freedom joint enabling rotation of section 2155 relative to afterburner section 2092 about axis 2171 (FIG. 28). Joint 2165 forms a fourth single degree-of-freedom joint enabling rotation of canopy 2054 relative to section 2155 about axis 2172 (FIG. 28). Further, trigger 2060 is shown configured to rotate relative to cockpit 2058 via joint 2160 during actuation. Front body section 2052 is shown configured to rotate relative to cockpit 2058 via joint 2051 about axis 2174 (FIG. 28). In this manner, front body section 2052, afterburner section 2092 and canopy 2054 may rotate relative to cockpit 2058 during transformation between modes.

Continuing with FIG. 29, cockpit 2058 is shown with the left arm and left leg removed exposing the two releasable interfaces 2140 and 2144 configured to respectively receive a front quarter panel section (arm) and a rear quarter panel section (leg) respectively. For example, end portion 2146 may be releasably coupled to releasable interface 2140 of cockpit 2058 in the manner described above with reference to FIG. 15, although other methods of connection are possible. Further, end portion 2142 of the rear quarter panel section (leg) may be releasably coupled to the opening created by releasable interface 2144 in a similar manner. Thus, upon activation of trigger 2060, disassembly of toy 2000 may occur.

An example process for reconfiguring toy 2000 is illustrated via FIGS. 20, 30, 31, 32, and finally 21. Specifically, in moving from the positions of FIG. 20 to FIG. 30, the rear quarter panels (legs) are each moved downward from the center sections, which drops the sports board away from the body members, and the cockpit canopy is rotated toward the rear of the vehicle. Then, in moving from the positions of FIG. 30 to FIG. 31, the front quarter panels are rotated outward. Further, the legs and arms are extended, and the cockpit canopy is further rotated toward the rear of the vehicle. Then, in moving from the positions of FIG. 31 to FIG. 32, front body section 2052 is rotated between the legs of the power-suit toward the rear of the suit. Finally, in moving from 32 to 21, the canopy is rotated further back to cover the front body section that has previously been rotated. Further, front section 2032 (lower arm) is rotated in relation to main section 2034 (upper arm) in order to simulate an elbow joint. Then, the action figure and power-suit can be repositioned so that the arms and legs are in similar or unique positions, so as to simulate the action figure's movement and/or positioning via the power-suit, thus providing an exciting power-suit play mode. Also, the process can be reversed to enable reversible reconfiguration back to the vehicle mode. It should be appreciated that the order described above is not required, and various alternative orders may be used, if desired.

Figure 33:
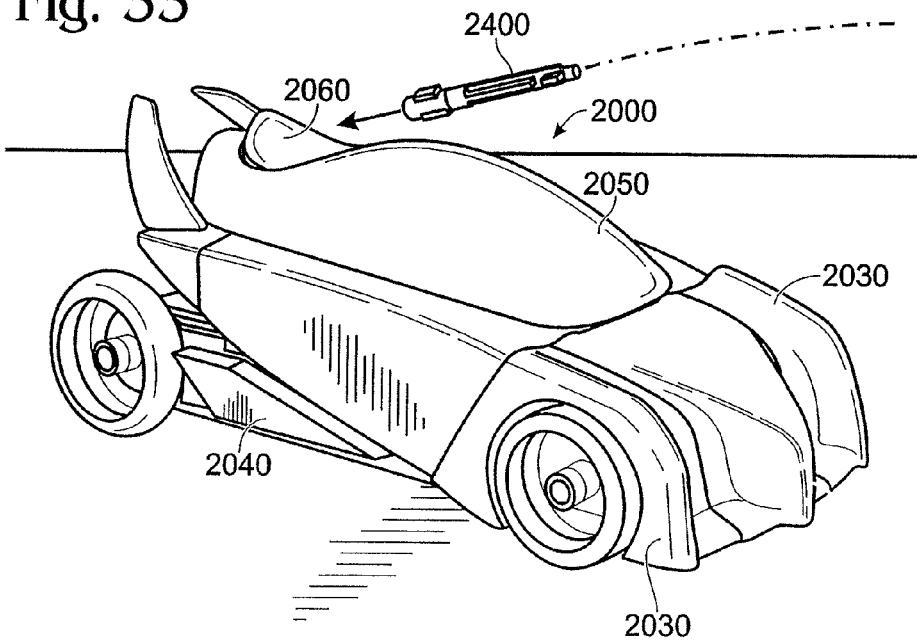
Figure 34:
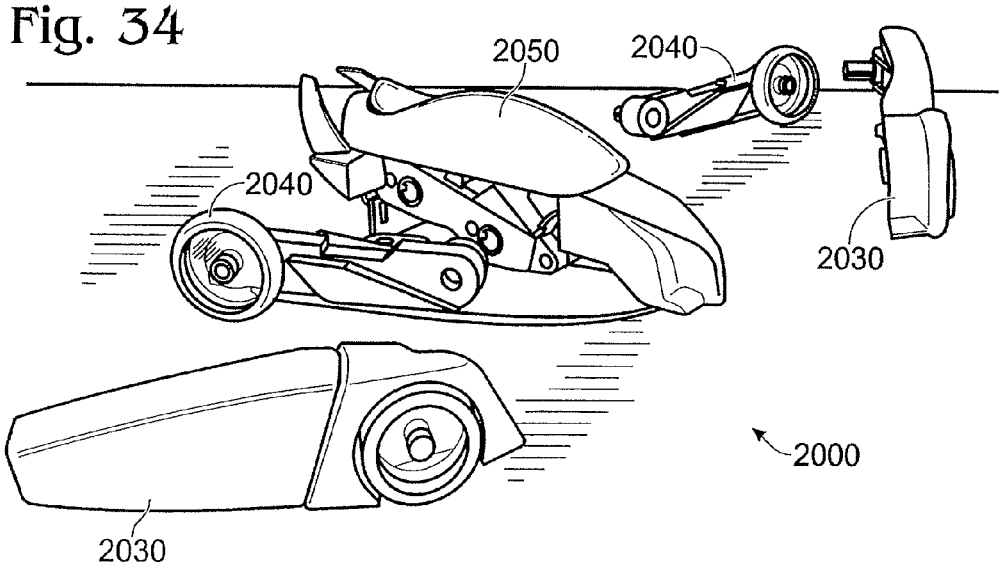
Figure 35:
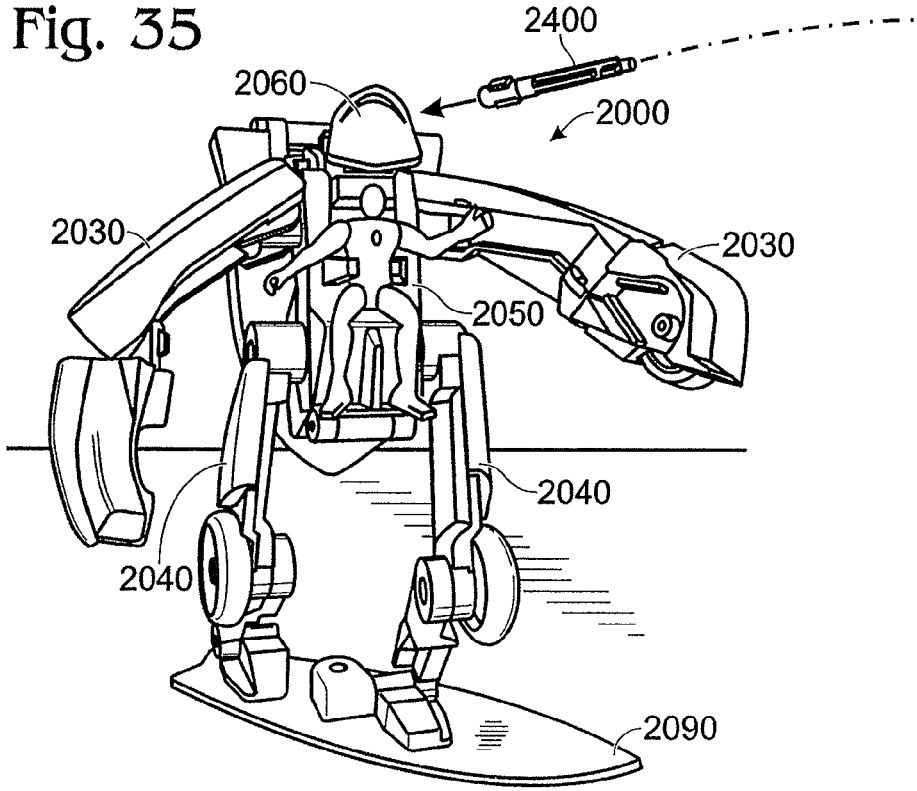
Figure 36:
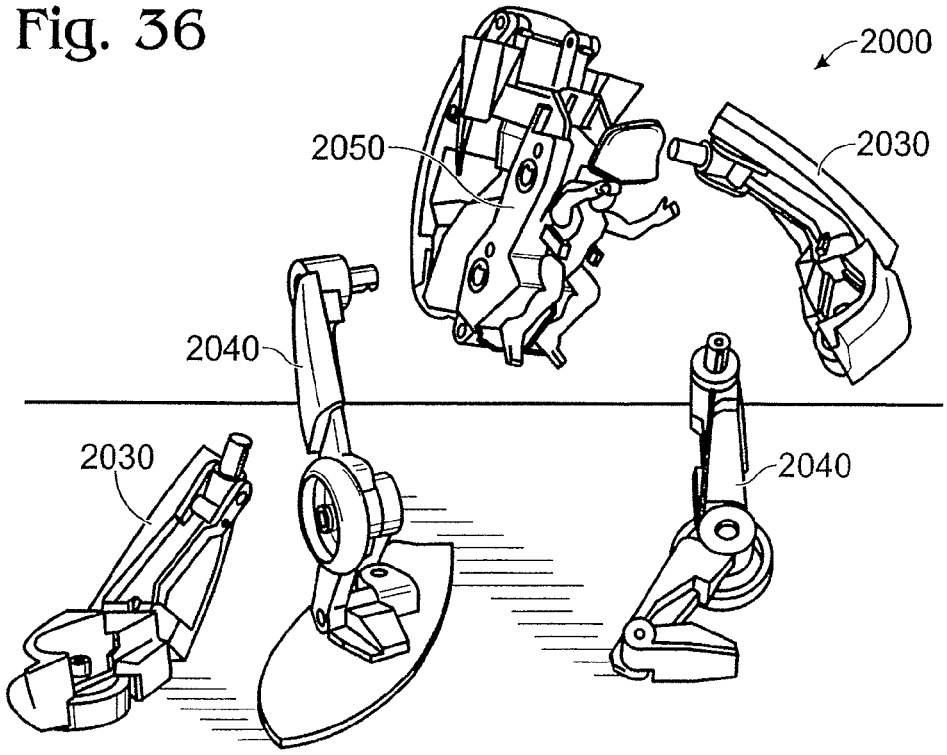

FIGS. 33-36 show the disassembly of toy 2000 when trigger 2060 is actuated. Specifically, FIGS. 33-34 show such action when the toy is configured as a vehicle, while FIGS. 35-36 show such action when the toy is configured as a power-suit. Referring now to FIG. 33, front quarter panels 2030 and rear quarter panels 2040 are shown releasably coupled to center cockpit 2058 with an item 2400 flying toward trigger 2060. As described herein, activation of trigger 2060 (by item 2400 for example) can cause release of the releasably coupled front and rear quarter panels as shown in FIG. 34. Likewise, FIG. 35 shows toy 2000 configured as a power-suit, with an item 2400 approaching trigger 2060. FIG.

36 shows the toy after activation of the trigger by item 2400, with each of the front quarter panels 2030 (arms) and rear quarter panels 2040 (legs) uncoupled from the cockpit 2058. As shown in FIGS. 34 and 36, activation of the trigger can cause the releasable portions to be forcibly uncoupled such that they are ejected from the central body (cockpit) of the toy thereby causing the various portions to be substantially separated upon release and/or uncoupling.

In some embodiments, toy 2000 may be configured to receive one or more interchangeable accessories, a further discussion of which is presented below with reference to FIGS. 75-85.

Figure 37:
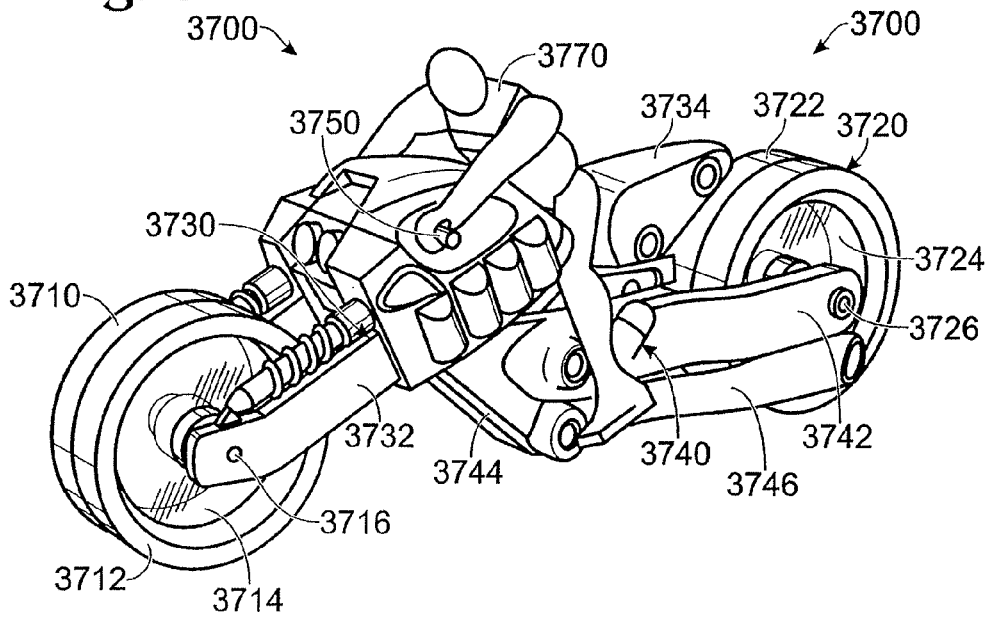
FIGS. 37-47 show a third example toy, which is transformable between a vehicle and a power-suit simulating a skydiving activity.
Figure 38:
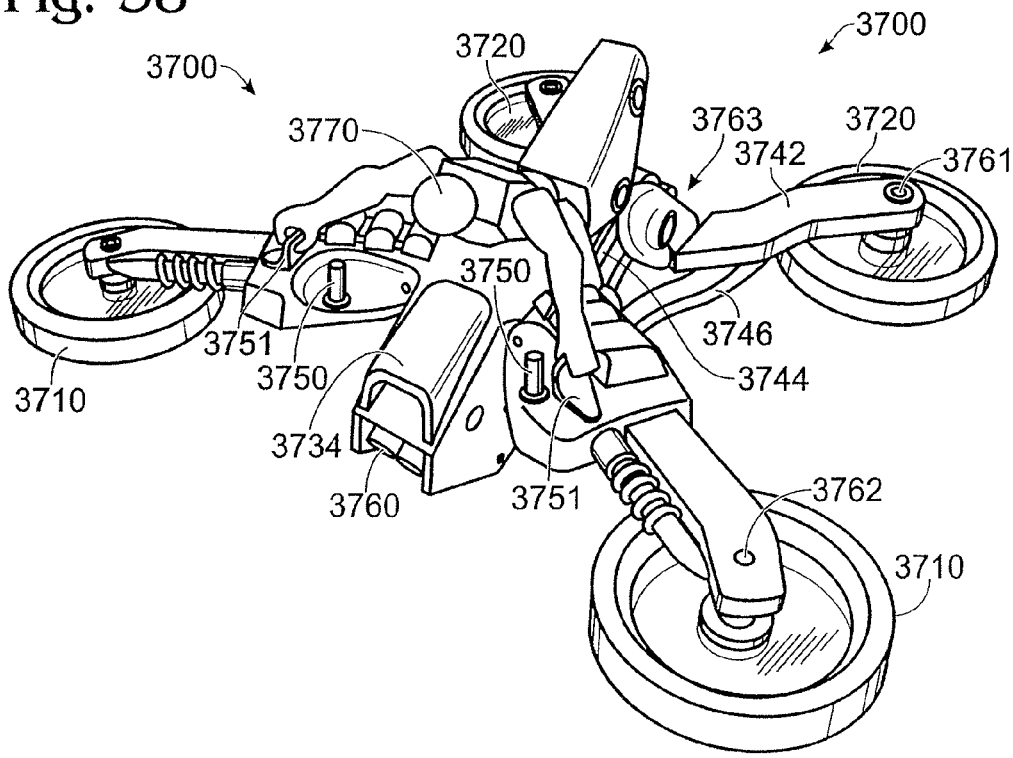

Referring now to FIGS. 37-47, an example vehicle that can be reversibly reconfigured to a power-suit simulating a skydiving activity is described. Specifically, FIG. 37 shows toy 3700 in a folded vehicle configuration simulating a motorcycle, and FIG. 38 shows toy 3700 in a spread power-suit configuration simulating a skydiving power-suit. As will be described in more detail below, toy 3700 can be reversibly reconfigured between the configurations of FIGS. 37 and 38 by manipulation of various components.

In this example embodiment, toy 3700 simulates a vehicle such as a motorcycle that has two front wheels 3710 and two rear wheels 3720. As shown in FIG. 37, each pair of the front and rear wheels when combined can simulate a single wheel. The front wheels and the back wheels each have inner sides that face one another when in the vehicle configuration. While various types of wheels may be used, front wheel 3710 can have an outer portion 3712, an inner portion 3714, and a center (or axle) portion 3716. Wheel 3720 is also shown having an outer portion 3722, an inner portion 3724, and a center (or axle) portion 3726. Wheel 3720 can be identical to wheel 3710 in terms of coloring and construction, or can include some variations. Further, while various types of wheels may be used, the wheels of toy 3700 can be identical to the wheels of toy 100 in terms of coloring and construction, or can include some variations.

Continuing with FIG. 37, toy 3700 is shown with a front section 3730 and a rear section 3740. As described below, front section 3730 and rear section 3740 are reversibly reconfigurable to respectively simulate arms and legs in the power-suit configuration. Front section 3730 is shown to include two front members 3732 and a main section 3734. Further, rear section 3740 is shown including two rear members 3742 (only 1 is visible in FIG. 37, an inner section 3744 and two exhaust sections 3746 (only one of which is visible in FIG. 37). Front members 3732 and rear members 3742 can respectively simulate front and rear motorcycle forks in the vehicle configuration. As described in more detail below, front section 3730 has a seat or saddle, and attachment components 3750 and 3751 incorporated into main section 3734 that allows an action figure 3770 to be placed onto and off of the reconfigurable toy 3700. In this embodiment, two sets of attachment components 3750 and 3751 are provided so that the hands of action figure 3770 can be coupled to toy 3700. As shown in FIGS. 37 and 38, the hands of the action figure may be coupled to attachment component 3750 in the vehicle configuration and coupled to attachment component 3751 in the skydiving configuration. By having two sets of attachment components (3750 and 3751) positioned differently, the action figure can be coupled to the toy in both modes to simulate exciting racing and skydiving action. In this way, action figure play can be used in both the vehicle and power-suit modes, providing additional fun and excitement.

The interface between front section 3730 and rear section 3740 is formed by releasable interface 3830 that is configured to be released upon activation of trigger 3760. When trigger 3760 is actuated, various portions and/or sections of the toy can be uncoupled from each other, thus simulating disassembly, collision, and the like. The disassembly of toy 3700 will be further described below with reference to FIGS. 43-47.

Referring now to FIG. 38, toy 3700 is shown in a power-suit configuration with action figure 3770 wearing the suit, where the action figure is coupled to the front section 3730 via a pair of attachment components 3750 and a seat portion incorporated into main section 3734. In this example, the attachment components 3751 are coupled to the hands of action figure 3770, however various other methods of coupling could be used, if desired. For example, there may be connection points at the waist or ankles of the action figure as described above with reference to toy 100.

Further, FIG. 38 shows toy 3700 in a power-suit configuration simulating a skydiving activity, where the two rear wheels 3720 simulate feet, and the two front wheels 3710 simulate hands. Further, front members 3732 can simulate arms and rear members 3742 can simulate legs power-suit configuration. In the spread apart skydiving mode, the inner sides of the wheels are shown facing in substantially the same direction wherein they are configured to point downward and away from the action figure and frame of the power-suit. Wheels 3720 are shown coupled to rear member 3742 via joint 3840. Wheels 3710 are shown coupled to the front members 3732 via joint 3762. Continuing with FIG. 38, toy 3700 is shown with the two rear member 3742 reconfigured into legs, which are coupled to inner section 3744 by hip assembly 3763.

Figure 39:
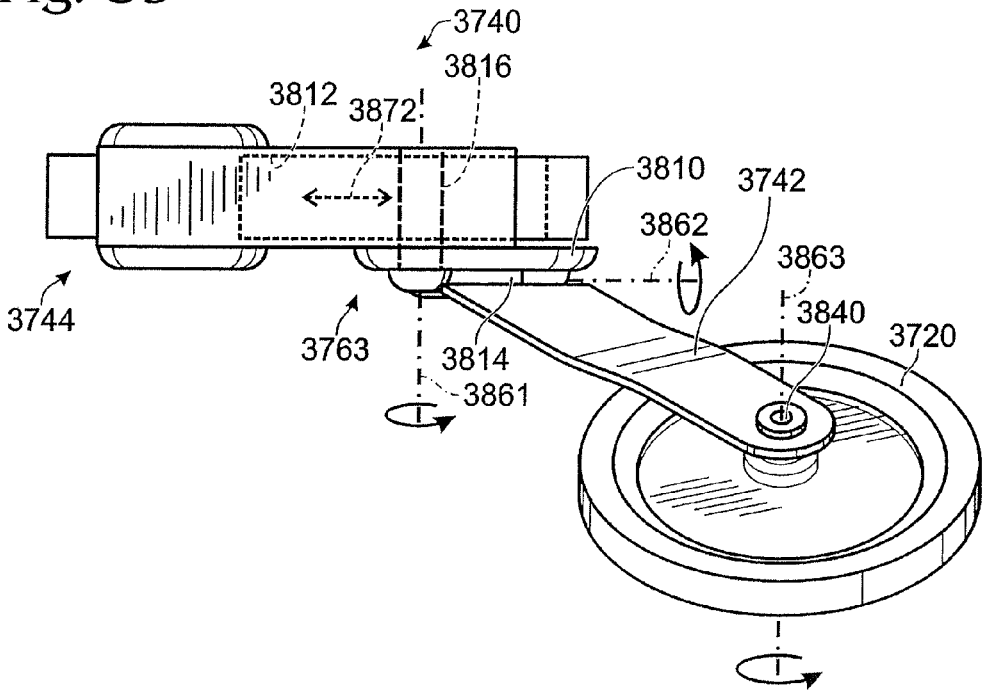
Figure 40:
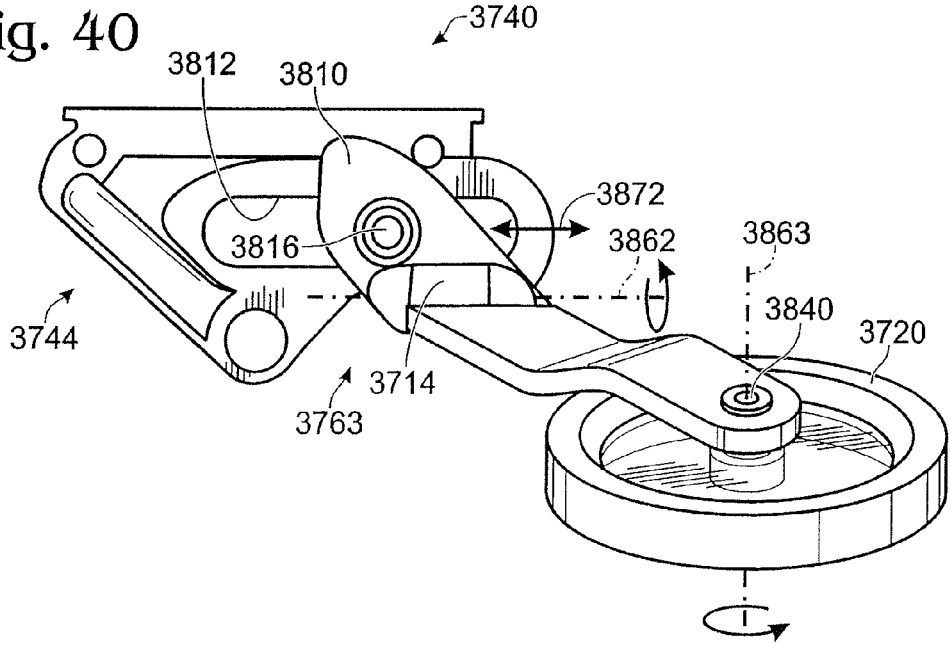

FIGS. 39-40 respectively show a two dimensional top view and side view of rear section 3740. Hip assembly 3763 is shown including joints 3816 and 3814, which enable both translation and rotation of rear member 3742 relative to inner section 3744. Joint 3814 is shown configured to couple rear member 3742 to sliding section 3810 and is shown as a single degree-of-freedom joint rotating about axis 3862. Sliding section 3810 is shown constrained by slot 3812, which allows translation of rear member 3742 along vector 3872 relative to inner section 3744. Concurrently, joint 3816 allows sliding section 3810 to rotate relative to inner section 3744 about axis 3861. In this manner, hip assembly 3763 may be used to enable positioning of the legs to simulate leg action in the power-suit configuration. Further, joint 3840, which couples rear wheel 3720 to rear member 3742, is shown as a single degree-of-freedom joint that allows rear wheel 3720 to rotate relative to rear member 3742.

Figure 41:
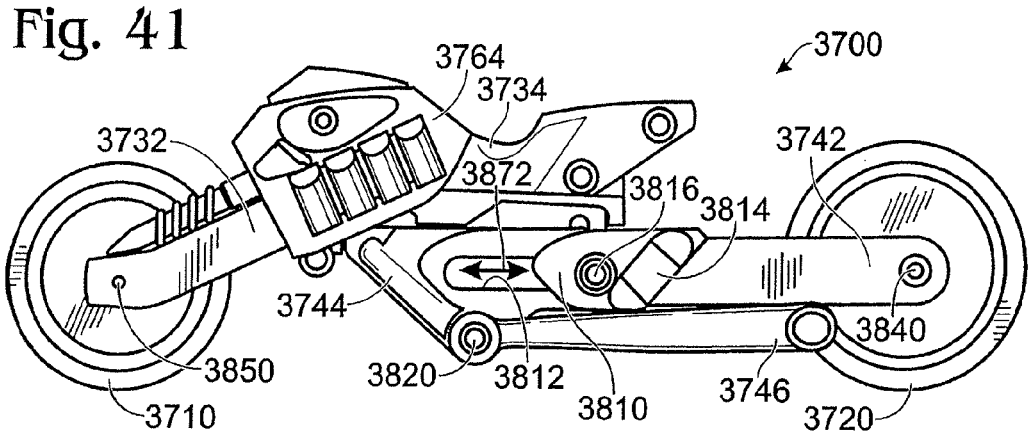

FIG. 41 shows a side view of toy 3700. Shoulder joint 3764 is shown as a single degree-of-freedom joint configured to couple front member 3732 to main section 3734. FIG. 41 also shows the various joints described above with reference to FIGS. 39 and 40.

Figure 42:
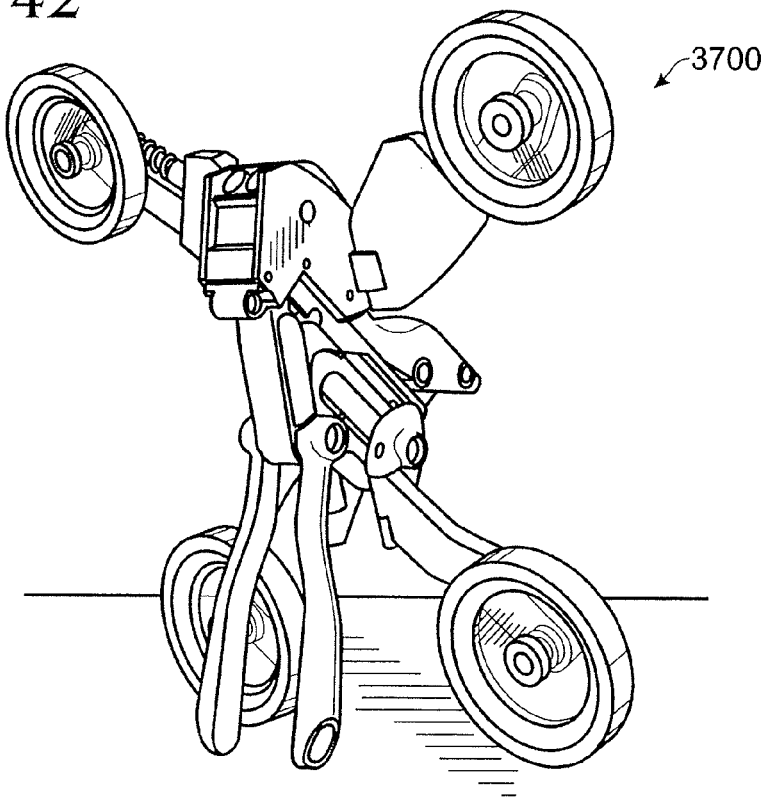

An example process for reconfiguring toy 3700 is illustrated via FIGS. 37, 41, 42, and finally 38. Specifically, in moving from the positions of FIG. 37 to FIG. 41, the rear member 3742 is moved (translated) toward the rear of the vehicle relative to inner section 3744 along vector 3872. Then, in moving from the positions of FIG. 41 to FIG. 42, the front and rear portions can be rotated outward. Further, exhaust sections 3746 may be rotated downward from inner section 3744. As described above with reference to toy 100, the action figure and power-suit may be repositioned so that arms and legs are in similar or unique positions, so as to simulate the action figure's movement and/or positioning via the power-suit, thus providing an exciting power-suit play mode. Also, the process can be reversed to enable reversible reconfiguration. It should be appreciated that the order described above is not required, and various alternative orders may be used, if desired.

Figure 43:
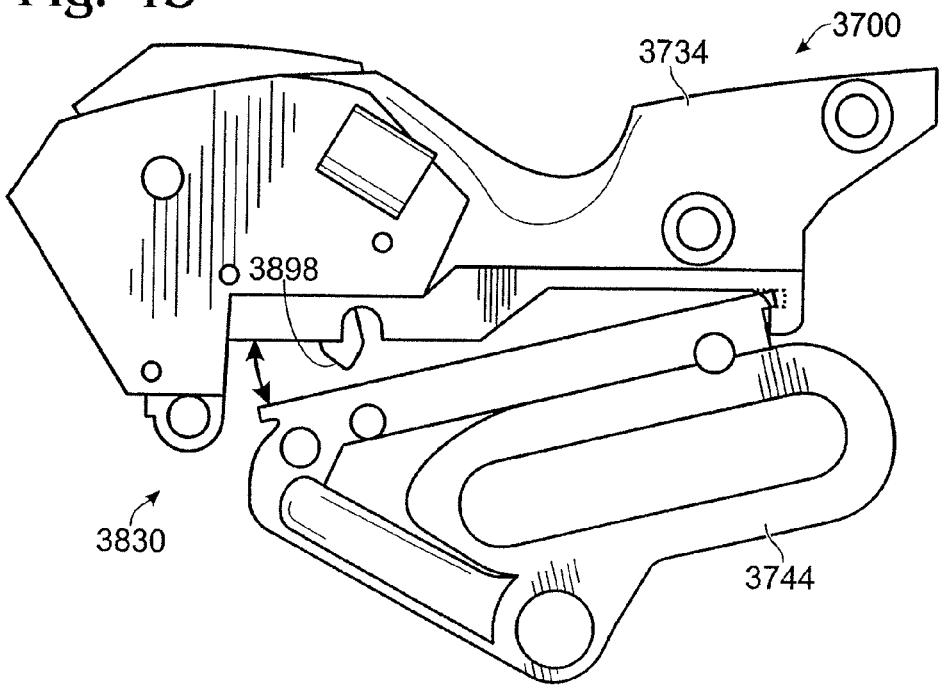

Referring now to FIG. 43, a two dimensional schematic view of releasable interface 3830, which couples inner section 3744 and main section 3734, is shown. Inner section 3744 is shown configured to be released from main section 3734. Further, release mechanism 3898 is shown rotating in order to accept inner section 3744. When trigger 3760 is activated, release mechanism 3898 is configured rotate downward, thus ejecting inner section 3744 from main section 3734. Releasable interface 3830 shown in FIG. 43, while different from the release mechanism shown in FIG. 15, nonetheless accomplishes the similar task of causing disassembly of the toy upon activation of a trigger. Similarly, other methods of uncoupling/coupling the various portions could be utilized for toy 3700. In this manner, releasable interface 3830 may facilitate reliable disassembly. A further discussion of disassembly of toy 3700 will be discussed below with reference to FIGS. 44-47.

Figure 44:
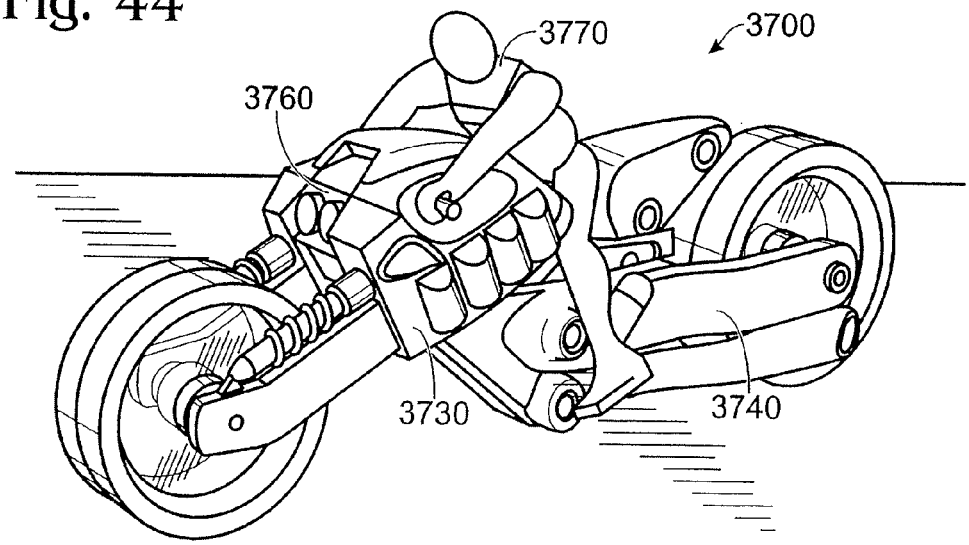
Figure 45:
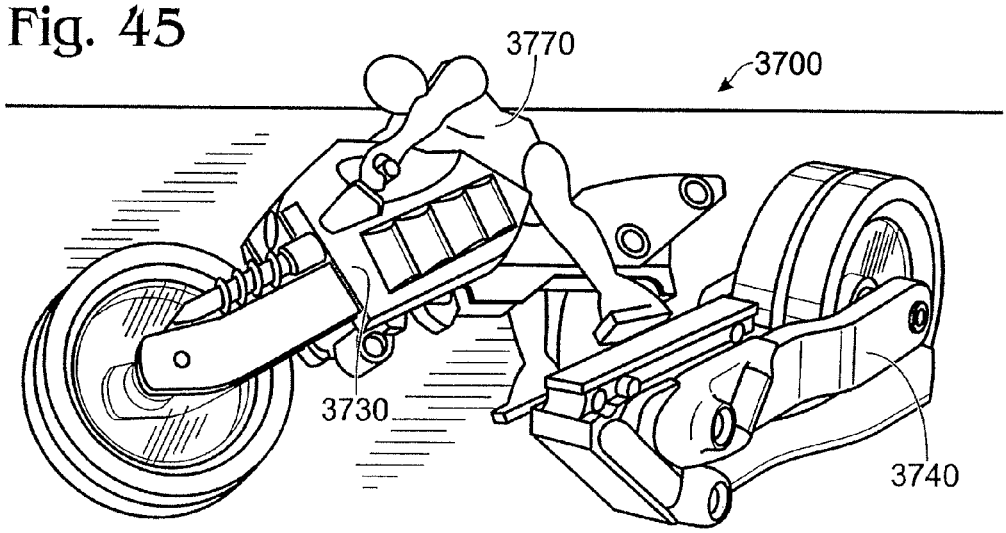
Figure 46:
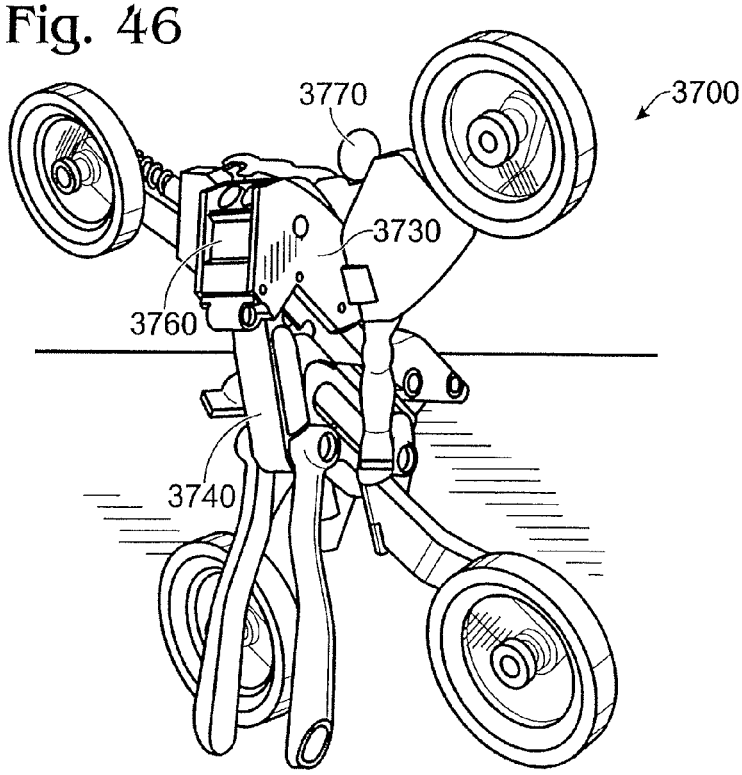
Figure 47:
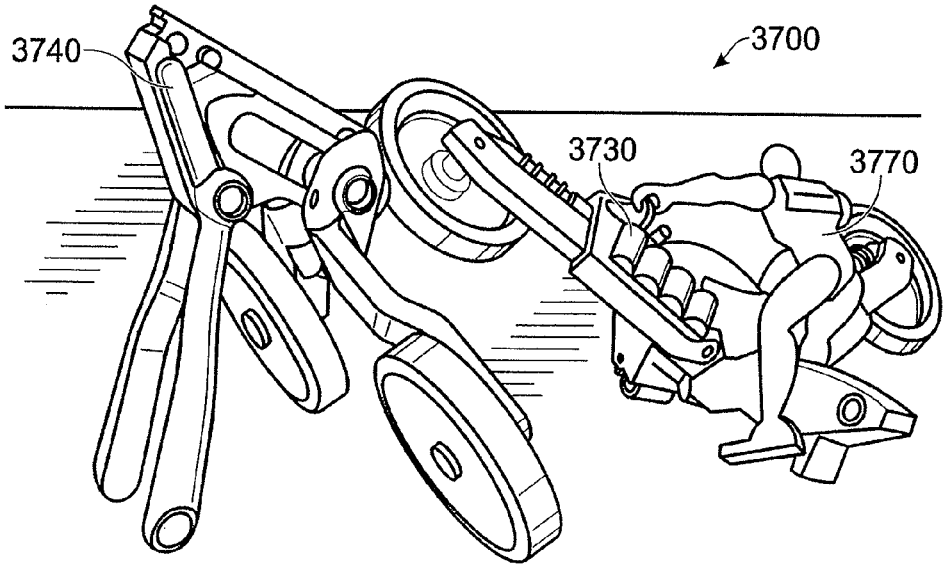

FIGS. 44-47 show the disassembly of toy 3700 when actuated such as by an ejected item and/or user, among others. Specifically, FIGS. 44-45 show such action when the toy is configured as a vehicle, while FIGS. 46-47 show such action when the toy is configured as a power-suit. Referring now specifically to FIG. 44 shows toy 3700 reversibly configured as a vehicle, with front members 3732 and rear members 3742 configured to simulate vehicle portions. As described herein, activation of trigger 3760 causes release of the releasably coupled rear section 3740 as shown in FIG. 45. Likewise, FIG. 46 shows toy 3700 reversibly configured as a power-suit and FIG. 47 shows the toy after activation of the trigger by the ejected item, causing the release of rear section 3740 simulating disassembly of toy 3700.

In some embodiments, toy 3700 may be configured to receive one or more interchangeable accessories, a further discussion of which is presented below with reference to FIGS. 75-85.

Figure 48:
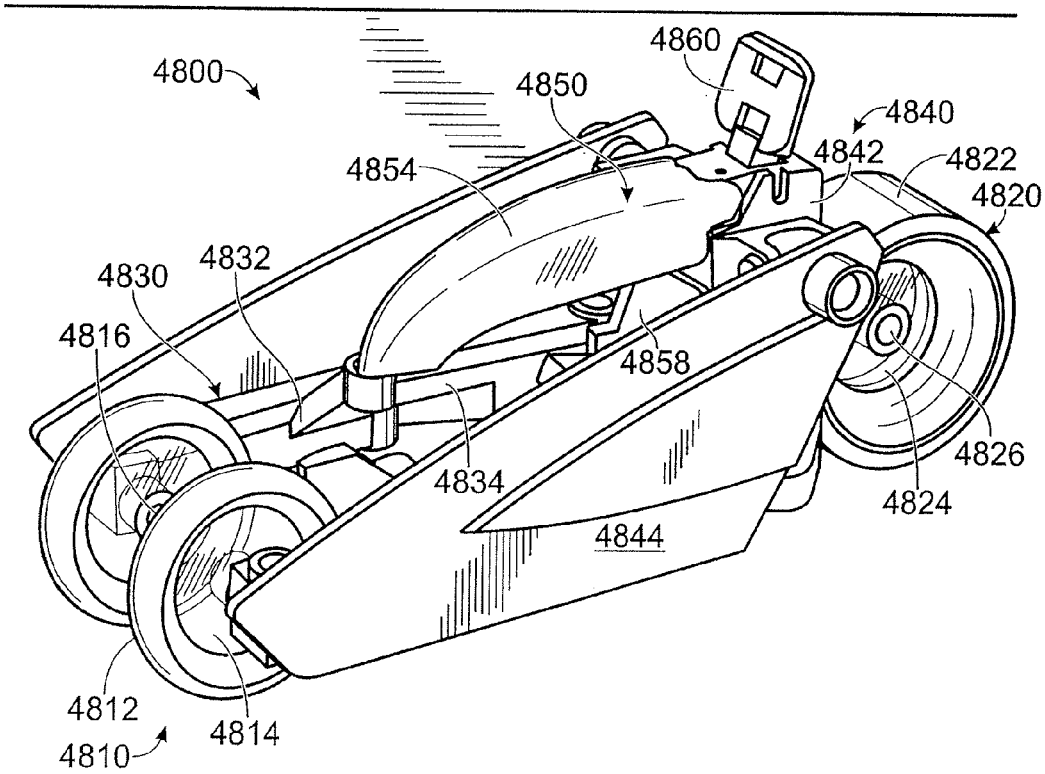
FIGS. 48-61 show a fourth example toy, which is transformable between a vehicle and a power-suit simulating a hang-gliding activity.
Figure 49:
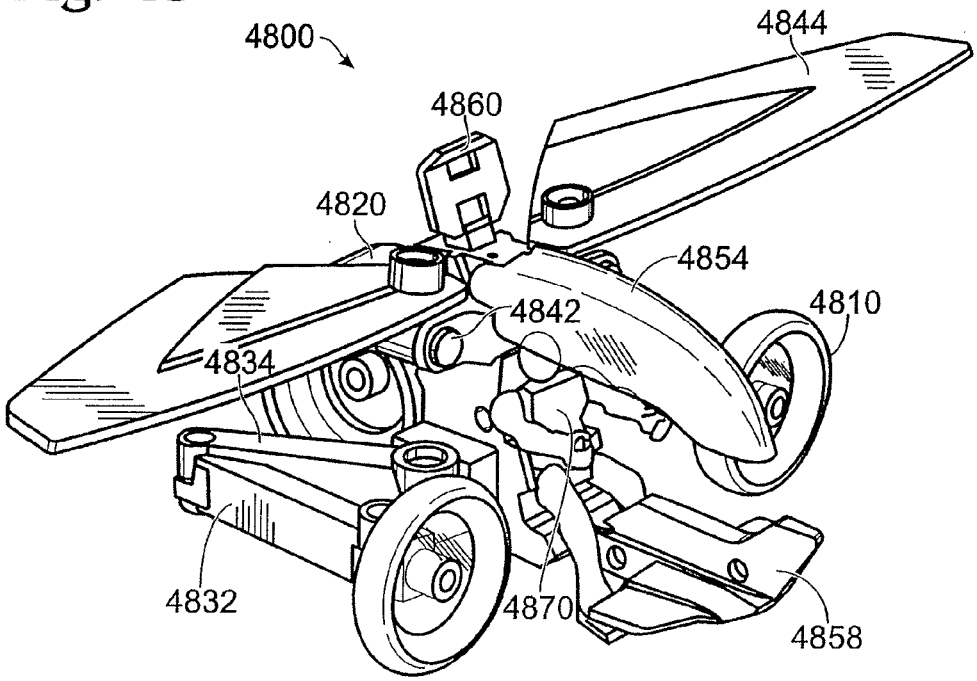

Referring now to FIGS. 48-60, an example of a reversibly reconfigurable toy that transforms between a vehicle mode (driving configuration) and a hang glider mode (flying configuration) is described. FIG. 48 shows reconfigurable toy 4800 in a vehicle configuration (FIG. 48) and in hang glider configuration (FIG. 49). As will be described in more detail below, toy 4800 can be reversibly reconfigured between the configurations of FIGS. 48 and 49 by manipulation of various components.

Referring to FIG. 48, toy 4800 is shown in a vehicle mode having two front wheels 4810 and one rear wheel 4820. While various types of wheels may be used, front wheel 4810 can have an outer portion 4812, an inner portion 4814, and a center (or axle) portion 4816. Wheel 4820 is also shown having an outer portion 4822, inner portion 4824, and a center (or axle) portion 4826. Wheel 4820 can be identical to front wheel 4810 in terms of coloring and construction, or can include some variations. Further, while various types of wheels may be used, the wheels of toy 4800 can be identical to the wheels of toy 100 in terms of coloring and construction, or can include some variations.

Continuing with FIG. 48, toy 4800 is shown with a rear section 4840 and two front sections 4830. As described below, rear section 4840 includes main section 4842 and two wings 4844. Further, front sections 4830 may be reversibly reconfigured to simulate engines or thrusters in the hang glider configuration. Front section 4830 is shown including a first section 4832 and a second section 4834. FIG. 48 also shows a center section 4850, which includes a cockpit 4858 and a canopy 4854. As described in more detail below, canopy 4854 can open allowing an action figure (not shown) to be placed into and out of the cockpit. In some embodiments, canopy 4854 may include plastic that is opaque, clear, translucent, or combinations thereof. In some embodiments, at least a portion of canopy 4854 may include translucent materials that are colored similarly to section 4812 and/or 4822 of the wheels.

Continuing with FIG. 48, the interface between front section 4830 and rear section 4840 is configured to be uncoupled upon activation of trigger 4860, thus simulating disassembly. Disassembly of toy 4800 will be further discussed below with reference to FIGS. 58-61.

Referring now to FIG. 49, toy 4800 is shown in a hang glider configuration with action figure 4870 coupled to the cockpit 4858 of the hang glider via clip 4872. In this example, the clip is coupled to a waist area of action figure 4870, however various other methods of coupling could be used, if desired. For example, there may be connection points at the hands of the action figure as described above with reference to toy 3700. Continuing with FIG. 49, toy 4800 is shown with the two wings 4844. Specifically, wing 4844 can be rotated relative to main section 4842. Further, section 4832 can rotated relative to section 4834 to retract front wheels 4810. Section 4834 can be rotated relative to cockpit 4858 to further retract front wheels 4810. The various joints enabling reconfiguration of toy 4800 are discussed in more detail below with reference to FIGS. 53 and 54.

Figure 50:
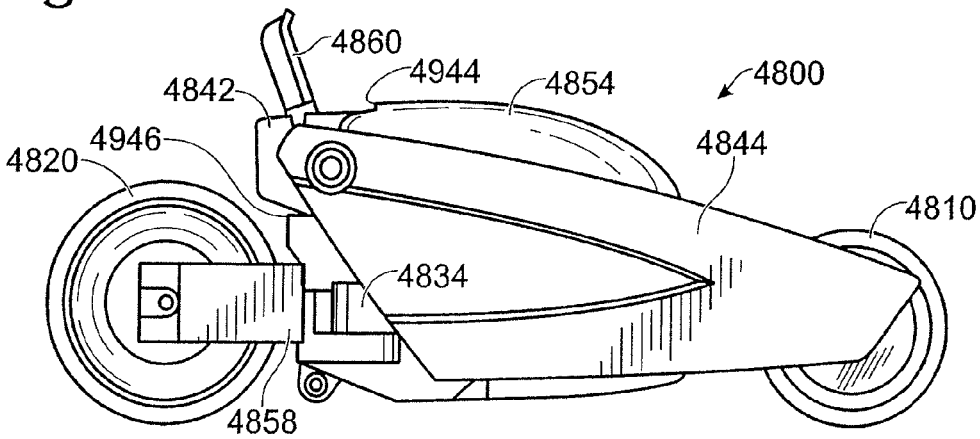
Figure 51:
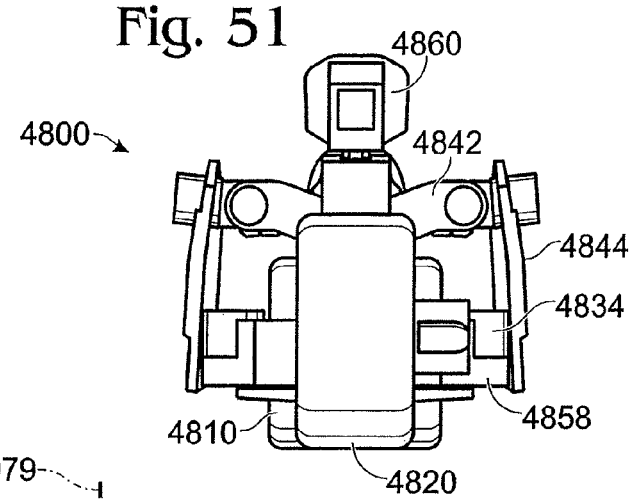

FIG. 50 shows a side view of toy 4800 in a vehicle configuration. Specifically, FIG. 50 shows releasable interface 4946 configured to uncouple main section 4842 from cockpit 4858 upon actuation of trigger 4860. Further, FIG. 50 shows canopy 4854 moveably coupled to the main section by joint 4944. FIG. 51 shows a rear view of toy 4800 in a vehicle configuration. Specifically, FIG. 51 shows how the various components of toy 4800 can be folded or positioned to represent a vehicle configuration.

Figure 52:
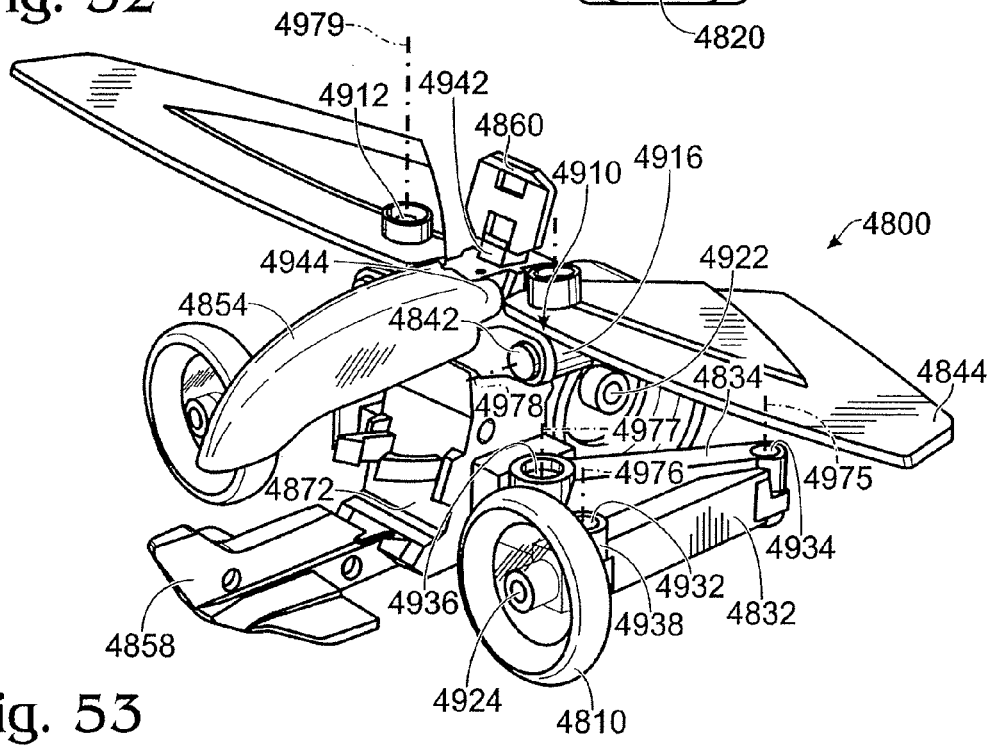

FIG. 52 shows a three dimensional view of a hang glider mode of toy 4800. As will be described herein toy 4800 utilizes a plurality of rotatable joints for the reconfiguration of various portions of toy 4800. Specifically, joint 4942 is shown as a single degree-of-freedom joint that allows trigger 4860 to rotate relative to main section 4842. Joint 4944, is shown as a single degree of freedom joint enabling canopy section 4854 to rotate relative main section 4842. Joint 4922 is shown as a single degree-of-freedom joint enabling wheel 4820 to rotate relative to cockpit 4858.

Figure 53:
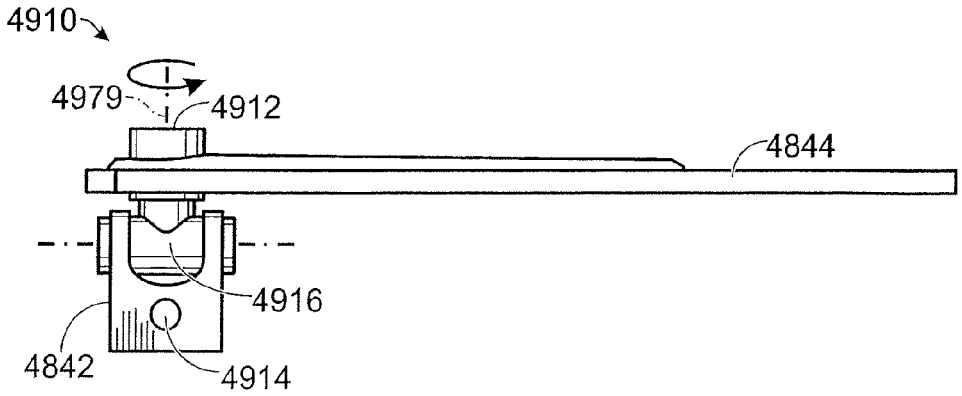
Figure 54:
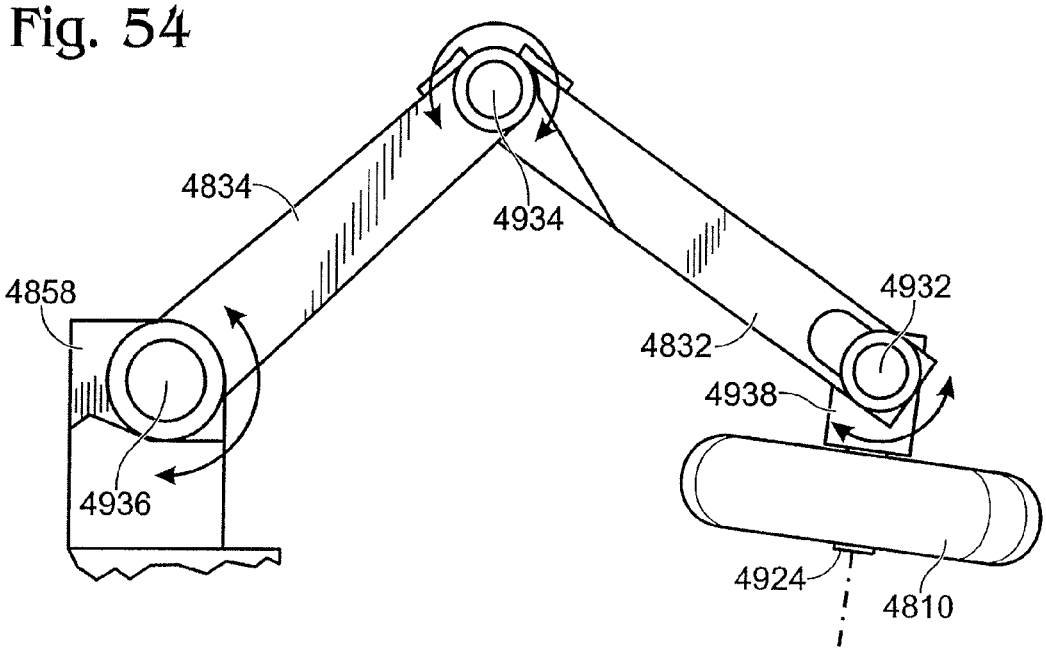
Figure 55:
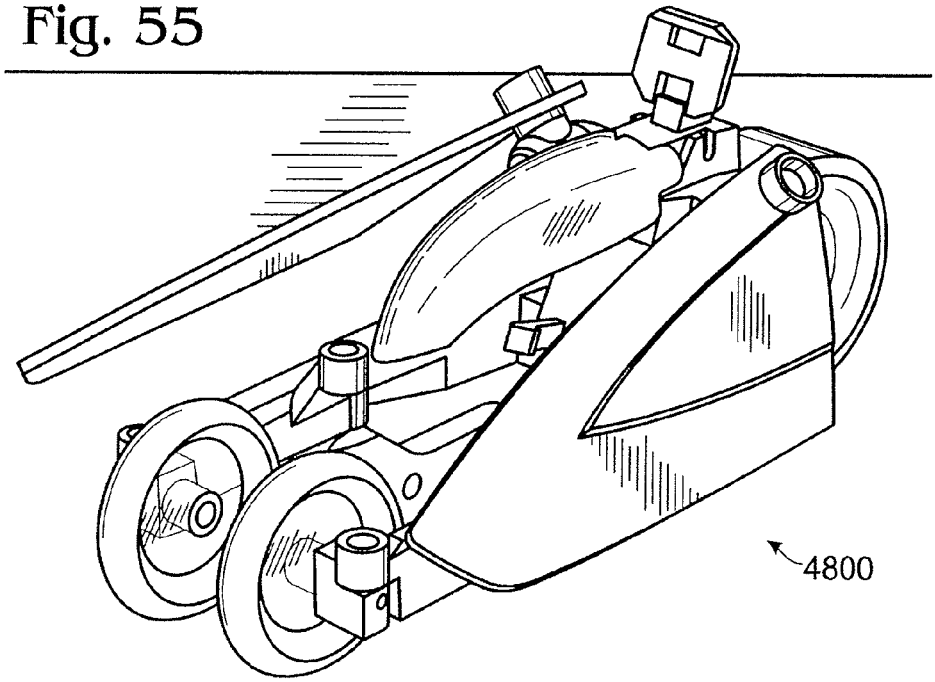
Figure 56:
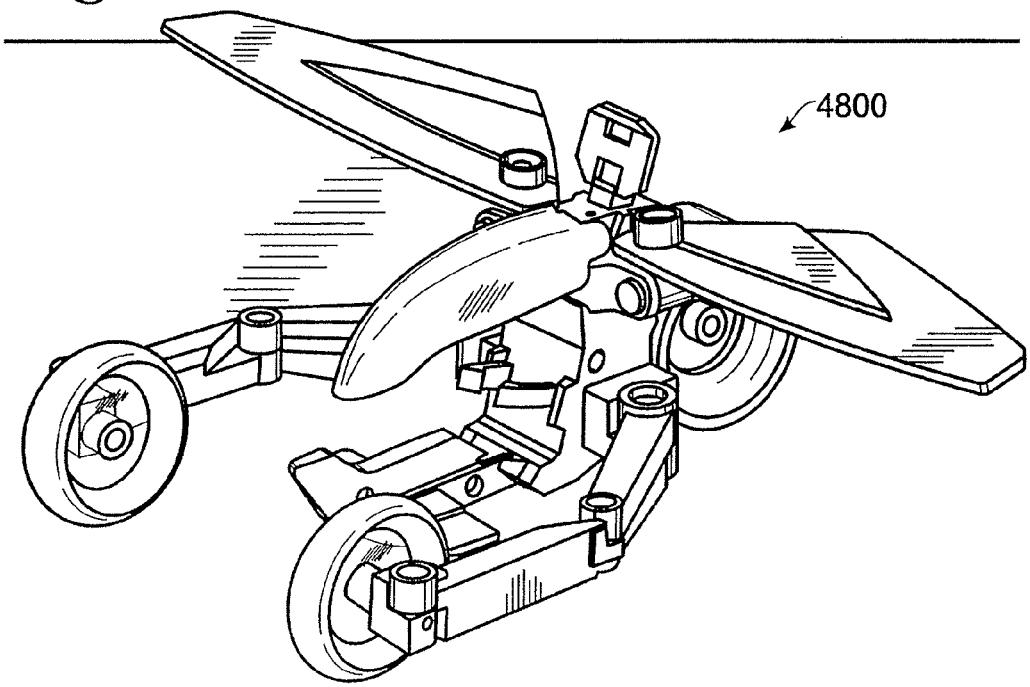
Figure 57:
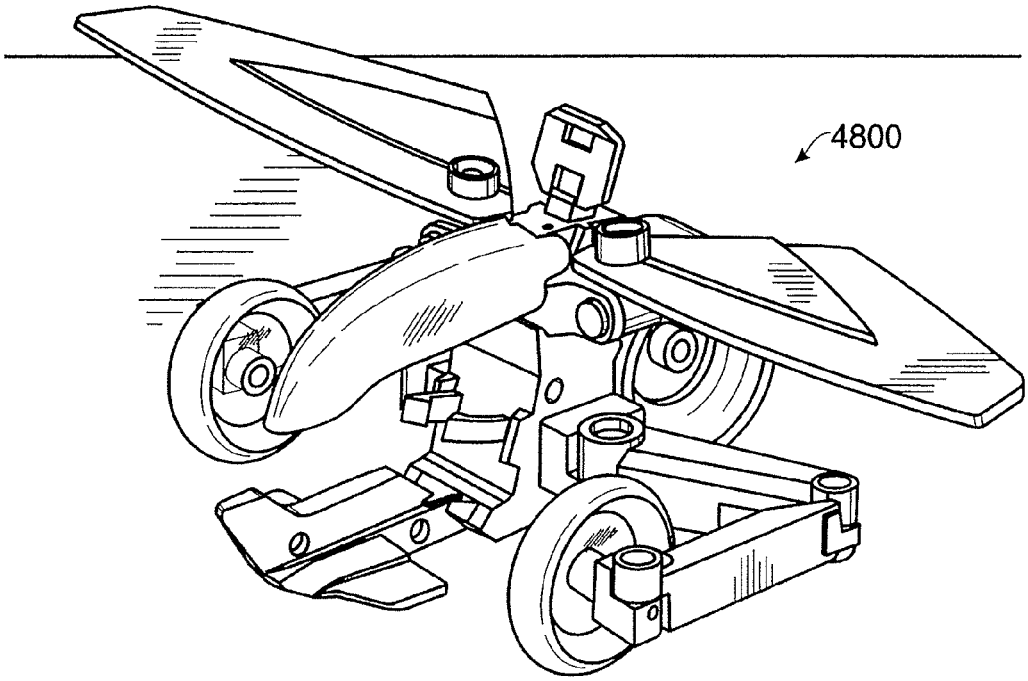

FIGS. 52, 53, and 54, show the various joints enabling transformation of toy 4800. Joint 4936 is shown as a single degree-of-freedom joint enabling section 4834 to rotate relative to cockpit 4858 about axis 4977. Joint 4934 is shown as a single degree-of-freedom joint enabling section 4832 to rotate relative to section 4834 about axis 4975. Joint 4932 is shown as a single degree-of-freedom joint enabling section 4938 to rotate relative to section 4832 about axis 4976. Joint 4924 is shown as a single degree-of-freedom joint enabling front wheel 4810 to rotate relative to section 4938. In this manner front wheels 4810 and front section 4830 may be retracted or extended during reconfiguration of toy 4800. Releasable interface 4946, which couples cockpit 4858 to main section 4842, is shown as a releasable coupling that when activated by trigger 4860 causes toy 4800 to disassemble into at least two portions. Activation of trigger 4860 will be further discussed below with reference to FIGS. 58-61.

Referring now to FIG. 53, a two dimensional side view of joint assembly 4910 coupling wing 4844 to cockpit 4858 is shown. Joint assembly 4910, which includes joints 4912 and 4914 allows for reconfiguration of wing 4844 to simulate a hang glider wing. Specifically, joint 4912 is shown as a single degree-of-freedom joint enabling wing 4844 to rotate relative to section 4916 about axis 4979. Joint 4914 is shown as a single degree-of-freedom joint enabling section 4916 to rotate relative to main section 4842 about axis 4978. In this manner joints 4912 and 4914 combined form a two degree-of-freedom joint enabling rotation of wing 4844.

An example process for reconfiguring toy 4800 is illustrated by FIGS. 48, 55, 56, 57, and finally 49. Specifically, in moving from the positions of FIG. 48 to FIG. 55, the wing 4844 (hang glider wings) are rotated about axis 4978 toward a horizontal configuration. Then, in moving from the positions of FIG. 55 to FIG. 56, front sections 4830 are rotated outward. Further, the wing 4844 are rotated to a horizontal position and rotated toward the rear of the vehicle to simulate wings. Then, in moving from the positions of FIG. 56 to FIG. 57, front sections 4830 are rotated back and to the sides of the vehicle. Wings 4844 are further rotated back into a hang glider position. Finally, in moving from 57 to 49 front wheels 4810 are rotated to a configuration perpendicular to the direction of vehicle travel. Wings 4844 may be further rotated back, thus simulating a high speed of flight and further providing an exciting hang glider play mode. Also, the process can be reversed to enable reversible reconfiguration from the hang glider mode to the vehicle mode. It should be appreciated that the order described above is not required, and various alternative orders may be used, if desired.

In some embodiments, toy 4800 may be configured with an automatic transformation mechanism, which automatically causes the toy to be reconfigured between the vehicle mode and the hang glider mode with limited user interaction. However, in some embodiments, a transformation toy may use automatic transformation with some aspects of user assisted transformation. While described in the context of hang glider toy 4800, automatic transformation may be used with virtually any transformation toy. As such, a transformable toy can be configured to transform from one configuration to a completely different configuration with very little user interaction. For example, simply pushing a button can initiate a transformation that is automatically completed without further user interaction. In some embodiments, this can be accomplished by biasing a plurality of toy components to a second configuration, while they are releasably locked in a first configuration that can be unlocked by activating the automatic transformation mechanism.

Figure 58:
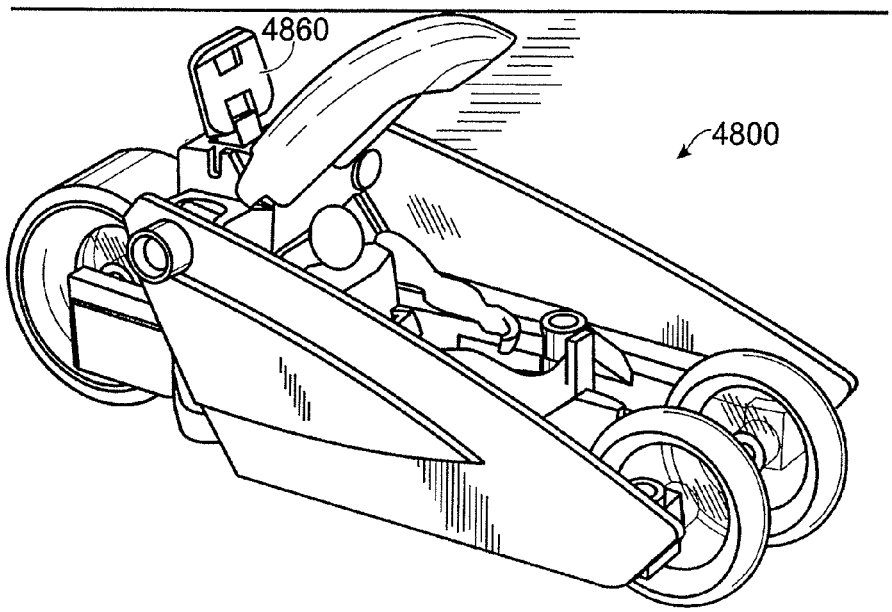
Figure 59:
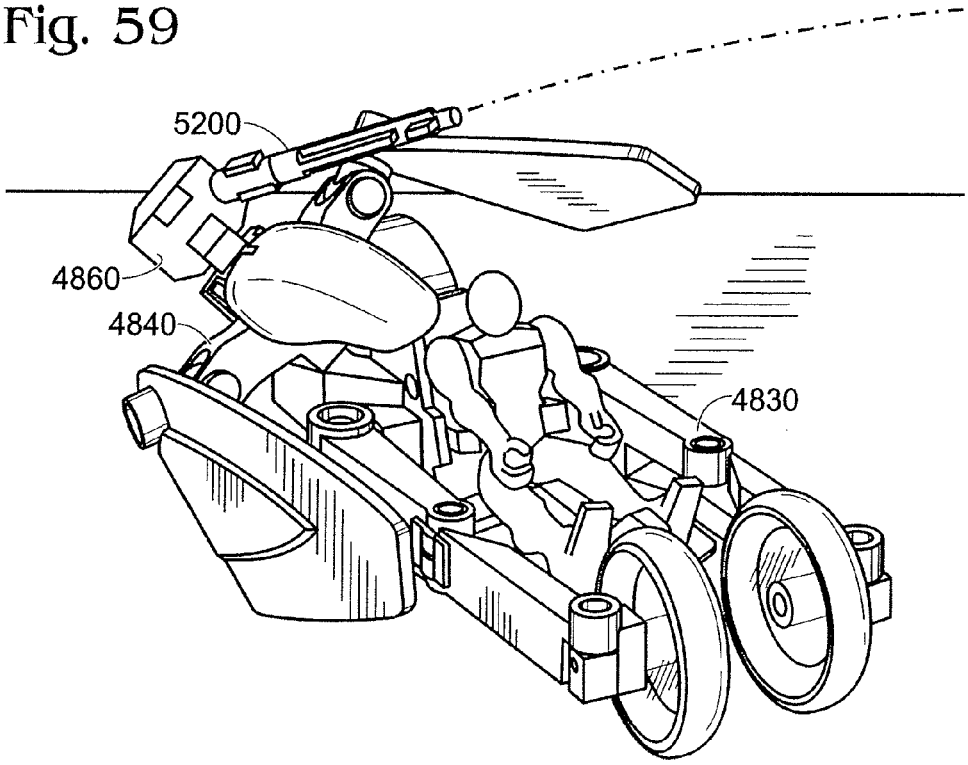
Figure 60:
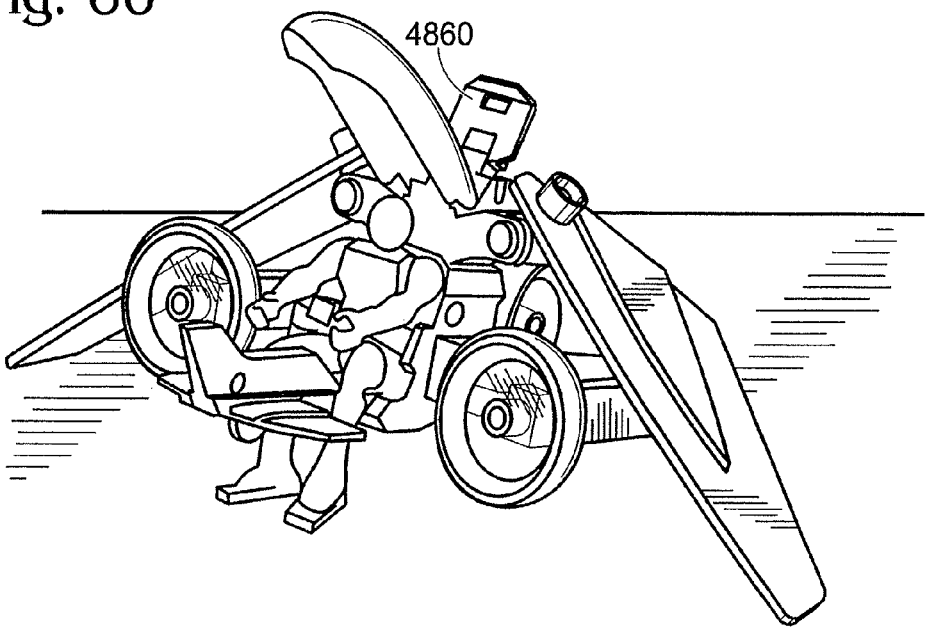
Figure 61:
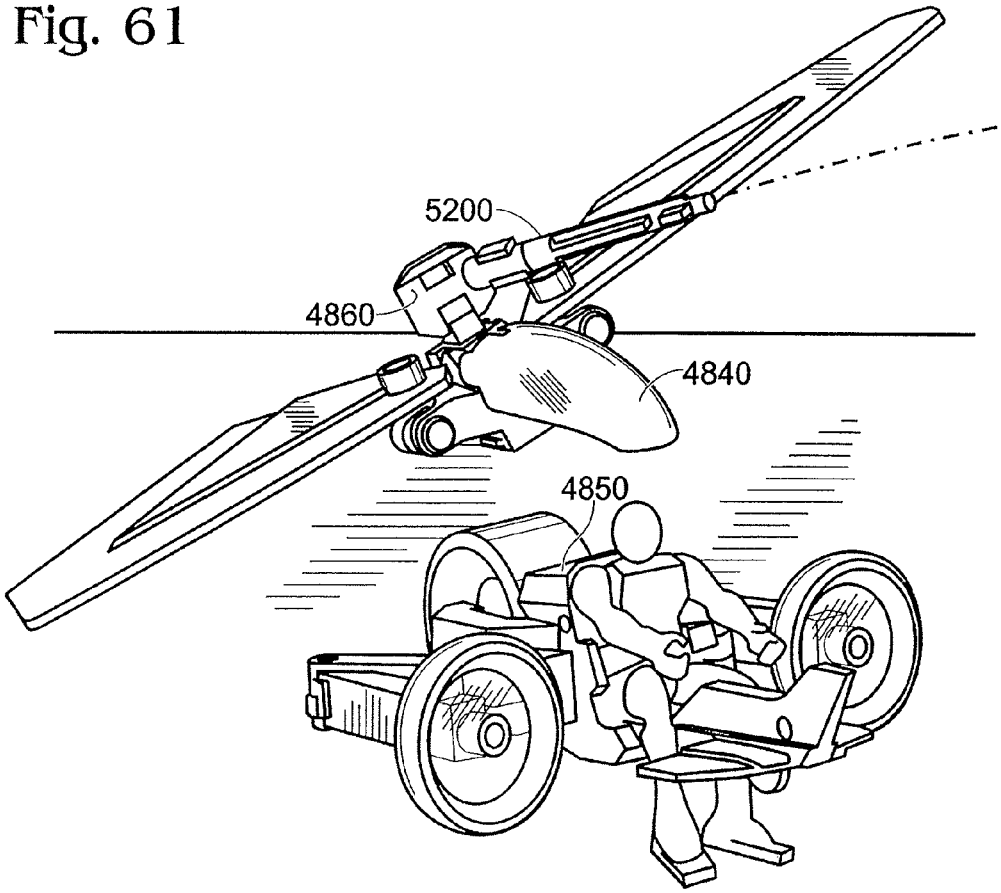

FIGS. 58-61 show the disassembly of toy 4800 when trigger 4860 is actuated. Specifically, FIGS. 58-59 show such action when the toy is configured as a vehicle, while FIGS. 60-61 show such action when the toy is configured as a hang glider. In particular, rear section 4840 comprising the canopy, wings, and trigger may be releasably coupled to cockpit in a manner described above with reference to FIG. 15; however other methods of releasably coupling portions of vehicle 4800 may be used. Toy 4800 is shown configured as a vehicle, with the cockpit coupled to rear section 4840. FIG. 59 shows ejected item 5200 striking trigger 4860 causing rear section 4840 to become uncoupled from the cockpit. Likewise, FIG. 60 shows toy 4800 reversibly configured as a hang glider and FIG. 61 shows the toy after activation of the trigger by item 5200.

In some embodiments, toy 4800 may be configured to receive one or more interchangeable accessories, a further discussion of which is presented below with reference to FIGS. 75-85.

Figure 64:
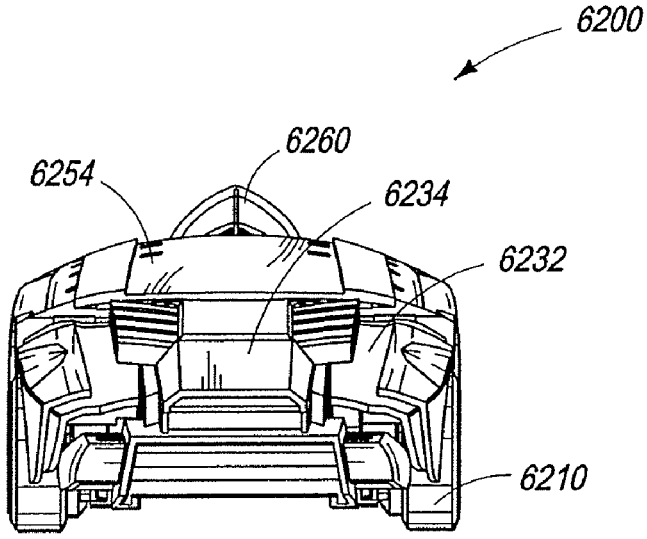
Figure 65:
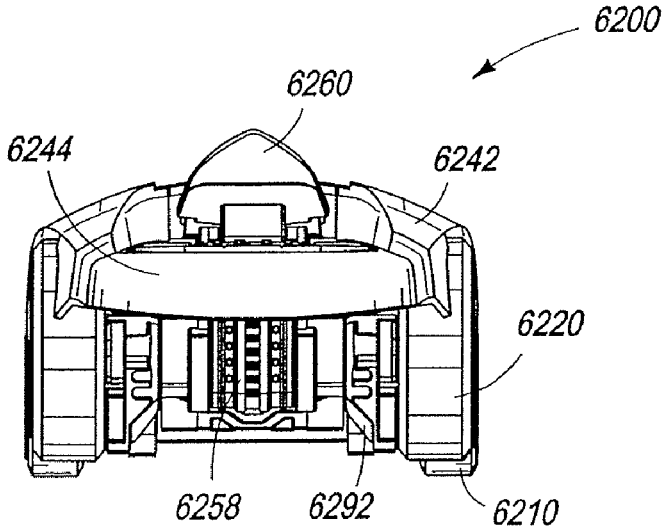
Figure 66:
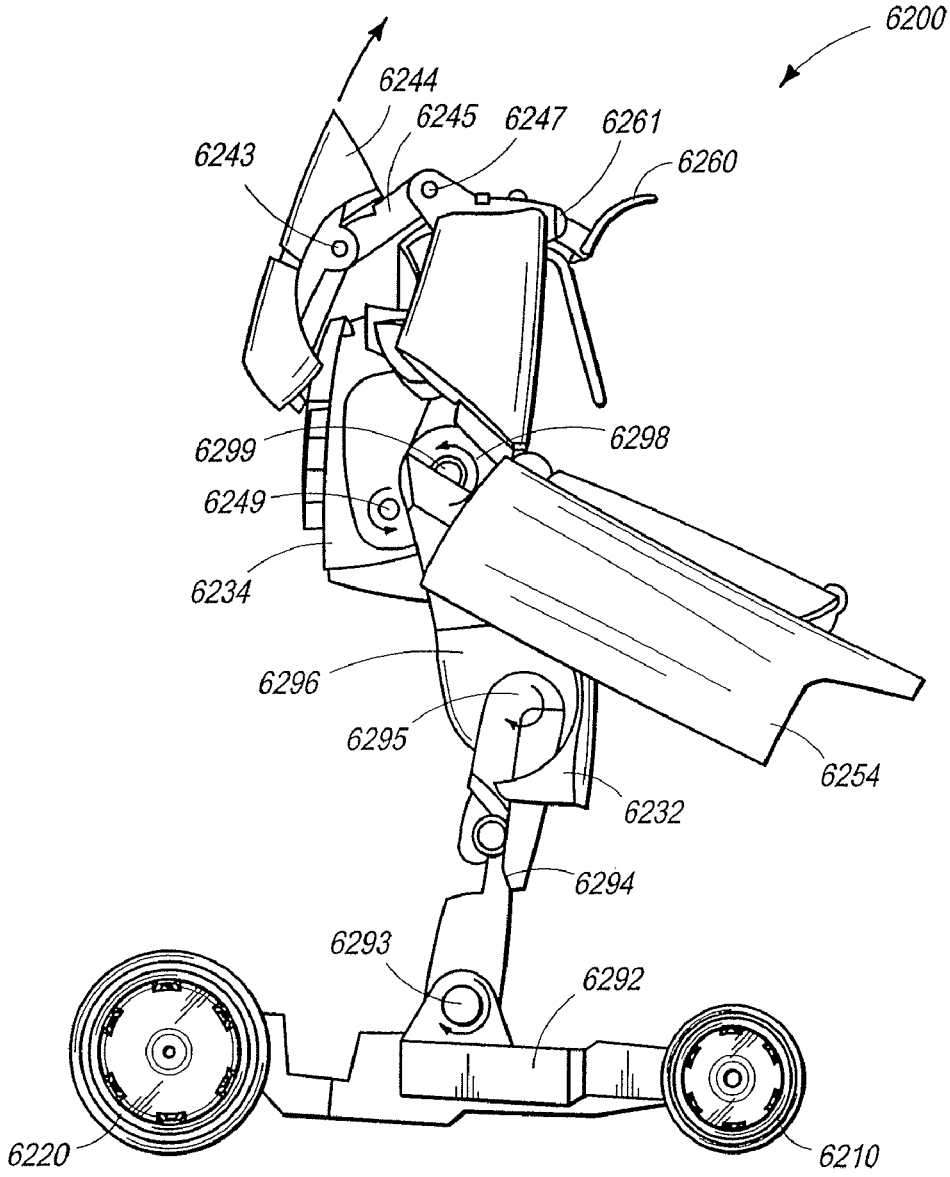
Figure 67:
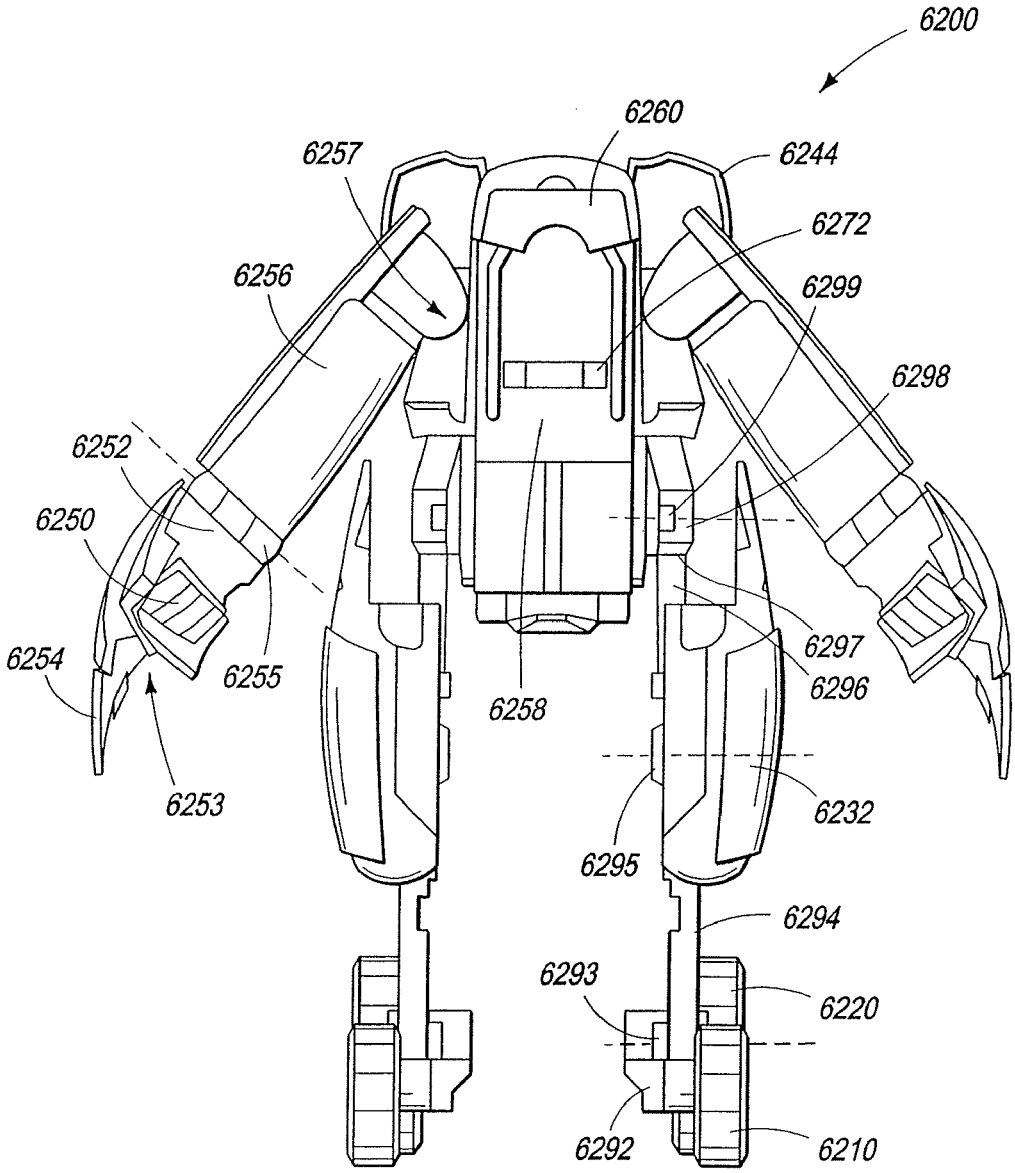
Figure 68:
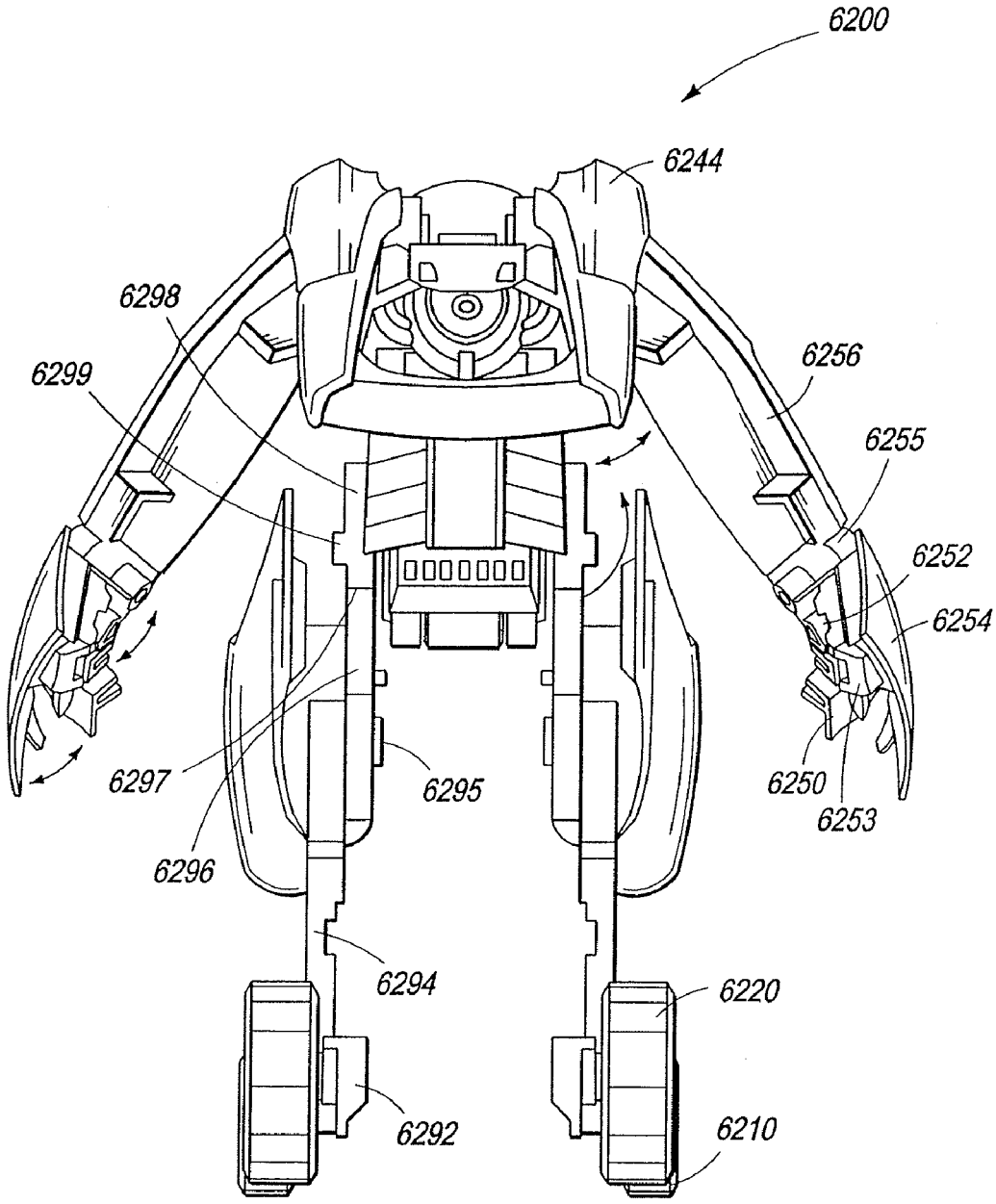

Referring now to FIGS. 62-68, an example reconfigurable toy that transforms between a vehicle configuration and a power-suit configuration simulating a rollerblading activity is described. In this particular example, the transformable toy can be transformed between a vehicle mode and the power-suit mode without separating pieces or disassembling the toy. Thus, the toy may remain a single portion during the transformation between a first configuration and a second configuration. As described in more detail below, one or more of the joints that enable transformation are also points of separation when a trigger mechanism is actuated. FIGS. 62-65 show an example reconfigurable toy 6200 in a vehicle configuration while FIGS. 66-68 show toy 6200 in a power-suit configuration. Toy 6200 can be reversibly reconfigured between the configurations of FIGS. 62 and 66 by manipulation of various components.

Figure 62:
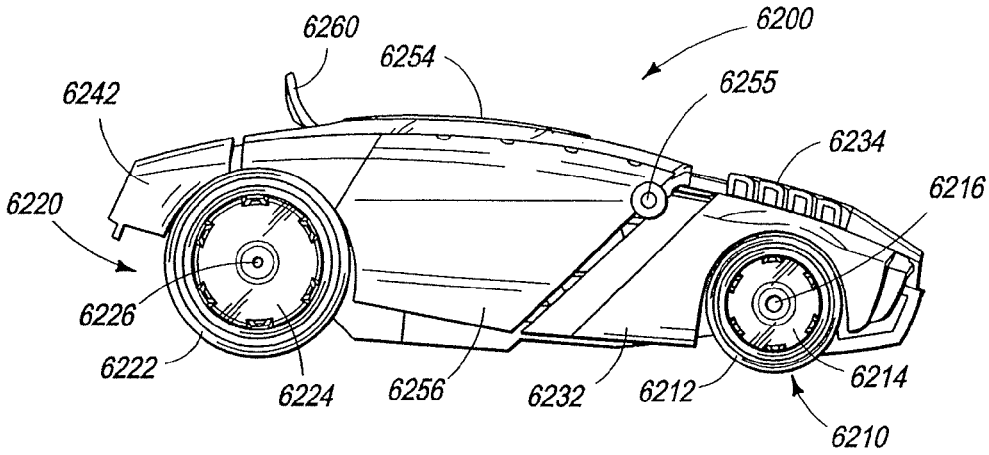
FIGS. 62-69 show a fifth example toy, which is transformable between a vehicle and a power-suit simulating a rollerblading activity.

Referring now to FIG. 62, a side view of toy 6200 in vehicle mode is shown. In this example, toy 6200 simulates a car that has two front wheels 6210 (only one of which is visible) and two rear wheels 6220 (only one of which is visible). While various types of wheels may be used, wheel 6210 can have an outer portion 6212, an inner portion 6214, and a center (or axle) portion 6216. Wheel 6220 is also shown having an outer portion 6222, inner portion 6224, and a center (or axle) portion 6226. Further, wheel 6220 can be identical to wheel 6210 in terms of coloring and construction, or can include some variations. Further, while various types of wheels may be used, the wheels of toy 6200 can be identical to the wheels of toy 100 in terms of coloring and construction, or can include some variations.

Continuing with FIG. 62, toy 6200 is shown with a vehicle front including a front quarter panel 6232 and a front hood 6234. The center canopy section of toy 6200 includes a top canopy 6254 and a side canopy 6256 coupled by elbow joint 6255. The rear of toy 6200 includes a rear quarter panel 6242 and rear hood 6244 (not shown in FIG. 62). As described below, each front quarter panel 6232 may be reconfigured to simulate an appendage, such as a leg, in the power-suit configuration. Further, the top canopy 6254 and side canopy 6256 may be reconfigured to simulate an appendage, such as an arm, in the power-suit configuration. As described in more detail below, the top canopy 6254 and side canopy 6256 may open thus allowing an action figure to be placed into and out of a cockpit 6258 (FIG. 66). Further, top canopy 6254 and side canopy 6256 may comprise plastic that is opaque, clear, translucent, or combinations thereof. In some embodiments, at least a portion of canopy sections 6254 and 6256 may comprise translucent materials that are colored similarly to section 6212 and 6222 of the wheels. Toy 6200 also is shown with an actuator configured as a trigger 6260. Further, trigger 6260 is configured to receive an actuation by a user, by an item ejected by an associated toy, and/or by an impact as described above with toy 100, for example. The trigger, when actuated, allows various portions and/or sections of the toy to uncouple from each other, thus simulating disassembly, collision, and the like.

Figure 63:
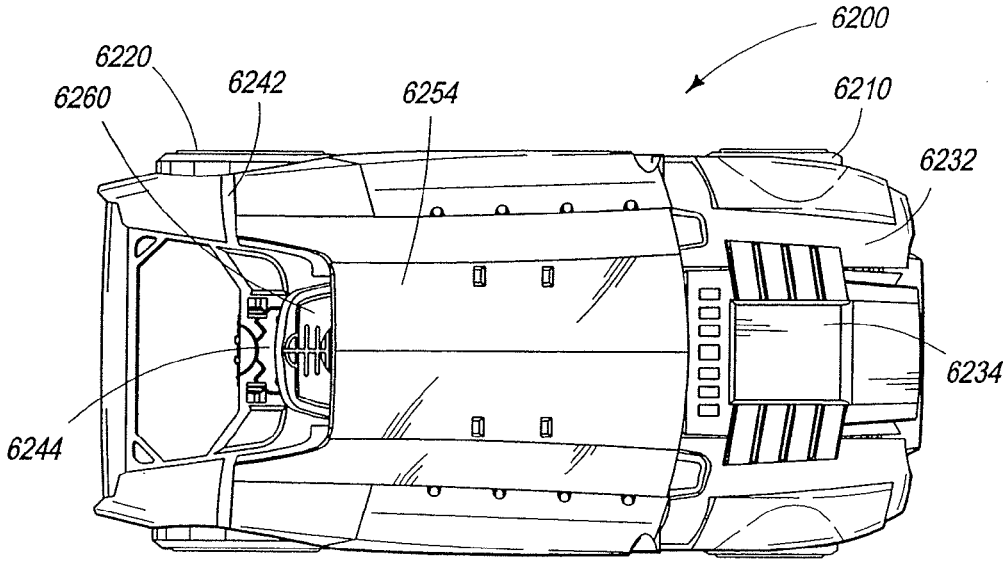

Referring now to FIG. 63, a top view of toy 6200 in a vehicle configuration is shown. In particular, FIG. 63 shows an top view of front hood 6234 and rear hood 6244. Further, the two front wheels 6210 and the two rear wheels 6220 of toy 6200 are also visible in FIG. 63. The top view of FIG. 63 also shows how toy 6200 has two front quarter panels 6232, two top canopy sections 6254, and two rear quarter panels 6242 when configured in the vehicle mode.

FIGS. 64 and 65 show a front view and side view, respectively, of toy 6200 in a vehicle configuration. In particular, the rear view of FIG. 65 shows cockpit 6258 disposed between undercarriage 6292. As will be described below, undercarriage 6292 simulates a rollerblade when toy 6200 is in the power-suit configuration.

Referring now to FIG. 66, a side view of toy 6200 in a power-suit configuration is shown. Specifically, FIG. 65 shows undercarriage 6292 coupling front wheel 6210 and rear wheel 6220, thus simulating a rollerblade and/or foot of the power-suit. Ankle joint 6293 is shown coupling lower leg 6294 and undercarriage 6292 by a single degree-of-freedom joint enabling lower leg 6294 to rotate relative to undercarriage 6292. Further, knee joint 6295 is shown coupling lower leg 6294 and upper leg 6296 by a single degree-of-freedom. Front quarter panel 6232 is shown coupled to upper leg 6296. Thus, each leg portion formed by upper leg 6296, lower leg 6294, and front quarter panel 6232 can transform into the front quarter panel in the vehicle configuration by reconfiguring the leg. Further, each leg is shown coupled to cockpit 6258 by joint 6299 having a single degree-of-freedom. Joint 6299 will be discussed in greater detail below with reference to FIG. 67.

Further, FIG. 66 shows how rear hood 6244 and front hood 6234 may rotated relative to the toy during transformation between the power-suit configuration and the vehicle configuration. Specifically, front hood 6234 is shown coupled to cockpit 6258 by joint 6249. Thus, joint 6249 allows front hood 6234 to rotate relative to the cockpit 6258 by a single degree-of-freedom joint. Rear hood 6244 is shown rotated to the rear of the power-suit and is connected to cockpit 6258 through linkage 6245. Further, rear hood 6244 is shown coupled to linkage 6245 by joint 6243 having a single degree-of-freedom and linkage 6245 is coupled to cockpit 6258 by joint 6247 also having a single degree-of-freedom. Thus, rear hood 6244 may rotate relative to cockpit 6258.

Trigger 6260 is shown coupled to the cockpit by a single degree-of-freedom joint 6261 allowing trigger 6260 to rotate relative to the cockpit. Further, top canopy 6254 is shown obscuring a portion of the arm of the power-suit; therefore each arm will be shown in greater detail in FIG. 67 below.

Figure 69:
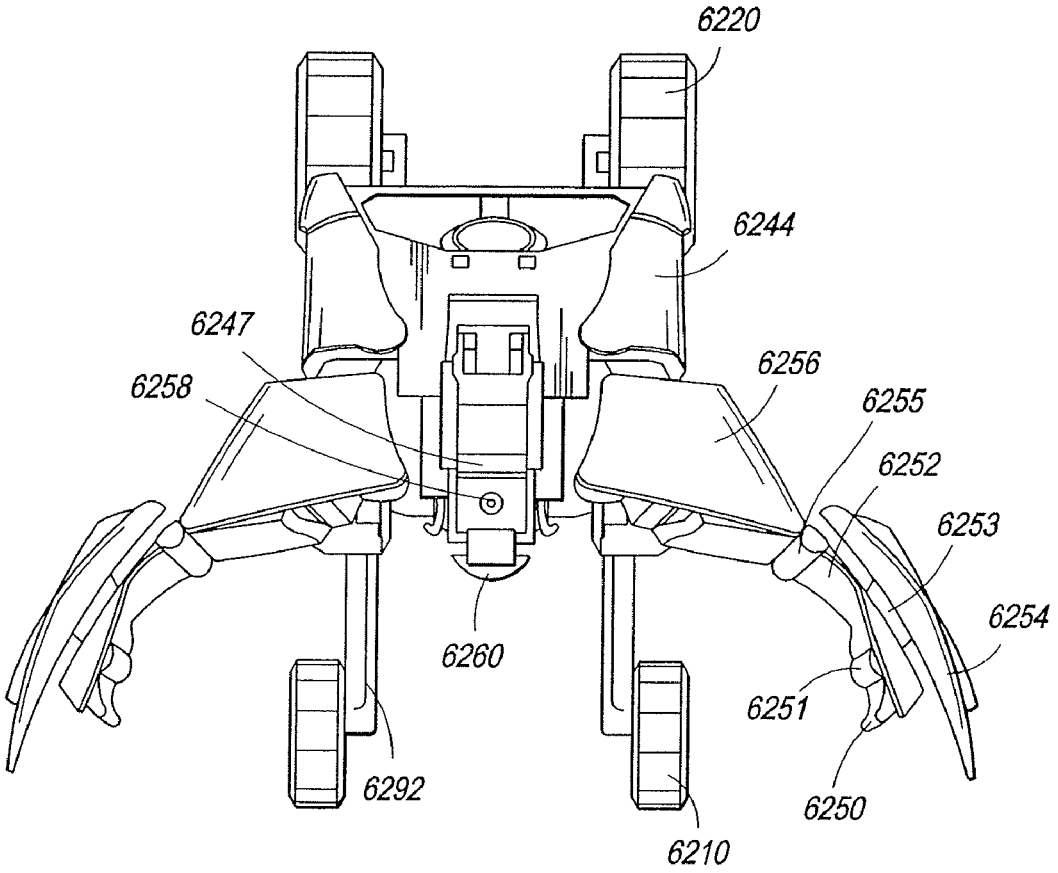

Referring now to FIG. 67, a front view of toy 6200 in a power-suit configuration is shown. Hand 6250 is coupled to lower arm 6252 by a wrist joint (FIG. 69). Top canopy 6254 is shown coupled to lower arm 6252 by joint 6253 (FIG. 68). Both joint 6251 and 6253 are shown as single degree-of-freedom joint, however other joints may be used, such as ball joints. Side canopy 6256 is also shown simulating an upper arm. Further, lower arm 6252 is shown coupled to side canopy 6256 (upper arm) by elbow joint 6255 having a single degree-of-freedom. Side canopy 6256 (upper arm) is shown coupled to cockpit 6258 by shoulder assembly 6257 having two degrees-of-freedom. Shoulder assembly 6257 may be of similar configuration as the shoulder joints shown above with reference to toy 100 and toy 2000. Cockpit 6258 is further shown configured with a clip 6272 for holding an action figure 6270 (not shown).

FIG. 67 also shows hip section 6298 coupling upper leg 6296 to cockpit 6258 by joint 6297 and joint 6299 each having a single degree of freedom. Thus, a hip joint is simulated by hip section 6298, joint 6297 and joint 6299. Front hood 6234 and rear hood 6244 are shown rotated toward the rear of cockpit 6258. Further, trigger 6260 is shown coupled to cockpit 6258.

Referring now to FIG. 68, a rear view of toy 6200 in a power-suit configuration is shown. Specifically, FIG. 66 shows joint 6253 as a single degree-of-freedom joint enabling rotation of top canopy 6254 relative to lower arm 6252. FIG. 68 also shows rear hood 6244 and front hood 6234 rotated to the rear of cockpit 6258. FIG. 69 shows a top view of toy 6200 configured as a power-suit. Further, wrist joint 6251 is shown coupling hand 6250 to lower arm 6252. FIG. 69 also provides an alternative view of the various portions discussed above with reference to FIGS. 62-68.

As described above, the wearable power-suit configuration of toy 6200 may be configured to simulate the 4 appendages of an action figure wearing the suit. Therefore, the arms and legs of the power-suit may be adjusted and/or reconfigured to be substantially adjacent to the arms and legs of the action figure, thus the wearable suit may act as an extension of the action figure's limbs. Specifically, for example, the right arm of the action figure may be substantially proximate to the right arm of the power-suit, the left arm of the action figure may be substantially proximate the left are of the power-suit, the right leg of the action figure may be substantially proximate the right leg of the power-suit, and the left leg of the action figure may be substantially proximate the left leg of the power-suit, thereby simulating an outfit that is worn by the action figure. In some examples, the power-suit configuration may contain a hat and/or feature that simulates the action figure's head thus further simulating a wearable suit. In this manner, the action figure wearing the power-suit may simulate a competitive or extreme sport activity such as rollerblading.

The process of reconfiguring toy 6200 can be similar to the method shown above with reference to toys 100 and 2000 among others. For example, toy 6200 may be reconfigured from a vehicle mode to a power-suit mode by extending the legs from a folded position by rotating the undercarriage 6290 downward from the bottom of the vehicle. Further, the arms may be extended outward from cockpit 6258 by rotating the top canopy 6254 and side canopy 6256 outward. Further, the front hood 6234 and the rear hood 6244 may be rotated behind cockpit 6258 as shown in FIGS. 66-68. Finally, the arms and legs of the power-suit may be adjusted as desired to simulate rollerblading action. Also, the process can be reversed to enable reversible reconfiguration wherein the power-suit is transformed into the vehicle. It should be appreciated that the order described above is not required, and various alternative orders may be used, if desired. Further, disassembly of toy 6200 may occur in a similar manner as shown above with reference to FIGS. 16-19, for example. The arms and the legs of toy 6200 may be removably coupled to cockpit 6258 as described above with reference to FIG. 15, among other methods.

In some embodiments, toy 6200 may be configured to receive one or more interchangeable accessories, a further discussion of which is presented below with reference to FIGS. 75-85.

Referring now to FIGS. 70-74, an example reconfigurable toy that transforms between a vehicle mode and a power-suit mode simulating a jumping activity is described herein. In this embodiment, the transformable toy 7000 can be transformed between the vehicle mode and the power-suit mode without physically separating portions of the toy or otherwise disassembling the toy in any way. Thus, the toy remains completely assembled during the transformation between a first mode (e.g. vehicle) and a second mode (e.g. power-suit), or between various configurations or poses within the same mode. However, while not shown in the following examples, in some embodiments, a transformable toy may be partially disassembled to facilitate the transformation process. As described in more detail below, one or more of the joints that enable transformation can be points of separation when a trigger is actuated.

Figure 70:
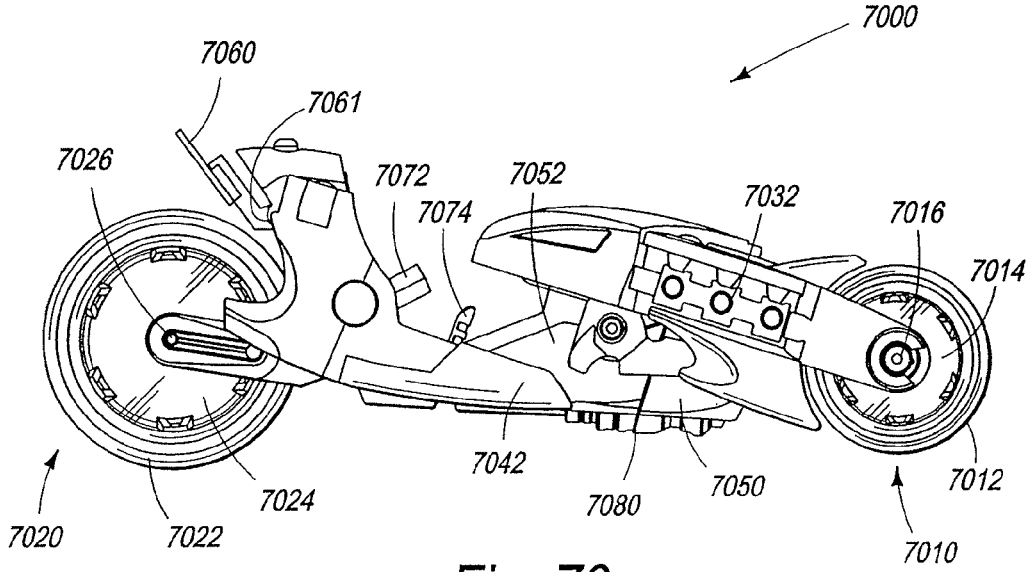
FIGS. 70-74 show a sixth example toy, which is transformable between a vehicle and a power-suit simulating a jumping activity.
Figure 71:
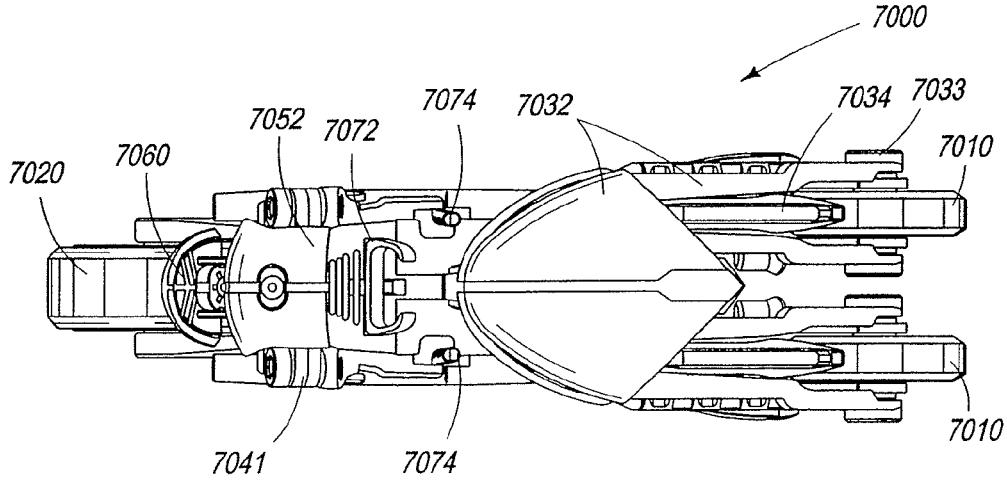
Figure 72:
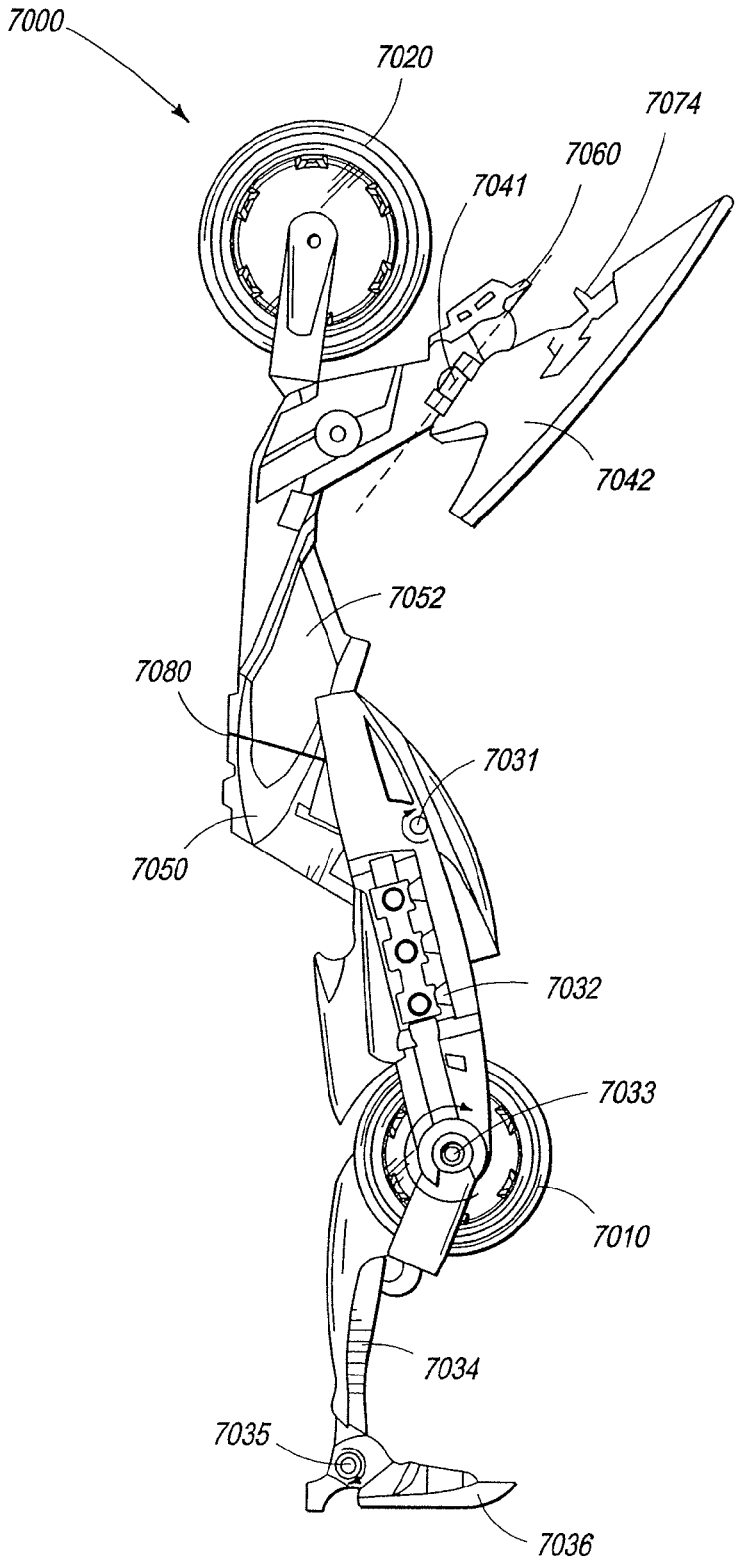
Figure 73:
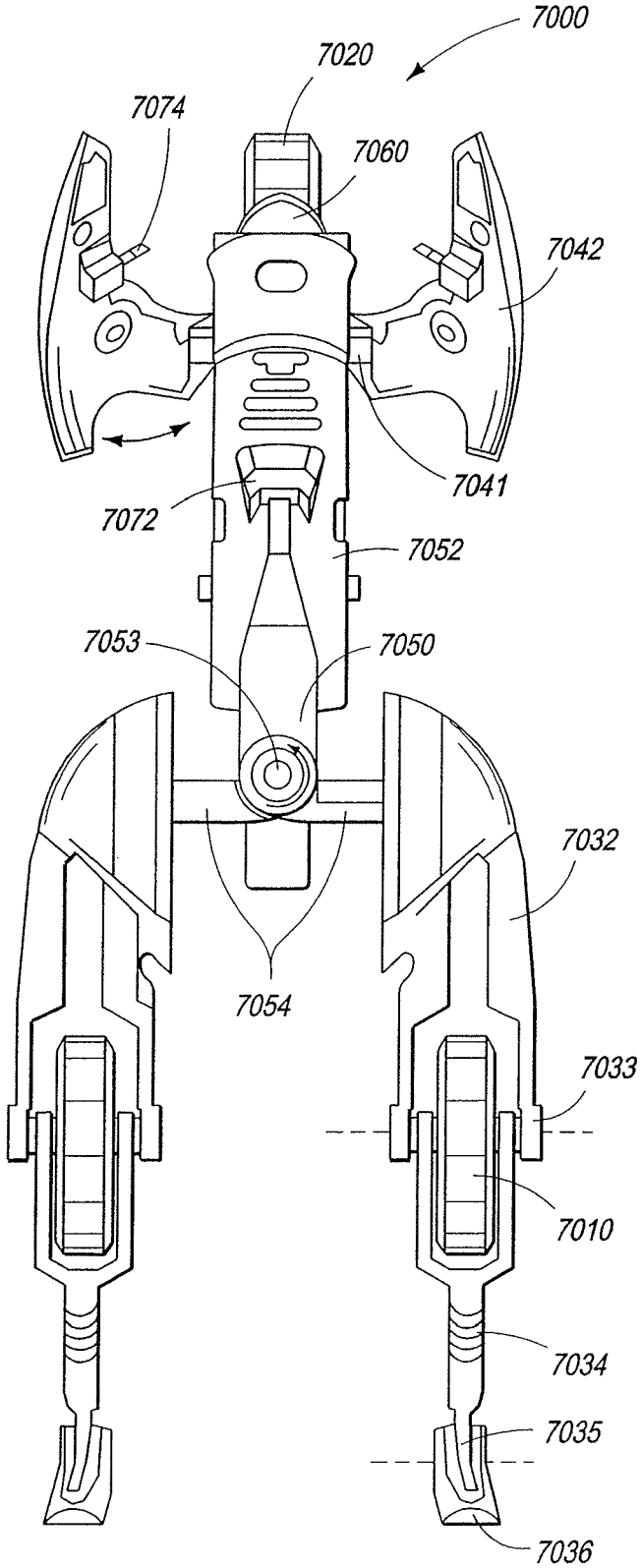
Figure 74:
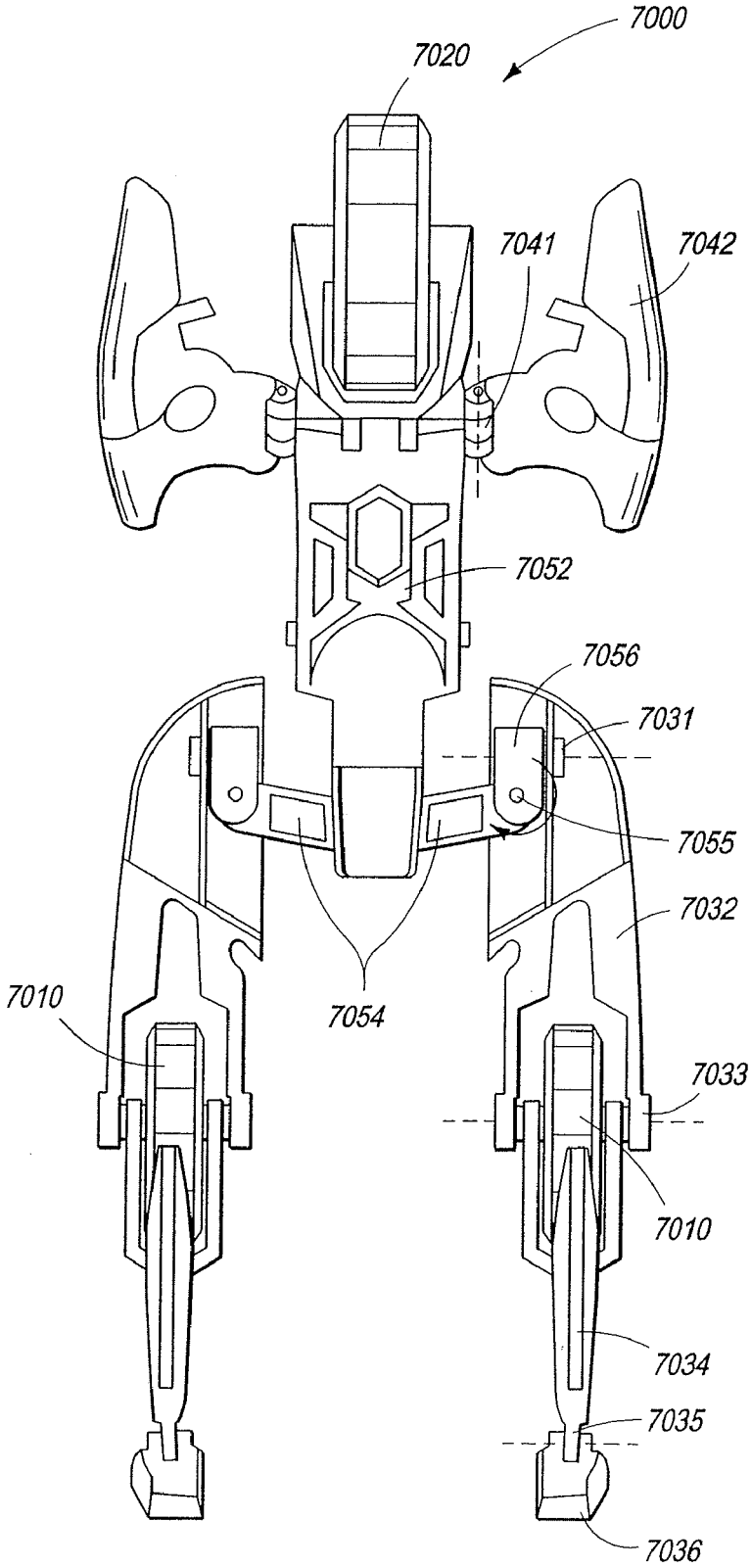

FIGS. 70 and 71 show an example reconfigurable toy product 7000 in a vehicle configuration, while FIGS. 72-74 show toy 7000 in a power-suit configuration simulating a jumping activity. Toy 7000 can be reversibly reconfigured between the configurations of FIGS. 70 and 72 by manipulation of various components.

Referring now to FIG. 70, a side view of toy 7000 in a vehicle configuration is shown. In this example, toy 7000 simulates a vehicle that has two front wheels (7010, only one of which is visible) and one rear wheel 7020. While various types of wheels may be used, wheel 7010 can have an outer portion 7012, an inner portion 7014, and a center (or axle) portion 7016. Wheel 7020 is also shown having an outer portion 7022, an inner portion 7024, and a center (or axle) portion 7026. Wheel 7020 can be identical to wheel 7010 in terms of coloring and construction, or can include some variations. Further, while various types of wheels may be used, the wheels of toy 7000 can be identical to the wheels of toy 100 in terms of coloring and construction, or can include some variations.

Continuing with FIG. 70, toy 7000 is shown with a front section 7032 coupled to front wheel 7010. The center of toy 7000 is shown comprising a cockpit 7052 coupled to the rear wheel 7020. Side section 7042 is shown coupled to cockpit 7052 by shoulder joint 7041. Bottom section 7050 is shown coupling front section 7032 to cockpit 7052 by releasable interface 7080. Further, cockpit 7052 is shown with a clip 7072) for receiving an action figure 7070 (not shown) and a pair of hand grips 7074 (only one is shown) for attaching to the hands of an action figure 7070 (not shown). Trigger 7060 is shown coupled to cockpit 7052 by joint 7061. In this manner, trigger 7060 may rotate relative to cockpit 7052 by single degree-of-freedom joint 7061 when actuated. Trigger 7060 may be configured such that upon activation releasable interface 7080 may be released causing disassembly of toy 7000, thus simulating toy collision, disassembly, and the like. Trigger 7060 may be configured to be actuated by a user or by an item ejected by an associated toy, or by a collision, etc.

Referring now to FIG. 71, a top view of toy 7000 in a vehicle configuration is shown. Specifically, the top view shows the two front wheels 7010 and one rear wheel 7020. Further, FIG. 70 shows front section 7032 coupled to lower leg 7034 and front wheel 7010 by knee joint 7033. Knee joint 7033 is shown as a single degree-of-freedom joint enabling rotation of lower leg 7034 relative to front wheel 7010 and front section 7032. As will be described below, front section 7032 (upper leg) and lower leg 7034 may be reversibly reconfigured to simulate a leg in the power-suit configuration.

Referring now to FIG. 72, a side view of toy 7000 in a power-suit configuration is shown. Specifically, the joints of the lower leg are visible. Beginning with the lower leg, foot section 7036 is shown coupled to lower leg 7034 by ankle joint 7035 having a single degree-of-freedom. As described above with reference to FIG. 70, knee joint 7033 is shown coupling lower leg 7034, front wheel 7010 and front section 7032 (upper leg), thus forming the leg of the power-suit. The leg of toy 7000 is shown coupled to bottom section 7050 by hip joint 7031. FIG. 71 further shows side section 7042 rotated outward about shoulder joint 7041 to simulate an arm.

Referring now to FIG. 73, a front view of toy 7000 in a power-suit configuration is shown. Specifically, FIG. 73 shows a detailed view of bottom section 7050 coupled to two hip sections 7054 by joint 7053 having a single degree-of-freedom. Further, FIG. 73 shows an alternative view of the two legs of toy 7000.

Referring now to FIG. 74, a rear view of toy 7000 in a power-suit configuration is shown. Specifically, FIG. 74 shows a detailed view of hip section 7054 coupled to front section 7032 by section 7056. In particular, hip section 7054 is shown coupled to section 7056 by joint 7055 having a single degree-of-freedom. Further, section 7056 is shown coupled to front section 7032 (upper leg) by hip joint 7031 having a single degree-of-freedom. Hip section 7054 is shown coupled to bottom section 7050 by joint 7053 (FIG. 73). Therefore, front section 7032 may rotate relative to bottom section 7050 by joints 7053, 7055, and 7031, thus enabling a broad range of motion for each of the legs, which are configured to simulate a jumping activity.

Toy 7000 may be reversibly reconfigured from the vehicle configuration of FIGS. 70-71 to the power-suit configuration of FIGS. 72-74 by rotating side sections 7042 outward to simulate arms. Further, front section 7032 (upper leg) and lower leg 7034 may be rotated outward and repositioned to simulate legs in the power-suit configuration. Further, the power-suit shown in FIGS. 72-74 can be reconfigured to simulate the four appendages of an action figure wearing the suit. Therefore, the arms and legs of the power-suit may be adjusted and/or reconfigured to be substantially adjacent to or proximate to the arms and legs of action figure wearing the suit. In this way, the wearable suit may act as an extension of the action figure's limbs. Specifically, for example, the right arm of the action figure may be substantially proximate to the right arm of the power-suit, the left arm of the action figure may be substantially proximate the left are of the power-suit, the right leg of the action figure may be substantially proximate the right leg of the power-suit, and the left leg of the action figure may be substantially proximate the left leg of the power-suit, thereby simulating an outfit that is worn by the action figure. In some examples, the power-suit configuration may contain a hat and/or feature that simulate the action figure's head thus further simulating a wearable suit. Also, the process can be reversed to enable reversible reconfiguration from the power-suit configuration to the vehicle configuration FIGS. 70 and 71. In some embodiments, toy 7000 may be configured to receive one or more interchangeable accessories, a further discussion of which is presented below with reference to FIGS. 75-85.

In some embodiments, accessories may interact with an associated toy or group of toys to further improve toy play and encourage toy interaction. However, as described above, accessories that provide only one function or one type of interaction may be apt to be monotonous. Thus, an accessory that provides a plurality of functions or interactions is provided herein.

Figure 75:
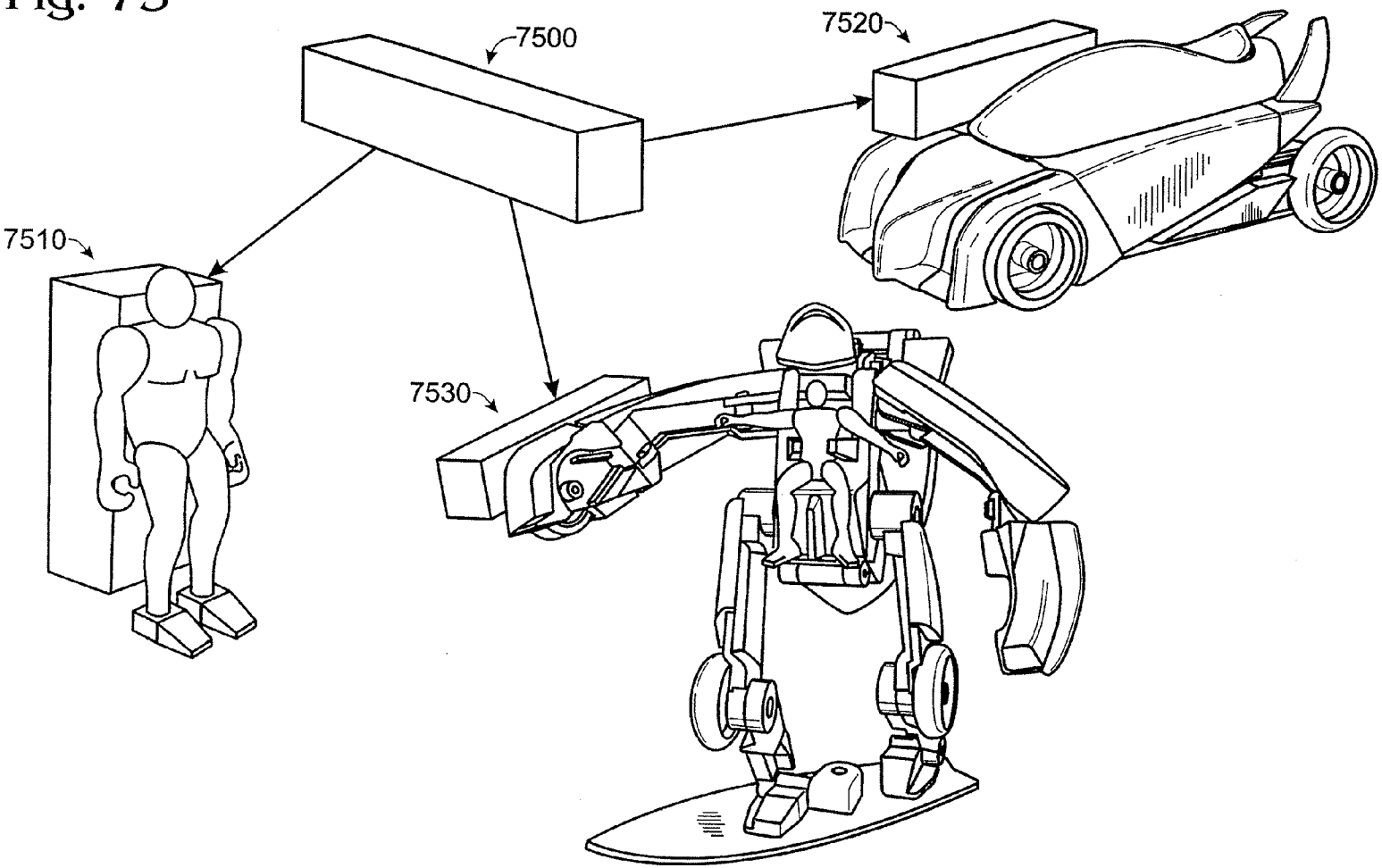
FIGS. 75-85 show several example interchangeable accessories for the transformable toys.

Referring now to FIG. 75, an example accessory is shown which is configured to provide a variety of functions and interact with a plurality of associated toys. As shown in FIG. 75, an accessory may be configured to be received by or coupled to multiple toys. For example, FIG. 75 shows accessory 7500 in a first play configuration 7510, wherein the accessory is coupled to an action figure. Accessory 7500 in the first play configuration 7510 may represent, for example, an article of clothing, a tool, or a simulated weapon, among a variety of other functions. Accessory 7500 is further shown coupled to a transformable toy configured as a vehicle, wherein the accessory provides a second play configuration 7520. The play configurations of 7520 and 7510 may differ in that the accessory provides a different fantastical element or function depending on toy interaction. For example, accessory 7500 in play configuration 7520 may represent a vehicle component. Further, accessory 7500 is shown in a third play configuration 7530, wherein the accessory is coupled to the toy in a power-suit configuration. Thus, in some embodiments, an accessory may interact with an action figure and with a transformable toy having at least a first and a second configuration or mode, wherein the transformable toy may also receive the action figure in each of the configurations. In this manner, an accessory may provide a plurality of play configurations, which may differ depending on the toy interaction.

Figure 76:
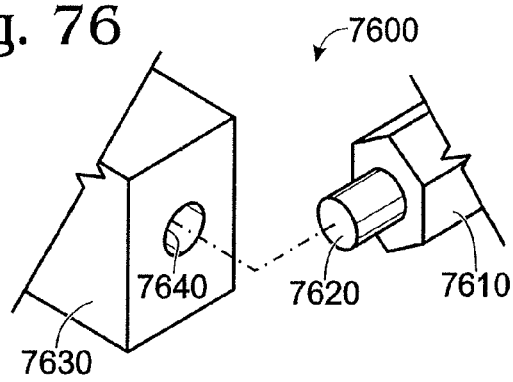
Figure 77:
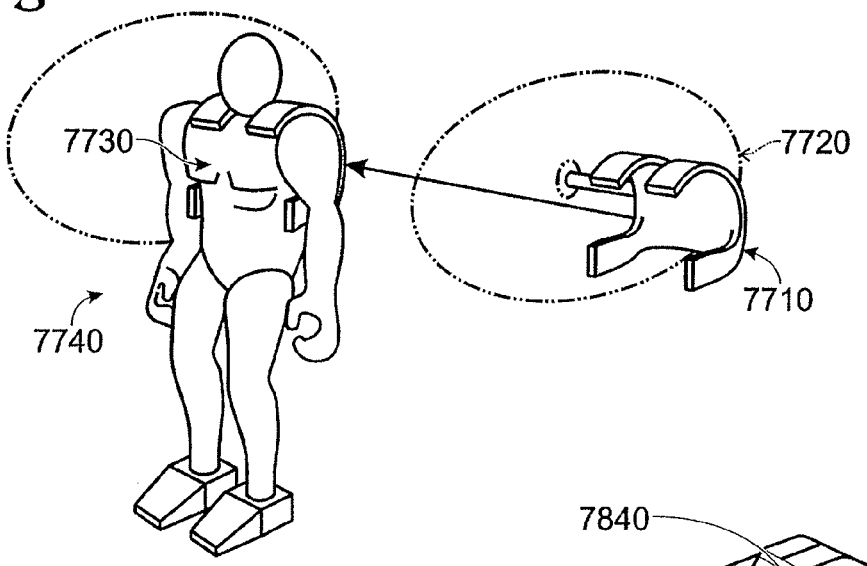

Accessories may be coupled to an associated toy in a variety of ways, two examples of which are shown in FIGS. 76 and 77. FIG. 76 shows an accessory/toy interface 7600 including an accessory 7610 having an attachment component 7620 shaped as a cylindrical protrusion projecting outward from the surface of the accessory, however other shapes are possible. Further, toy 7630 is shown having an attachment component 7640 configured as an opening with a substantially circular shape and sufficient depth for receiving the cylindrical attachment component 7620. Thus, in one example, accessory 7610 may be attached to toy 7630 by inserting the attachment component 7620 of accessory 7610 into the opening forming attachment component 7640 of toy 7630.

FIG. 77 shows another example of an attachment component for an accessory. Accessory 7720 is shown having an attachment component 7710 configured as a clip. Attachment component 7710 is shaped so that it can be releasably coupled to a torso portion 7730 of an action figure 7740. Thus, the accessory shown in FIG. 77 has a fantasy component that simulates a backpack that is worn by the action figure. In this manner, the accessory may be clipped to the action figure or unclipped from the action figure as desired by the user. It should be understood that while the attachment component of FIG. 77 is shown interacting with a toy action figure, other configurations are possible. For example, an attachment component having a similar clip configuration may be used to couple the accessory to a portion of a toy vehicle. Furthermore, the clip described above may be of a variety of shapes and/or sizes wherein the shape and/or size of the clip is dictated at least partially by the portion of the toy to which it is coupled.

In some embodiments, an accessory and/or an associated toy may include multiple attachment components, each having a different configuration. For example, an accessory may include both an attachment component 7620 of FIG. 76 and an attachment component 7710 of FIG. 77, among other methods of attachment. Thus, in some embodiments, a single accessory may be coupled to a toy or group of toys using more than one method of attachment.

Likewise, in some examples, a toy may be configured to receive one of a plurality of accessories. For example, an attachment component of an accessory may include a configuration that is universal among a group of toys. Thus, accessories may be interchangeable with one or more toys. As used herein, the term "interchangeable accessory" is used to describe any accessory that may be coupled to one of a plurality of toys and/or where a toy is configured to receive one of a plurality of accessories.

In some embodiments, accessories may be interchangeable among a select group of associated toys, wherein a first group of toys may be configured to receive a first attachment component and a second group of toys may be configured to receive a second attachment component different from the first. For example, toys representing action figures may use an attachment component similar to the clip described in FIG. 77, while transformable toys may use an attachment component similar to the cylindrical protrusion described in FIG. 76. Thus, in some embodiments, accessory/toy interaction may be limited by the configuration of the accessory and/or toy attachment component.

Some toys may be configured to receive more than one accessory at a time. For example, a toy representing an action figure may receive a plurality of accessories. Furthermore, each accessory may be coupled to the toy by a different attachment component. For example, an accessory that is configured to attach to a foot of the action figure may have a different attachment component from an accessory that is configured to attach to a hand of the action figure. Thus, in some embodiments, accessories may be directed to a specific toy interaction.

Figure 78:
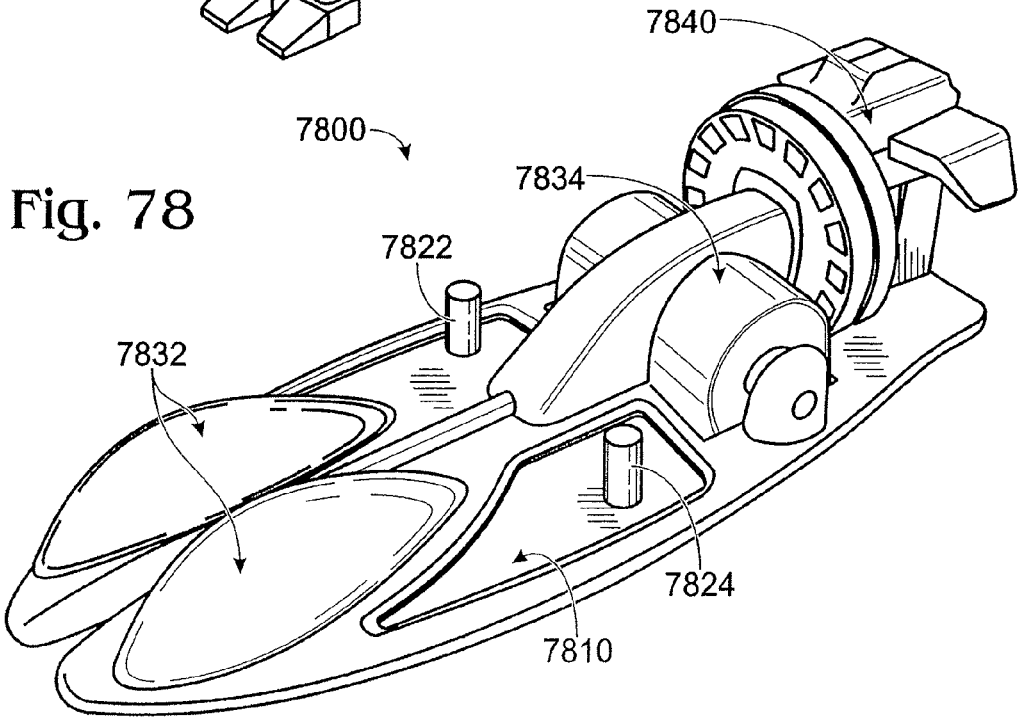

Referring now to FIG. 78, an example interchangeable accessory 7800 is shown. In particular, accessory 7800 is shown representing a wheeled vehicle that may be ridden by a toy action figure. Accessory 7800 includes a base 7810, two front rotatable wheels 7832, and a rotatable rear wheel 7834. Further accessory 7800 has a rear portion 7840 that represents a vehicle engine. Thus, the accessory may include a fantasy component that embodies a vehicle theme. Accessory 7800 is also shown having two attachment components that may be coupled to the bottom of an action figures foot as described above with reference to FIG. 76 or alternately coupled to the action figure's hands. Attachment components 7822 and 7824, which can be similar to attachment component 3750 of FIG. 37, are shown as cylindrical protrusions, however other methods of coupling the accessory to the action figure are possible. Therefore, a toy action figure may be coupled to attachment components 7822 and 7824 by inserting the cylindrical protrusions into a circular outlet located on the bottom of each foot of the action figure.

Figure 79:
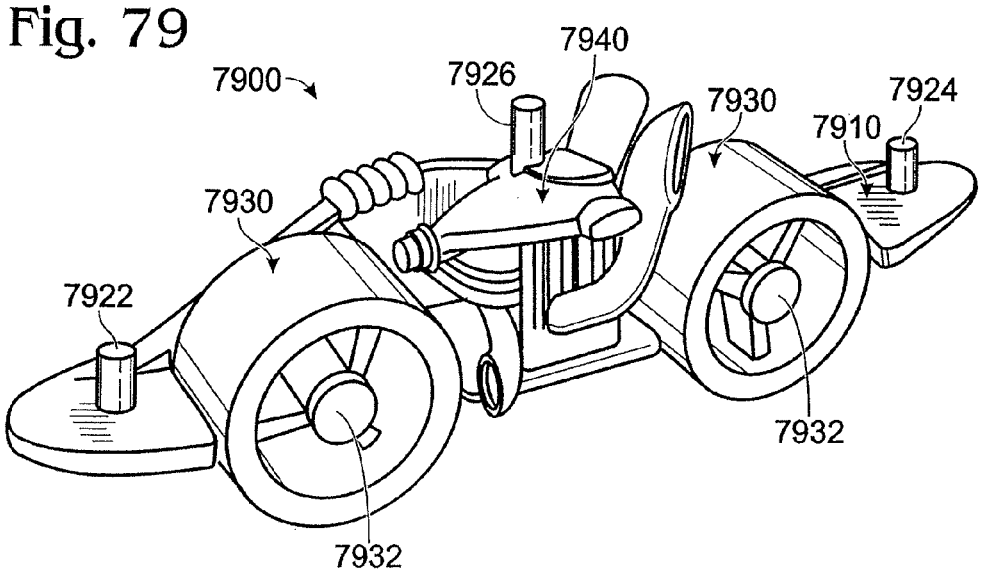

Referring now to FIG. 79, another example of an accessory is shown. Accessory 7900 is shown having three attachment components 7922, 7924, and 7926, where each attachment component is shown having a cylindrical shape as described above with reference to FIG. 76. Accessory 7900 is also shown having a fantasy component representing an engine 7940 powering two rotatable thrusters 7930 each rotating about joints 7932. As described above in FIG. 78, a toy action figure may be attached to accessory 7900 so that a left foot may be attached to attachment component 7922 and a right foot may be attached to attachment component 7924. Thus, the action figure can simulate riding accessory 7900. Further, attachment component 7926 may be used in a second configuration to attach accessory 7900 to a different toy. For example, accessory 7900 may be coupled to a toy vehicle by attachment component 7926.

Figure 80:
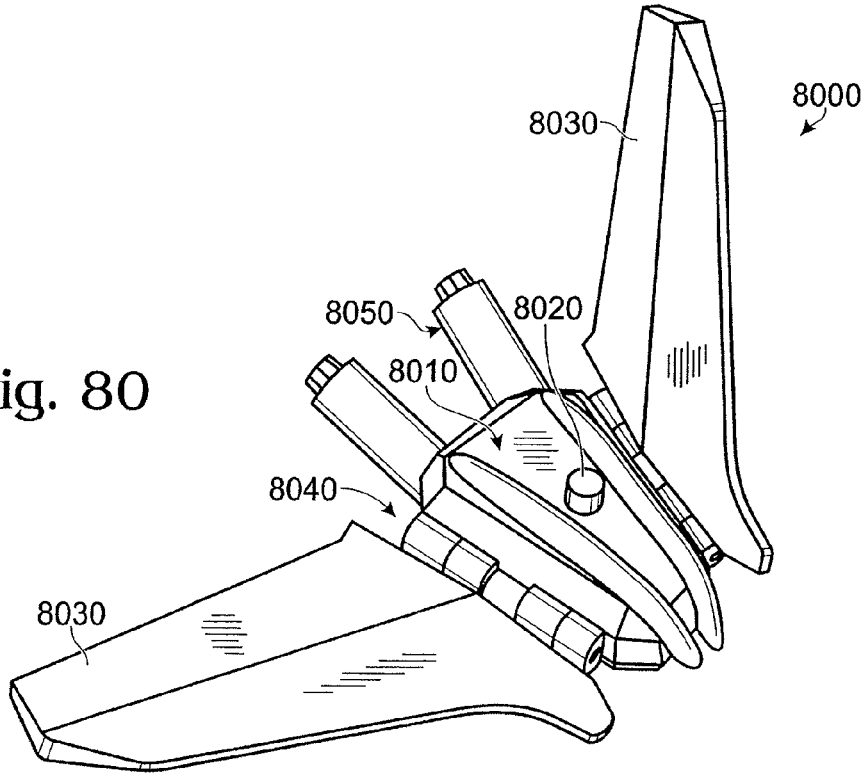

FIG. 80 shows accessory 8000 having an accessory body including a center portion 8010 and two wings 8030. Accessory 8000 is also shown having two sub-accessories 8050 releasably coupled to the center portion 8010. Wings 8030 are shown coupled to center portion 8010 by a joint 8040. Thus, each wing may rotate relative to center portion 8010. Further, accessory 8000 is shown having an actuator 8020 configured to uncouple sub-accessories 8050 from center portion 8010. In some embodiments, sub-accessories 8050 may be ejected or discharged from center portion 8010. In one example, the discharged sub-accessories can interact with other associated toys. For example, some toys may be configured to receive the discharged sub-accessory such that a trigger located on the surface of the toy is actuated by the discharged accessory striking the trigger. When the trigger is actuated, disassembly of the toy may occur such as described above with reference to FIGS. 16-19, for example.

Figure 81:
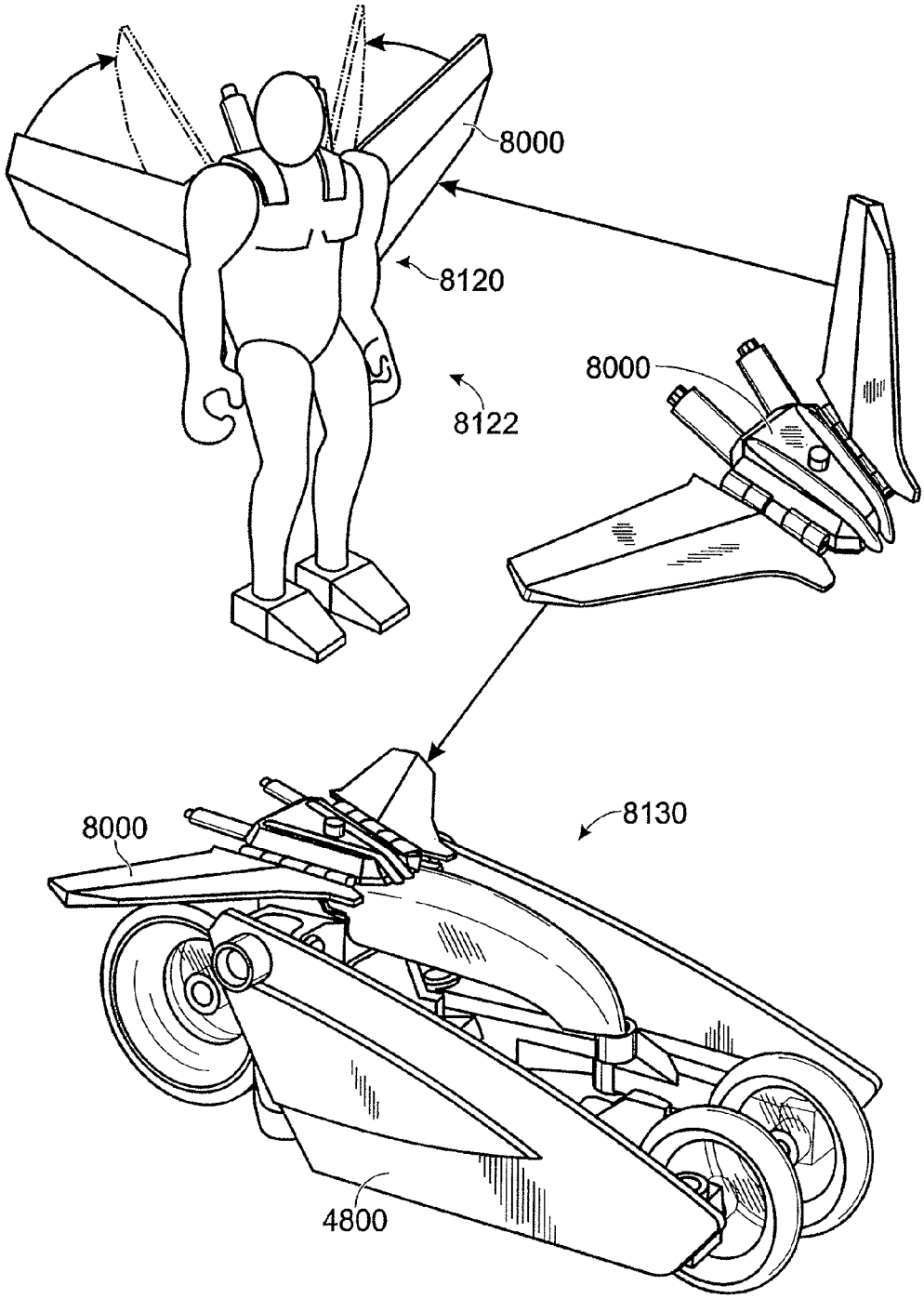

In some embodiments, an accessory's fantasy component may change depending on the toy with which it is interacting. FIG. 81 shows accessory 8000 interacting with two toys wherein the accessory has a first fantasy component when coupled to the first toy and a second fantasy component when coupled to the second toy. A first play configuration 8120 is shown where accessory 8000 is coupled to the torso section of a toy action figure 8122 with a clip as described above with reference to FIG. 77. Accessory 8000 in the first play configuration 8110 is shown having a fantasy component representing a backpack with retractable wings. A second play configuration 8130 is shown where accessory 8000 is coupled to transformable toy 4800 as described above with reference to FIG. 48. Accessory 8000 in the second play configuration has a fantasy component representing a vehicle component such as a rear spoiler. Thus, accessory 8000 can perform at least a different function in each of the play configurations. While FIG. 81 shows accessory 8000 having two play configurations, other play configurations are possible. For example, an accessory may be able to perform the same or similar function in each of its play configurations, wherein accessory 8000 may be coupled to the action figure and vehicle in a manner that allows a user to access the actuator in each play configuration. Thus, accessory 8000 may be able to discharge or eject subassemblies 8050 upon actuation of actuator 8020 in each of the play configurations.

Figure 82:
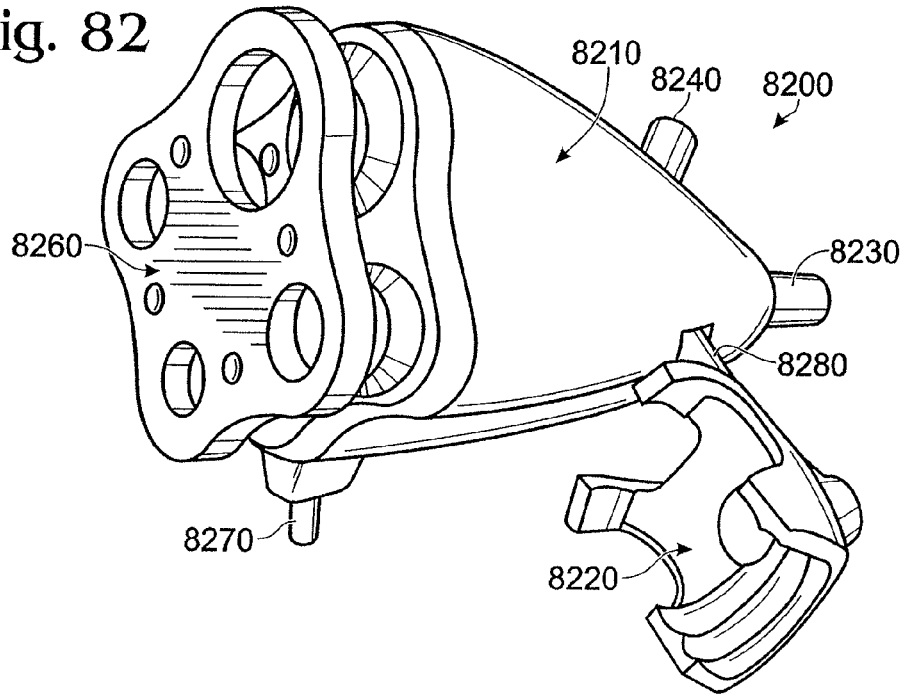

Referring now to FIG. 82, an accessory 8200 is shown having a releasable sub-accessory. Accessory 8200 is shown having an accessory body 8210 coupled to a first attachment component 8220 by portion 8280. Further, accessory 8200 is shown having sub-accessory 8260 releasably coupled to the accessory body 8210 such that actuation of actuator 8230 causes sub-accessory 8260 to be uncoupled from the accessory body 8210. In some embodiments, upon actuation of actuator 8230, sub-accessory 8260 may be forcibly discharged or ejected from the accessory body 8210 at a high rate of speed. Attachment component 8220 is shown as a clip that may be coupled to an action figure as described above with reference to FIG. 77. Accessory 8200 is also shown having a second actuator 8240 configured to uncouple portion 8280 of attachment component 8220. Further, accessory 8200 is shown having a second attachment component 8270 configured to attach to a vehicle in the manner described above with reference to FIG. 76. Thus, in a first play configuration, accessory 8200 may be coupled to a toy action figure, and in a second play configuration accessory 8200 may be coupled to a vehicle as will be described below in FIG. 83.

Figure 83:
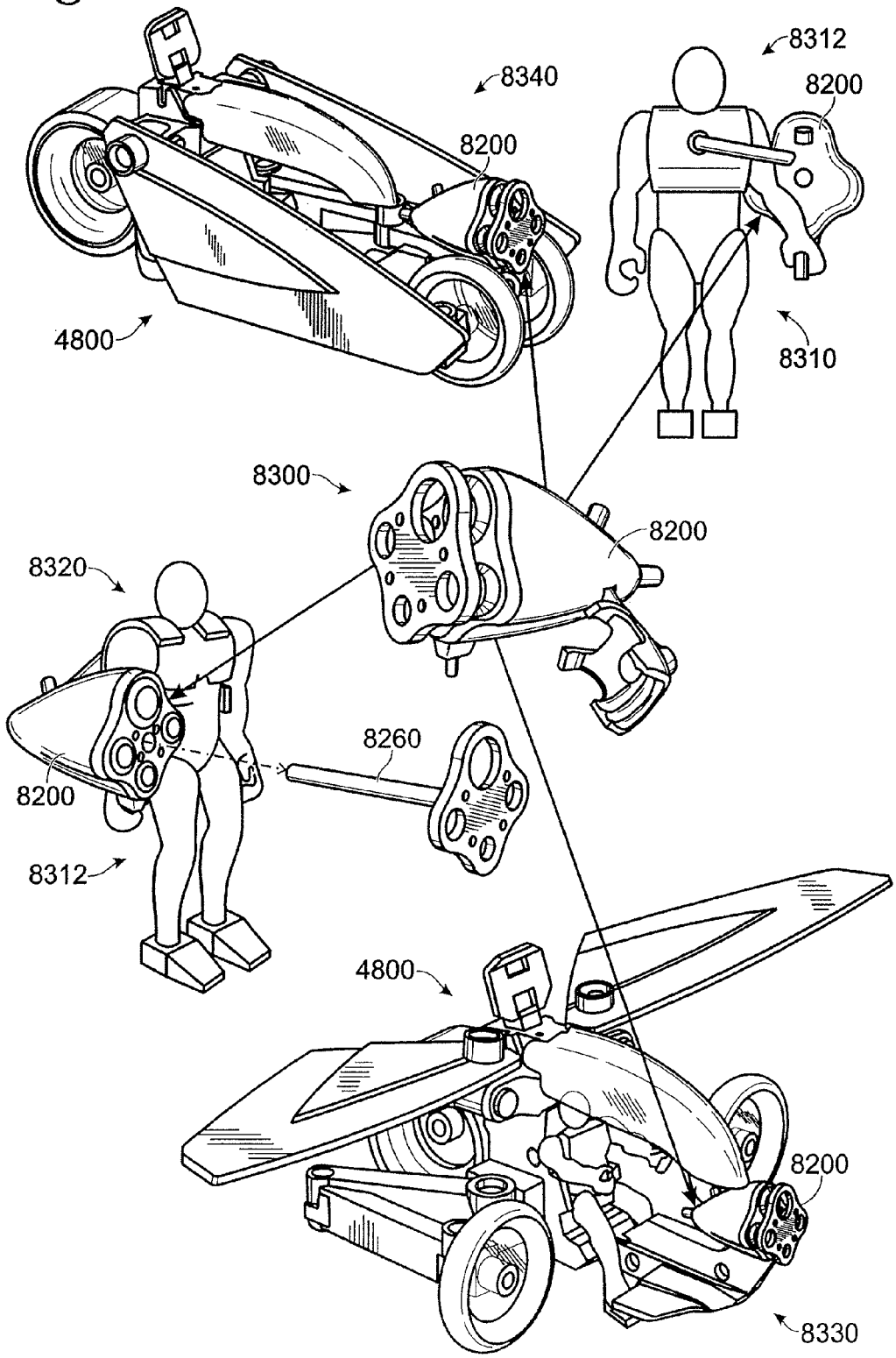

FIG. 83 shows accessory 8200 interacting with a variety of associated toys in a variety of play configurations. Play configuration 8300 shows accessory 8200 in a first configuration, wherein the accessory is not coupled to an associated toy. Thus, in some embodiments, accessory 8200 may provide a first play configuration as a stand alone accessory, wherein the accessory serves as the toy. For example, accessory 8200 may be used to eject a sub-accessory without being coupled to a toy, wherein the ejected sub-accessory may interact with an associated toy as described above with reference to FIGS. 15-19, causing disassembly. A second play configuration 8310 is shown where accessory 8200 is coupled to a toy action figure 8312 via a clip as described above with reference to FIG. 77. A third play configuration 8320 is shown where accessory 8200 is again coupled to an action figure, wherein the accessory 8200 is used to discharge sub-accessory 8260. Play configurations 8310 and 8320 show accessory 8200 coupled to the action figure where a first attachment component is shown as a clip coupled to the torso of the action figure as described above in FIG. 3 and a second attachment component is shown where a hand of the action figure is coupled to the second attachment component 8270. Thus, the fantasy component of accessory 8200 in play configurations 8310 and 8320 represent a backpack weapon that is operated by the action figure wearing the backpack. A fourth play configuration 8330 is shown where accessory 8200 is coupled to a transformable toy 4800 in a first transformation configuration representing a flying vehicle. A fifth play configuration 8340 is shown where accessory 8200 is coupled to the transformable toy in a second configuration representing a wheeled vehicle. Thus, accessory 8200 may be coupled to a transformable toy where the accessory performs a different function or has a different fantasy component in the first transformation configuration and second transformation configuration. For example, accessory 8200 can represent vehicle headlights in play configuration 8340 and a simulated weapon in play configuration 8330. While FIG. 83 shows accessory 8200 having five play configurations, more or less play configurations are possible.

Figure 84:
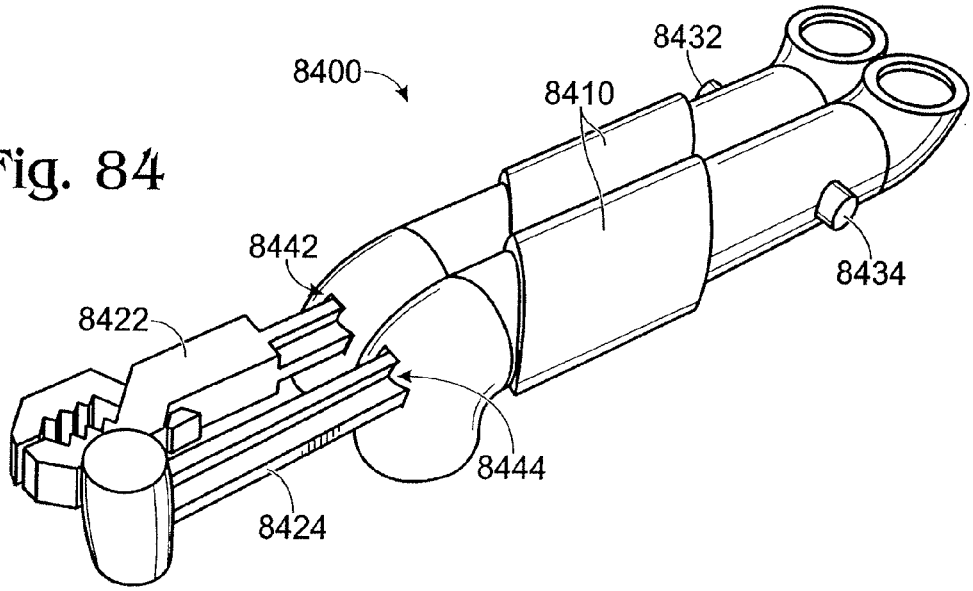

Referring now to FIG. 84, accessory 8400 is shown having two sub-accessories 8422 and 8424. Accessory 8400 is further shown having a fantasy component representing a vehicle exhaust system. Further, each of the sub-accessories are shown having a fantasy component representing tools where sub-accessory 8422 represents a wrench and sub-accessory 8424 represents a hammer. Thus, accessory 8400 and sub-accessories 8422 and 8424 may be part of a fantasy racing theme.

Accessory 8400 is shown having an accessory body 8410 representing a vehicle exhaust system. The accessory body 8410 is shown including two storage regions configured to store a portion of each of the sub-accessories. Further, accessory body 8410 is shown having two discharge regions 8442 and 8444 respectively corresponding to the two sub-accessories 8422 and 8424. Accessory 8400 is shown having two actuators 8432 and 8434 configured to respectively release sub-accessories 8422 and 8424. Actuation of actuator 8432 causes sub-accessory 8422 to be released from accessory 8400. Likewise, actuation of actuator 8434 causes sub-accessory 8424 to be released from accessory 8400. In some embodiments, actuation of either actuators may cause the sub-accessories to be discharged at a high rate of speed from accessory 8400. Thus, in one example, sub-accessories 8422 and 8424 may interact with other associated toys causing disassembly as described above, for example, with reference to FIGS. 15-19. Accessory 8400 may be coupled to an associated toy using the attachment components described above with reference to FIGS. 76 and 77 among other methods.

Figure 85:
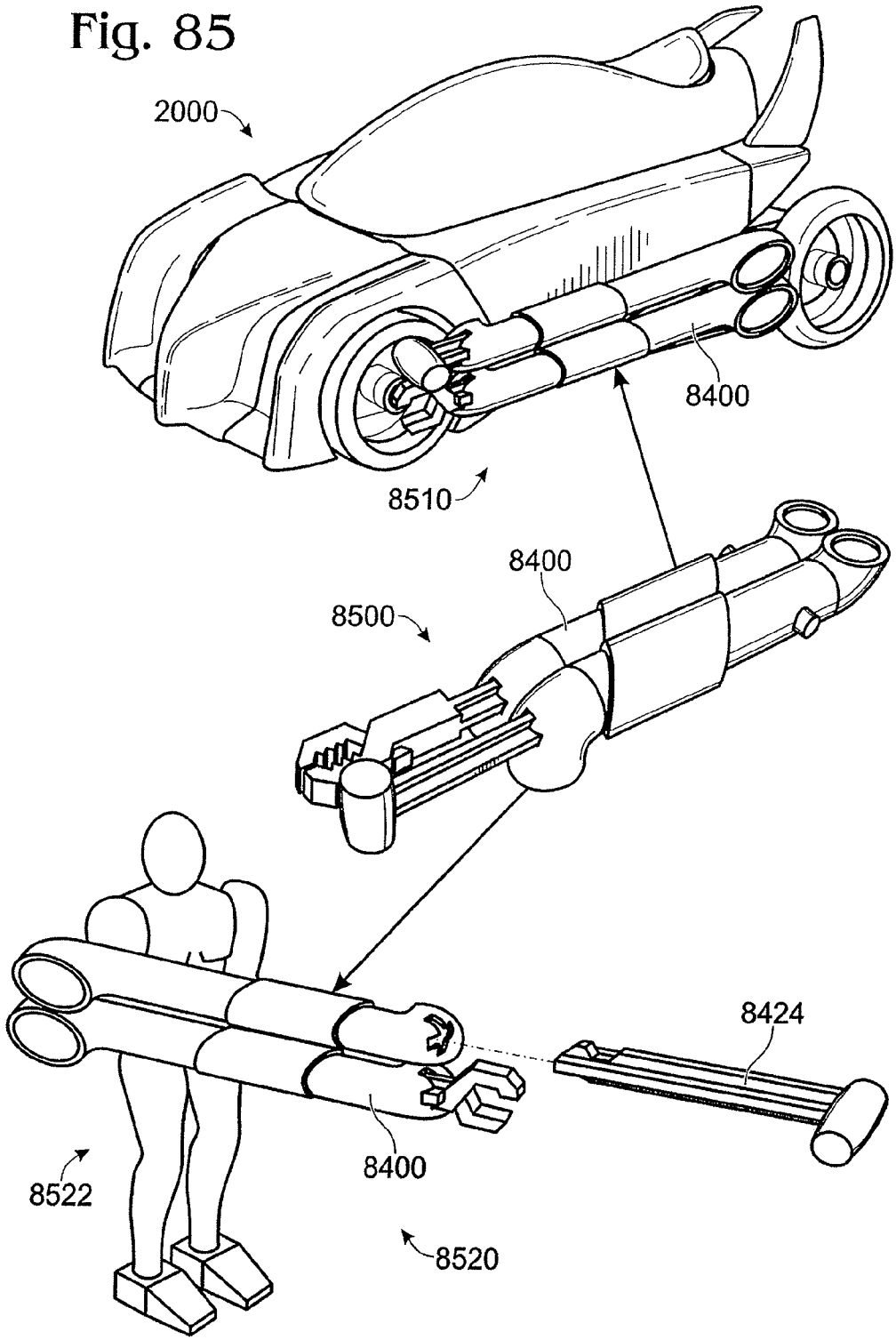

FIG. 85 shows accessory 8400 interacting with associated toys in a variety of play configurations. Configuration 8500 shows accessory 8400 in a first play configuration where the accessory is not attached to an associated toy. Thus, accessory 8400 may provide a first play configuration 8500 as a stand alone accessory, wherein the accessory serves as a toy. A second and third play configuration 8520 are shown, where accessory 8400 is coupled to action figure 8522 as described above with reference to FIG. 76 or 77. Further, sub-accessory 8424 is shown being discharged from accessory 8400. Thus, accessory 8400 in play configuration 8520 is shown having a fantasy component representing a tool, wherein the tool can be ejected, thus further simulating a projectile. A fourth play configuration 8510 is shown where accessory 8400 is coupled to toy vehicle 6200 as described above with reference to FIG. 62. Thus, accessory 8400 in play configuration 8510 is shown having a fantasy component representing a vehicle exhaust system. While FIG. 85 shows accessory 8400 having at least four play configurations, other play configurations are possible. For example, a fifth play configuration may include a power-suit configuration. Thus, the accessory coupled to the power-suit may provide a different play from that of the vehicle configuration and/or action figure 8522.

It will be appreciated that the configurations and embodiments disclosed herein are exemplary in nature, and that these specific embodiments are not to be considered in a limiting sense, because numerous variations are possible. The components, shapes, colors, etc. described herein are non-limiting examples and it should be understood that each of these features may be changed.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A reconfigurable toy being reconfigurable between a first configuration in which the toy resembles a vehicle and a second configuration in which the toy resembles a power-suit configuration to which a toy figure can be coupled, the toy comprising:

a body portion including:

a first leg movably coupled to the body portion, the first leg having a first transportation component coupled thereto, the first transportation component providing a first mode of transportation for the toy when the toy is in its first configuration, the first transportation component being engageable with a support surface; and a second leg movably coupled to the body portion, the second leg being movable relative to the body portion independent of the movement of the first leg relative to the body portion the second leg having a second transportation component coupled thereto, the second transportation component providing the same mode of transportation as the first transportation component, the second transportation component being engageable with the support surface; and a third transportation component resembling a board coupled to the first leg, such that the third transportation component provides a second mode of transportation different from the first mode of transportation, the third transportation component remaining coupled to the first leg as the toy is reconfigured between its first configuration and its second configuration and being engageable with the support surface when the toy is in its second configuration, the second leg being selectively engageable with the third transportation component when the toy is in its second configuration.

2. The reconfigurable toy of claim 1, wherein the first transportation component and the second transportation component are wheels that are coupled to the first leg and the second leg, respectively.

3. The reconfigurable toy of claim 1, wherein the third transportation component is movably coupled to the first leg.

4. The reconfigurable toy of claim 3, wherein the second leg can be placed into contact with the third transportation component.

5. The reconfigurable toy of claim 1, wherein the first mode of transportation involves the toy in its first configuration resembling a toy vehicle and the second mode of transportation involves the toy in its second configuration resembling a surfer.

6. The reconfigurable toy of claim 5, wherein the first and second transportation components are wheels and the third transportation component is a board.

7. The reconfigurable toy of claim 6, wherein the wheels remain coupled to the first leg and the second leg when the toy is in its first configuration and in its second configuration.

8. The reconfigurable toy of claim 1, wherein the first transportation component is a wheel that is rotatably coupled to the first leg and movable about a first axis, and the third transportation component is a board that is pivotally coupled to the first leg about a second axis that is substantially perpendicular to the first axis.

9. The reconfigurable toy of claim 8, wherein the first leg is coupled to the body portion at a joint, and the first axis is located at a point on the first leg that is between the joint and the intersection of the second axis with the first leg.

10. The reconfigurable toy of claim 1, wherein the toy figure has a waist area, and the toy includes the toy figure and the body portion includes a cockpit and a clip located in the cockpit and configured to clip to the waist area of the toy figure when the toy figure is placed in the cockpit.

11. A reconfigurable toy being reconfigurable between a first configuration in which the toy resembles a vehicle and a second configuration in which the toy resembles a power-suit configuration to which a toy figure can be coupled, the toy comprising:

a body portion including:

a cockpit that receives the toy figure, the cockpit including a clip that is configured to receive and retain the toy figure;

a first leg movably coupled to the body portion, the first leg having a first transportation component coupled thereto and a second transportation component coupled thereto, the first transportation component providing a first mode of transportation for the toy when the toy is in its first configuration and the second transportation component providing a second mode of transportation for the toy when the toy is in its second configuration, each of the first transportation component and the second transportation component being engageable with a support surface, the first leg including a front surface, a rear surface, and a first lower leg member with a first end and an opposite second end, the first end of the first lower leg member being pivotally coupled at the location of the first transportation component on the first leg, the second end of the first lower leg member being pivotally coupled to the second transportation component and remains coupled thereto as the toy is reconfigured between its first configuration and its second configuration, the second transportation component being substantially planar and extending beyond the front surface of the first leg and beyond the rear surface of the first leg; and a second leg movably coupled to the body portion, the second leg having a third transportation component coupled thereto, the third transportation component providing the first mode of transportation for the toy when the toy is in its first configuration, the third transportation component being engageable with the support surface, the second leg including a front surface, a rear surface, and a second lower leg member with a first end and an opposite second end, the first end of the second lower leg member being pivotally coupled at the location of the third transportation component on the second leg, the second end of the second lower leg member being selectively engageable to the second transportation component when the toy is in its second configuration.

12. The reconfigurable toy of claim 11, wherein the first transportation component and the third transportation component are wheels that are coupled to the first leg and the second leg, respectively.

13. The reconfigurable toy of claim 11, wherein the second transportation component resembles a ski that is pivotally coupled to the first leg.

14. The reconfigurable toy of claim 13, wherein the second transportation component has a planar lower surface.

15. The reconfigurable toy of claim 13, wherein the clip is a U-shaped clip that engages a waist portion of the toy figure when the toy figure is placed in the cockpit.

16. A reconfigurable toy being reconfigurable between a first configuration in which the toy resembles a vehicle and a second configuration in which the toy resembles a power-suit configuration to which a toy figure can be coupled, the toy comprising:

a body portion including:

a first leg movably coupled to the body portion, the first leg having a first wheel rotatably coupled thereto and mounted for movement relative to the first leg about a first axis, the first wheel being engageable with a support surface when the toy is in its first configuration; and a second leg movably coupled to the body portion, the second leg being movable relative to the body portion independent of the movement of the first leg relative to the body portion, the second leg having a second wheel coupled thereto and mounted for movement relative to the second leg about a second axis, the second wheel being engageable with the support surface when the toy is in its first configuration; and a board movably coupled to the first leg about a third axis, the third axis being substantially perpendicular to the first axis when the toy is in its second configuration, the second leg being selectively engageable with the board when the toy is in its second configuration, wherein the first and second wheels remain coupled to the first leg and the second leg, respectively, when the toy is in its first configuration and in its second configuration, and the board remains coupled to the first leg when the toy is in its first configuration and in its second configuration.

17. The reconfigurable toy of claim 16, wherein the board has a first surface and an opposite second surface, the first surface being engaged by the first leg and the second leg and the second surface being engageable with the support surface when the toy is in its second configuration.

* * * * *